US012515291B2

(12) United States Patent
Ren et al.

(10) Patent No.: US 12,515,291 B2
(45) Date of Patent: Jan. 6, 2026

(54) GRINDING TOOL KIT, APPARATUS AND METHOD FOR FINISH MACHINING OF ROLLING SURFACE OF BEARING ROLLER

(71) Applicant: TIANJIN UNIVERSITY, Tianjin (CN)

(72) Inventors: Chengzu Ren, Tianjin (CN); Chunlei He, Tianjin (CN); Guang Chen, Tianjin (CN); Chuanbin Yan, Tianjin (CN); Xinmin Jin, Tianjin (CN); Kun Geng, Tianjin (CN); Yongxiang Su, Tianjin (CN); Jing Zhang, Tianjin (CN); Weifeng Liu, Tianjin (CN); Lei Liang, Tianjin (CN)

(73) Assignee: TIANJIN UNIVERSITY, Tianjin (CN)

( * ) Notice: Subject to any disclaimer, the term of this patent is extended or adjusted under 35 U.S.C. 154(b) by 543 days.

(21) Appl. No.: 18/164,691

(22) Filed: Feb. 6, 2023

(65) Prior Publication Data

US 2023/0182255 A1 Jun. 15, 2023

Related U.S. Application Data

(63) Continuation of application No. PCT/CN2021/110194, filed on Aug. 3, 2021.

(30) Foreign Application Priority Data

Aug. 6, 2020 (CN) ..... 202010783379.3
Aug. 6, 2020 (CN) ..... 202010783389.7
Aug. 6, 2020 (CN) ..... 202010783401.4

(51) Int. Cl.
*B24B 5/37* (2006.01)
*B24B 5/22* (2006.01)
*B24B 11/02* (2006.01)

(52) U.S. Cl.
CPC ..... *B24B 5/37* (2013.01); *B24B 5/22* (2013.01); *B24B 11/02* (2013.01)

(58) Field of Classification Search
CPC .... B24B 5/20; B24B 5/22; B24B 5/24; B24B 5/26; B24B 5/37; B24B 11/02
(Continued)

(56) References Cited

U.S. PATENT DOCUMENTS 2,597,795 A * 5/1952 Hegeman ..... B24B 5/26 451/284
5,674,112 A * 10/1997 Steinwender ..... B24B 5/18 451/49

(Continued)

FOREIGN PATENT DOCUMENTS

JP 2002263994 A 9/2002

OTHER PUBLICATIONS

Internation Search Report of PCT/CN2018/080591, Mailed Oct. 28, 2021.

*Primary Examiner* — Joel D Crandall
*Assistant Examiner* — Marcel T Dion

(57) ABSTRACT

A grinding tool kit, apparatus and method for finish machining of a rolling surface of a bearing roller. The apparatus comprises a main machine, an external circulation system, a grinding tool kit and a grinding tool kit clamp. A configuration of the main machine comprise a grinding strip assembly rotary type and a grinding sleeve rotary type. The external circulation system comprises a collection unit (41), a sorting unit (42), a feeding unit (43) and a transmission subsystem. The grinding tool kit comprises a grinding sleeve (21) remaining coaxial during working, and a grinding strip assembly penetrating through the grinding sleeve (21), an inner surface of the grinding sleeve (21) is provided with a first spiral groove (211); and the grinding strip assembly comprises a plurality of grinding strips (22), front surfaces (Continued)

of which are provided with linear grooves (221) or second spiral grooves distributed in a circumferential columnar array.

8 Claims, 15 Drawing Sheets

(58) Field of Classification Search
USPC ..... 451/49, 50, 194
See application file for complete search history.

(56) References Cited

U.S. PATENT DOCUMENTS

| | | | | |
|---|---|---|---|---|
| 9,446,492 | B2 * | 9/2016 | Fujimoto | B24B 19/06 |
| 2011/0177760 | A1 * | 7/2011 | Tanaka | B24B 11/06 451/50 |
| 2021/0146494 | A1 * | 5/2021 | Ren | B24B 5/20 |

* cited by examiner

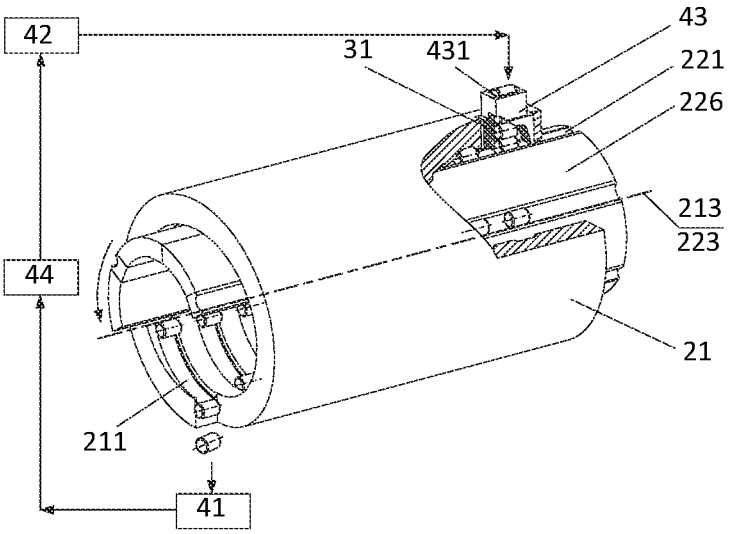
FIG. 2-5
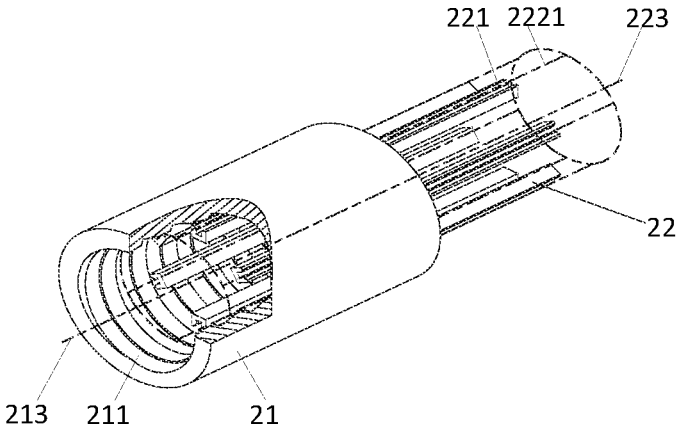
FIG. 3-1
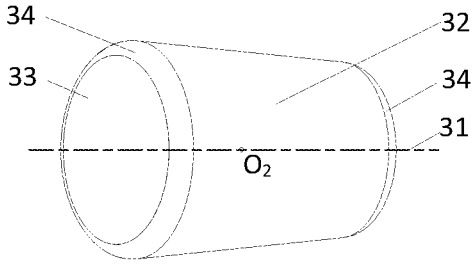
3-2(a)
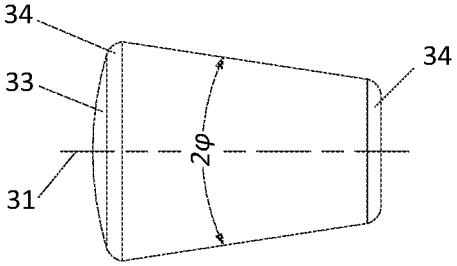
FIG. 3-2(b)

GRINDING TOOL KIT, APPARATUS AND METHOD FOR FINISH MACHINING OF ROLLING SURFACE OF BEARING ROLLER

CROSS-REFERENCE TO RELATED APPLICATIONS

This application is a continuation of International Patent Application No. PCT/CN2021/110194 with a filing date of Aug. 3, 2021, designating the United States, now pending, and further claims priority to Chinese Patent Application No. 202010783389.7 with a filing date of Aug. 6, 2020, Chinese Patent Application No. 202010783379.3 with a filing date of Aug. 6, 2020, Chinese Patent Application No. 202010783401.4 with a filing date of Aug. 6, 2020. The content of the aforementioned applications, including any intervening amendments thereto, are incorporated herein by reference.

TECHNICAL FIELD OF THE INVENTION

The present invention relates to a grinding tool kit, an apparatus and a method for finish machining of a rolling surface of a bearing roller, and belongs to the technical field of precision machining of bearing rollers.

BACKGROUND ART

Roller bearings are widely used in various rotating machinery. As one of the important parts of the roller bearing, a shape precision and size consistency of a rolling surface of a bearing roller has an important influence on the performances of the rolling bearing. At present, a known machining technology of the rolling surface of the bearing roller (cylindrical roller, tapered roller or spherical roller) is as follows: blank forming (turning or cold heading or emulsion), rough machining (soft grinding of rolling surface), heat treatment, semi-finishing (hard grinding of rolling surface) and finish machining, wherein the known main processing method for the finish machining of the rolling surface is superfinishing.

Superfinishing is a finishing method which uses fine-grained whetstone as a grinding tool, and the whetstone exerts a low pressure on a machined surface of a workpiece and makes high-speed micro-amplitude reciprocating vibration and low-speed feed motion along the machined surface of the workpiece, thus realizing micro-cutting.

At present, the finish machining of the rolling surface of the bearing roller (cylindrical roller, tapered roller or spherical roller) mostly adopts centerless penetration or centerless in-feed superfinishing methods. In the superfinishing process, the bearing rollers of the same batch enter a machining area in turn and undergo the superfinishing of the whetstone. Only a single (or a few) bearing rollers are machined at the same time, and a material removal amount of the rolling surface of the bearing roller is hardly affected by a diameter difference of the rolling surfaces of the bearing rollers in the same batch, so it is difficult to effectively improve diameter dispersion of the rolling surfaces of the bearing rollers by using a superfinishing apparatus.

At present, devices (apparatuses) and methods for finish machining of a rolling surface of a cylindrical roller further comprise:

Patent literature with a publication number of CN108908094A discloses a grinding apparatus and a grinding disc kit for finish machining of a rolling surface of a cylindrical roller, and the grinding disc kit comprises a pair of first and second grinding discs which are coaxial and have opposite front surface. The front surface of the first grinding disc comprises one group of linear grooves radially distributed on a base surface (regular conical surface) of the first grinding disc, and the front surface of the second grinding disc comprises one or multiple spiral grooves distributed on a base surface (regular conical surface) of the second grinding disc.

The above machining method belongs to multi-sample direct comparative machining, and has an ability to remove more rolling surface materials of cylindrical rollers with larger diameters and less rolling surface materials of cylindrical rollers with smaller diameters. However, when grinding the rolling surface of the cylindrical roller by using the above apparatus and method, because the linear grooves are distributed on the regular conical surface, on one hand, circumferences of a big end and a small end of the regular conical surface as the base surface of the grinding disc are different, and a quantity of the linear grooves is limited by the circumference of the small end of the regular conical surface, which affects a quantity of cylindrical rollers participating in grinding at the same time, and is not conducive to giving full play to the advantages of comparative machining. On the other hand, during grinding machining, because distances from different positions of the spiral groove on the regular conical surface to an axis of the grinding disc are different, rotational linear speeds of different positions of the spiral groove around the axis of the grinding disc relative to the linear groove are different, speeds of autorotation of the cylindrical roller in different positions of the spiral groove are different, a material removal rate of the rolling surface of the cylindrical roller and a wear rate of a working surface of the grinding disc change with the position of the cylindrical roller in the spiral groove, thus affecting the improvement of dimension consistency of the rolling surface of the cylindrical roller.

At present, devices (apparatuses) and methods for finish machining of a rolling surface of a tapered roller further comprise:

Patent literature with a publication number of CN108723979A discloses a grinding apparatus and a grinding disc kit for finish machining of a rolling surface of a tapered roller, and the grinding disc kit comprises a pair of first and second grinding discs which are coaxial and have opposite front surface. The front surface of the first grinding disc comprises one group of linear grooves radially distributed on a base surface (regular conical surface) of the first grinding disc, and the front surface of the second grinding disc comprises one or multiple spiral grooves distributed on a base surface (regular conical surface) of the second grinding disc.

The above machining method belongs to multi-sample direct-comparison machining, and has an ability to remove more rolling surface materials of tapered rollers with larger diameters and less rolling surface materials of tapered rollers with smaller diameters. However, when grinding the rolling surface of the tapered roller by using the above apparatus and method, because the linear grooves are distributed on the regular conical surface, on one hand, circumferences of a big end and a small end of the regular conical surface as the base surface of the grinding disc are different, and a quantity of the linear grooves is limited by the circumference of the small end of the regular conical surface, which affects a quantity of tapered rollers participating in grinding at the same time, and is not conducive to giving full play to the advantages of comparative machining. On the other hand, during grinding machining, because distances from different positions of the spiral groove on the regular conical surface to an axis of the grinding disc are different, rotational linear speeds of different positions of the spiral groove around the axis of the grinding disc relative to the linear groove are different, speeds of autorotation of the tapered roller in different positions of the spiral groove are different, a material removal rate of the rolling surface of the tapered roller and a wear rate of a working surface of the grinding disc change with the position of the tapered roller in the spiral groove, thus affecting the improvement of dimension consistency of the rolling surface of the tapered roller.

At present, devices (apparatuses) and methods for finish machining of a rolling surface of a spherical roller further comprise:

Patent literature with a publication number of CN108890516A discloses a grinding apparatus and a grinding disc kit for finish machining of a rolling surface of a convex cylindrical roller, and the grinding disc kit comprises a pair of first and second grinding discs which are coaxial and have opposite front surface. The front surface of the first grinding disc comprises one group of concave arc grooves radially distributed on a base surface (convex circular arc rotating surface) of the first grinding disc, and the front surface of the second grinding disc comprises one or multiple spiral grooves distributed on a base surface (convex circular arc rotating surface) of the second grinding disc.

The above machining method belongs to multi-sample direct-comparison machining, and has an ability to remove more rolling surface materials of spherical rollers with larger diameters and less rolling surface materials of spherical rollers with smaller diameters. However, when grinding the rolling surface of the spherical roller by using the above apparatus and method, because the concave arc grooves are distributed on the convex circular arc rotating surface, on one hand, circumferences of an inner edge and an outer edge of the convex circular arc rotating surface as the base surface of the grinding disc are different, and a quantity of the concave arc grooves is limited by the circumference of the inner edge of the convex circular arc rotating surface, especially when a curvature radius of an axial section profile of the rolling surface of the spherical roller is small, a curvature radius of a base line of the concave arc groove will also decrease. With reference to the fact that the quantity of the concave arc grooves is limited by the circumference of the inner edge of the concave arc rotating surface, a total length of the concave arc groove decreases sharply, and the quantity of the spherical rollers participating in grinding decreases sharply, which is not conducive to giving full play to the advantages of comparative machining. On the other hand, because distances from different positions of the spiral groove on the convex circular arc rotating surface to an axis of the grinding disc are different, rotational linear speeds of different positions of the spiral groove around the axis of the grinding disc relative to the concave arc groove are different, speeds of autorotation of the spherical roller in different positions of the spiral groove are different, a material removal rate of the rolling surface of the spherical roller and a wear rate of a working surface of the grinding disc change with the position of the spherical roller in the spiral groove, thus affecting the improvement of dimension consistency of the rolling surface of the spherical roller.

SUMMARY OF THE INVENTION

Aiming at the problems in the prior art, the present invention provides a grinding tool kit, an apparatus and a method for finish machining of a rolling surface of a bearing roller, and the apparatus provided with the grinding tool kit has an ability for finish machining of rolling surfaces of a large number of bearing rollers. For cylindrical rollers or tapered rollers or spherical rollers, a quantity of bearing rollers simultaneously participating in machining according to the present invention is greatly increased in comparison to that of the prior art, and advantages of multi-sample direct comparative machining can be better exerted. Moreover, a material removal rate of the rolling surface of the bearing roller and a wear rate of a working surface of a grinding tool do not change with a position of the bearing roller in the grinding tool kit, so that dimension consistency of the rolling surface of the bearing roller can be improved.

In order to solve the foregoing technical problems, the present invention provides a grinding tool kit for finish machining of a rolling surface of a bearing roller, comprising a grinding sleeve and a grinding strip assembly, wherein: during grinding machining, the grinding sleeve is coaxial with the grinding strip assembly, and the grinding strip assembly penetrates through the grinding sleeve; an inner surface of the grinding sleeve is provided with one or a plurality of first spiral grooves; the grinding strip assembly comprises at least three grinding strips distributed in a circumferential columnar array, a surface of each grinding strip opposite to the inner surface of the grinding sleeve is a front surface of the grinding strip, the front surface of each grinding strip is provided with one grinding strip groove penetrating through the grinding strip along a length direction of the grinding strip, and the grinding strip groove is a linear groove or a second spiral groove; and the first spiral groove and the second spiral groove are both cylindrical spiral grooves;

a surface of the first spiral groove comprises a working surface of the first spiral groove in contact with a bearing roller to be machined during grinding machining, and a surface of the grinding strip groove comprises a working surface of the grinding strip groove in contact with the bearing roller during grinding machining;

during grinding machining, one bearing roller is distributed at each intersection of the first spiral groove and the grinding strip groove; corresponding to each intersection, an area enclosed by the working surface of the first spiral groove and the working surface of the grinding strip groove is a grinding machining area; the grinding strip assembly and the grinding sleeve rotate relatively around an axis of the grinding strip assembly, and simultaneously, the grinding strip assembly and the grinding sleeve make relative reciprocating linear motion along the axis of the grinding strip assembly or make relative reciprocating spiral motion around the axis of the grinding strip assembly, or make no relative reciprocating motion, and the grinding strip applies a working pressure to the bearing roller distributed in the first spiral groove along a radial direction of the grinding strip assembly; the bearing roller is in contact with the working surface of the first spiral groove and the working surface of the grinding strip groove respectively in the grinding machining area; the bearing roller rotates around an axis of the bearing roller under the friction drive of the working surface of the first spiral groove or the working surface of the grinding strip groove, and simultaneously moves along the first spiral groove and the grinding strip groove respectively under the pushing action of the working surface of the grinding strip groove and the working surface of the first spiral groove, and the rolling surface of the bearing roller slides relative to the working surface of the first spiral groove and the working surface of the grinding strip groove, so that grinding machining of the rolling surface is realized; and when the grinding strip groove is the linear groove, the working surface of the grinding strip groove is a working surface of the linear groove, and when the grinding strip groove is the second spiral groove, the working surface of the grinding strip groove is a working surface of the second spiral groove;

the working surface of the first spiral groove is on a scanning surface of the first spiral groove, the scanning surface of the first spiral groove is a scanning surface with equal section, and the working surface of the first spiral groove is continuous or discontinuous; and the bearing roller is taken as a scanning outline A of solid scanning of the scanning surface of the first spiral groove, a scanning path A of the scanning surface of the first spiral groove is a cylindrical helix, the scanning path A passing through a geometric reference point on an axis of the bearing roller is denoted as a cylindrical helix A, all the cylindrical helices A are on the same cylindrical surface, and an axis of the cylindrical helix A is an axis of the grinding sleeve;

the working surface of the grinding strip groove is on a scanning surface of the grinding strip groove, the scanning surface of the grinding strip groove is a scanning surface with equal section, and the working surface of the grinding strip groove is continuous or discontinuous; when the grinding strip groove is the linear groove, the scanning surface of the grinding strip groove is a scanning surface of the linear groove, the bearing roller is taken as a scanning outlet B1 of solid scanning of the scanning surface of the linear groove, a scanning path B1 of the scanning surface of the linear groove is a straight line parallel to an array axis of the grinding strip assembly, the scanning path B1 passing through the geometric reference point is denoted as a straight line B, a distance from the straight line B to the array axis is an array radius, and the array axis is an axis of the grinding strip assembly; when the grinding strip groove is the second spiral groove, the scanning surface of the grinding strip groove is a scanning surface of the second spiral groove, the bearing roller is taken as a scanning outline B2 of solid scanning of the scanning surface of the second spiral groove, a scanning path B2 of the scanning surface of the second spiral groove is a cylindrical equidistant helix, the scanning path B2 passing through the geometric reference point is denoted as a cylindrical helix B, and all the cylindrical helices B are on the same cylindrical surface; an axis of the cylindrical helix B is the array axis of the grinding strip assembly, a radius of the cylindrical helix B is an array radius of the grinding strip assembly, and the array axis is the axis of the grinding strip assembly; and a normal section of the linear groove is a plane perpendicular to the straight line B, and a normal section of the second spiral groove is a plane perpendicular to a tangent of the cylindrical helix B and passing through a point of tangency of the tangent; and during grinding machining, the array radius is equal to a radius of the cylindrical helix A.

Further, in the grinding tool kit according to the present invention, wherein:

the bearing roller is one of a cylindrical roller, a tapered roller and a spherical roller; and according to different types of the bearing rollers, the geometric reference point, a relative positional relationship between the bearing roller as the scanning outline A of the scanning surface of the first spiral groove and the grinding sleeve, and a relative positional relationship between the bearing roller as the scanning outline B of the scanning surface of the grinding strip groove and the grinding strip assembly are respectively:

1) when the bearing roller is a cylindrical roller, the geometric reference point is a center of mass of the cylindrical roller; the grinding strip groove is the linear groove, and an axis of the cylindrical roller as the scanning outline B1 coincides with the straight line B; solid scanning is carried out on the scanning outline B1 along the scanning path B1, then a groove surface formed by enveloping of the scanning outline B1 on the front surface of the grinding strip is the scanning surface of the linear groove; the scanning path A is a cylindrical equidistant helix or a cylindrical non-equidistant helix; the axis of the cylindrical roller as the scanning outline A is parallel to an axis of the grinding sleeve; and solid scanning is carried out on the scanning outline A along the scanning path A, then a groove surface formed by enveloping of a rolling surface of the cylindrical roller as the scanning outline A and an end surface rounding at one end on the inner surface of the grinding sleeve is the scanning surface of the first spiral groove;

2) when the bearing roller is a tapered roller, the geometric reference point is a center of mass of the tapered roller; the grinding strip groove is the linear groove, an axis of the tapered roller as the scanning outline B1 is within an axial section of the grinding strip assembly, an included angle between the axis of the tapered roller and the straight line B is denoted as $\gamma$, a half cone angle of the tapered roller is denoted as $\phi$, and $\gamma+\varphi<45°$; solid scanning is carried out on the scanning outline B1 along the scanning path B1, then two V-shaped side faces formed by enveloping of a rolling surface of the tapered roller as the scanning outline B1 on the front surface of the grinding strip are the scanning surface of the linear groove; the scanning path A is a cylindrical equidistant helix; the axis of the tapered roller as the scanning outline A is within an axial section of the grinding sleeve, an included angle between the axis of the tapered roller and the axis of the grinding sleeve is denoted as $\delta$, and $\delta=\gamma$; solid scanning is carried out on the scanning outline A along the scanning path A, then a groove surface formed by enveloping of the rolling surface of the tapered roller as the scanning outline A and a big head-end surface on the inner surface of the grinding sleeve is the scanning surface of the first spiral groove; and the big head-end surface comprises a spherical base surface of the tapered roller or comprises an end surface rounding of a big head-end of the tapered roller or comprises the spherical base surface and the end surface rounding of the big head-end; and 3) when the bearing roller is a spherical roller, a cross-sectional truncated circle with a largest diameter of a rolling surface of the spherical roller is denoted as a maximum diameter truncated circle, and the geometric reference point is a circle center of the maximum diameter truncated circle;

the first spiral groove is continuous or discontinuous; when the first spiral groove is continuous, the grinding sleeve is of an integrated structure; and when the first spiral groove is discontinuous, the grinding sleeve is of a split structure, the grinding sleeve with the split structure consists of at least three grinding sleeve unit strips distributed in a circumferential columnar array, and each first spiral groove is intermittently distributed in the inner surface of the grinding sleeve formed by a front surface of each grinding sleeve unit strip; and a gap is provided between adjacent grinding sleeve unit strips along a circumferential direction of the grinding sleeve so as to facilitate the synchronous inward contraction of each grinding sleeve unit strip along a radial direction of the grinding sleeve to compensate wear of the working surface of the first spiral groove in the grinding machining process;

the spherical roller as the scanning outline A is one of a symmetric spherical roller without spherical base surface, a symmetric spherical roller with spherical base surface and an asymmetric spherical roller, the scanning path A is a cylindrical equidistant helix, and a helical rise angle of the cylindrical helix A is denoted as $\lambda$; an included angle between an axis of the spherical roller and the axis of the grinding sleeve is denoted as $\alpha$, and $\alpha+\lambda=90°$; a vertical line A from the circle center to the axis of the grinding sleeve is perpendicular to the axis of the spherical roller; a radius of curvature of an axial section profile of the rolling surface of the spherical roller is denoted as $R_c$, the radius of the cylindrical helix A is denoted as $R_0$, a radius of the maximum diameter truncated circle is denoted as r, and $R_c=R_0(1+\tan^2\lambda)+r$; and solid scanning is carried out on the scanning outline A along the scanning path A, then a groove surface formed by enveloping of the scanning outline A on the inner surface of the grinding sleeve is the scanning surface of the first spiral groove;

the spherical roller as the scanning outline B1 is the same as the spherical roller as the scanning outline A, when the grinding strip groove is the linear groove, an included angle between the axis of the spherical roller and the straight line B is denoted as $\beta$, and $\beta=\alpha$; a vertical line B from the circle center to the axis of the grinding strip assembly is perpendicular to the axis of the spherical roller; solid scanning is carried out on the scanning outline B1 along the scanning path B1, then a groove surface formed by enveloping of a rolling surface of the symmetric spherical roller without spherical base surface as the scanning outline B1 or the rolling surface of the symmetric spherical roller without spherical base surface as the scanning outline B1 and the end surface rounding at one end or the rolling surface of the symmetric spherical roller with spherical base surface as the scanning outline B1 and a reference end surface or the rolling surface of the asymmetric spherical roller as the scanning outline B1 and the big head-end surface on the front surface of the grinding strip is the scanning surface of the linear groove; and the reference end surface comprises the spherical base surface of the symmetric spherical roller with spherical base surface or comprises the end surface rounding at the same end as the spherical base surface or comprises the spherical base surface and the end surface rounding at the same end as the spherical base, and the big head-end surface comprises the spherical base surface of the asymmetric spherical roller or comprises the end surface rounding of the big head-end of the asymmetric spherical roller or comprises the spherical base surface and the end surface rounding of the big head-end;

the spherical roller as the scanning outline B2 is the same as the spherical roller as the scanning outline A, when the grinding strip groove is the second spiral groove, an included angle between the axis of the spherical roller and the axis of the grinding strip assembly is denoted as $\xi$, and $\xi=\alpha$; the vertical line B from the circle center to the axis of the grinding strip assembly is perpendicular to the axis of the spherical roller; a rotation direction of the cylindrical helix B is opposite to that of the cylindrical helix A; and solid scanning is carried out on the scanning outline B2 along the scanning path B2, then a groove surface formed by enveloping of the rolling surface of the symmetric spherical roller without spherical base surface as the scanning outline B2 or the rolling surface of the symmetric spherical roller without spherical base surface as the scanning outline B2 and the end surface rounding at one end or the rolling surface of the symmetric spherical roller with spherical base surface as the scanning outline B2 and the reference end surface or the rolling surface of the asymmetric spherical roller as the scanning outline B2 and the big head-end surface on the front surface of the grinding strip is the scanning surface of the second spiral groove.

The grinding tool kit in the present invention is used for the finish machining of the rolling surface of the bearing roller made of a ferromagnetic material, wherein, according to the different types of the bearing rollers, a cylindrical magnetic structure or a strip-shaped magnetic structure is provided, specifically:

1) when the bearing roller is a cylindrical roller or a tapered roller, the surface of the first spiral groove in contact with the rolling surface during grinding machining is denoted as a working surface I of the first spiral groove, the grinding sleeve is made of a magnetic conductive material, and the cylindrical magnetic structure is embedded in a solid inside of the grinding sleeve so as to form a grinding sleeve magnetic field with magnetic lines distributed on the axial section of the grinding sleeve in the grinding machining area; and the working surface I of the first spiral groove is embedded with one or multiple spiral belt-shaped non-magnetic conductive materials along the scanning path A, or one or multiple spiral belt-shaped grinding sleeve magnetic isolation grooves or multiple annular belt-shaped grinding sleeve magnetic isolation grooves are arranged along the scanning path A on a solid inner cavity side of the grinding sleeve facing away from the working surface I of the first spiral groove so as to increase magnetic resistance of the magnetic lines of the grinding sleeve magnetic field passing through the solid of the grinding sleeve at the working surface I of the first spiral groove; and 2) when the bearing roller is a spherical roller, the surface of the grinding strip groove in contact with the rolling surface during grinding machining is denoted as a working surface I of the grinding strip groove, the grinding strip is made of a magnetic conductive material, and the strip-shaped magnetic structure is embedded in the solid inside of the grinding strip along the scanning path B1 or the scanning path B2 so as to form a grinding sleeve magnetic field with magnetic lines distributed on a normal section of the grinding strip groove in the grinding machining area; and the working surface I of the grinding strip groove is embedded with one or multiple strip-shaped non-magnetic conductive materials along the scanning path B1 or the scanning path B2, or one or multiple strip-shaped grinding strip magnetic isolation grooves are arranged along the scanning path B1 or the scanning path B2 on a solid inner cavity side of the grinding strip facing away from the working surface I of the grinding strip groove so as to increase magnetic resistance of the magnetic lines of the grinding strip magnetic field passing through the solid of the grinding strip at the working surface I of the grinding strip groove.

The present invention also provides an apparatus for finish machining of a rolling surface of a bearing roller, comprising a main machine, an external circulation system, a grinding sleeve fixture, a grinding strip assembly fixture and the grinding tool kit for the finish machining of the rolling surface of the bearing roller according to the present invention, wherein:

the grinding sleeve fixture is used for clamping the grinding sleeve; when the grinding sleeve is of the split structure, the grinding sleeve fixture comprises one group of grinding sleeve unit strip mounting bases which are distributed in a circumferential columnar array and used for fixedly connecting the grinding sleeve unit strips and a radial contraction mechanism located at the periphery of the grinding sleeve unit strip mounting base; the radial contraction mechanism comprises a radial contraction member and a basic shaft sleeve coaxial with the grinding sleeve; the axis of the grinding sleeve is an axis of the grinding sleeve fixture; the basic shaft sleeve is connected to the main machine; and the radial contraction member is connected to the grinding sleeve unit strip mounting bases and the basic shaft sleeve respectively, and used for driving all the grinding sleeve unit strip mounting bases and the grinding sleeve unit strips on the grinding sleeve unit strip mounting bases to contract inward synchronously along a radial direction of the grinding sleeve fixture to compensate wear of the working surface of the first spiral groove and transmit torque between the basic shaft sleeve and the grinding sleeve unit strip mounting bases;

the grinding strip assembly fixture is used for clamping the grinding strip assembly; the grinding strip assembly fixture comprises one group of grinding strip mounting bases which are distributed in a circumferential columnar array and used for fixedly connecting the grinding strip and a radial expansion mechanism located in a center of the grinding strip assembly fixture; a back surface of the grinding strip is fixedly connected to a surface of the grinding strip mounting base located at a periphery of the grinding strip assembly fixture; the radial expansion mechanism comprises a radial expansion member and a basic mandrel coaxial with the grinding strip assembly; the axis of the grinding strip assembly is an axis of the grinding strip assembly fixture; the basic mandrel is connected to the main machine; and the radial expansion member is connected to the grinding strip mounting bases and the basic mandrel respectively, used for driving all the grinding strip mounting bases and the grinding strips on the grinding strip mounting bases to expand and load outward synchronously along a radial direction of the grinding strip assembly fixture and transmit torque between the basic mandrel and the grinding strip mounting bases;

according to different relative rotation modes of the grinding tool kit, a configuration of the main machine is a grinding strip assembly rotary type or a grinding sleeve rotary type; for the main machine of the grinding strip assembly rotary type, the main machine comprises a grinding strip assembly rotary driving member and a grinding sleeve fixture clamping member; the grinding strip assembly rotary driving member is used for clamping the basic mandrel in the grinding strip assembly fixture and driving the grinding strip assembly to rotate; the grinding sleeve fixture clamping member is used for clamping the grinding sleeve fixture; for the main machine of the grinding sleeve rotary type, the main machine comprises a grinding sleeve rotary driving member and a grinding strip assembly fixture clamping member; the grinding sleeve rotary driving member is used for clamping the grinding sleeve fixture and driving the grinding sleeve to rotate; and the grinding strip assembly fixture clamping member is used for clamping the basic mandrel in the grinding strip assembly fixture;

when the bearing roller is a spherical roller, the main machine further comprises a reciprocating motion system; for the main machine of the grinding strip assembly rotary type, when the grinding strip groove is the linear groove, the reciprocating motion system is used for driving the grinding strip assembly rotary driving member and the grinding sleeve fixture clamping member to make relative reciprocating linear motion along the axis of the grinding strip assembly, and when the grinding strip groove is the second spiral groove, the reciprocating motion system is used for driving the grinding strip assembly rotary driving member and the grinding sleeve fixture clamping member to make relative reciprocating linear motion along the axis of the grinding strip assembly or make relative reciprocating spiral motion around the axis of the grinding strip assembly; and for the main machine of the grinding sleeve rotary type, when the grinding strip groove is the linear groove, the reciprocating motion system is used for driving the grinding strip assembly fixture clamping member and the grinding sleeve rotary driving member to make relative reciprocating linear motion along the axis of the grinding strip assembly, and when the grinding strip groove is the second spiral groove, the reciprocating motion system is used for driving the grinding strip assembly fixture clamping member and the grinding sleeve rotary driving member to make relative reciprocating linear motion along the axis of the grinding strip assembly or make relative reciprocating spiral motion around the axis of the grinding strip assembly;

the external circulation system comprises a collection unit, a sorting unit, a feeding unit and a transmission subsystem;

the collection unit is arranged at an exit of the first spiral groove and used for collecting bearing rollers leaving the grinding machining area from the exit of each first spiral groove;

according to the different types of the bearing rollers, functions of the sorting unit are respectively:

1) when the bearing roller is a cylindrical roller or a symmetric spherical roller without spherical base surface or a symmetric spherical roller with spherical base surface, the sorting unit is used for sorting the bearing rollers into a queue required by the feeding unit; and 2) when the bearing roller is a tapered roller or an asymmetric spherical roller, the sorting unit is used for sorting the bearing rollers into a queue required by the feeding unit, and adjusting pointing directions of small-head ends of the bearing rollers to be consistent;

according to the different configurations of the main machine, a setting position and a working mode of the feeding unit in the apparatus are as follows:

1) for the main machine of the grinding strip assembly rotary type, the feeding unit is arranged at an entrance of the first spiral groove, and a frame of the feeding unit maintains a fixed relative position with the grinding sleeve; the feeding unit is provided with a feeding channel, and the feeding channel intersects the first spiral groove at the entrance; and the feeding unit is used for feeding the bearing roller into the grinding strip groove through the feeding channel; and 2) for the main machine of the grinding sleeve rotary type, the feeding unit is arranged at one end of the grinding sleeve located at the entrance of the first spiral groove, and the frame of the feeding unit and the grinding sleeve keep a fixed relative position in a direction of the axis of the grinding sleeve, while the frame of the feeding unit and the grinding strip groove keep a fixed relative position in a circumferential direction of the grinding strip assembly; an area of each grinding strip groove located outside an end surface of the grinding sleeve and close to the end surface is a feeding waiting area, and the end surface is located at an entrance end of the first spiral groove; and the feeding unit is used for feeding the bearing roller into the entrance of the first spiral groove through the feeding waiting area;

the transmission subsystem is used for transmitting the bearing roller between the units in the external circulation system;

during the grinding machining process, an external circulation moving path of the bearing roller in the external circulation system is: from the exit of the first spiral groove to the entrance of the first spiral groove through the collection unit, the sorting unit and the feeding unit in turn; and a spiral moving path of the bearing roller between the grinding strip assembly and the grinding sleeve along the first spiral groove is combined with the external circulation moving path in the external circulation system to form one sealed circle; and the bearing roller is combined with the external circulation movement path in the external circulation system along the spiral movement path of the first spiral groove between the grinding bar assembly and the grinding sleeve to form a closed cycle; and the radial contraction mechanism is one of a conical surface radial contraction mechanism, a communicating-type fluid pressure radial contraction mechanism and a micro-displacement unit radial contraction mechanism; and the radial expansion mechanism is one of a conical surface radial expansion mechanism, a communicating-type fluid pressure radial expansion mechanism and a micro-displacement unit radial expansion mechanism.

The apparatus in the present invention is used for the finish machining of the rolling surface of the bearing roller made of a ferromagnetic material, wherein, according to the different types of the bearing rollers, a cylindrical magnetic structure or a strip-shaped magnetic structure is provided, specifically:

1) when the bearing roller is a cylindrical roller or a tapered roller, the surface of the first spiral groove in contact with the rolling surface during grinding machining is denoted as a working surface I of the first spiral groove, and the grinding sleeve is made of a magnetic conductive material; and the cylindrical magnetic structure is arranged at one of the following two positions so as to form a grinding sleeve magnetic field with magnetic lines distributed on the axial section of the grinding sleeve in the grinding machining area:

a) the cylindrical magnetic structure is embedded in the solid inside of the grinding sleeve; the working surface I of the first spiral groove is embedded with one or multiple spiral belt-shaped non-magnetic conductive materials along the scanning path A, or one or multiple spiral belt-shaped grinding sleeve magnetic isolation grooves or multiple annular belt-shaped grinding sleeve magnetic isolation grooves are arranged along the scanning path A on a solid inner cavity side of the grinding sleeve facing away from the working surface I of the first spiral groove so as to increase magnetic resistance of the magnetic lines of the grinding sleeve magnetic field passing through the solid of the grinding sleeve at the working surface I of the first spiral groove; and b) the grinding sleeve fixture further comprises a magnetic sleeve made of a magnetic conductive material, and the grinding sleeve fixture clamps the grinding sleeve through the magnetic sleeve; the cylindrical magnetic structure is embedded in a middle part of an inner wall of the magnetic sleeve, the magnetic sleeve is sleeved on a periphery of the grinding sleeve, and the magnetic sleeve is connected with the grinding sleeve at both ends of the cylindrical magnetic structure to conduct the grinding sleeve magnetic field; and the working surface I of the first spiral groove is embedded with one or multiple spiral belt-shaped non-magnetic conductive materials along the scanning path A, or one or multiple spiral belt-shaped grinding sleeve magnetic isolation grooves or multiple annular belt-shaped grinding sleeve magnetic isolation grooves are arranged along the scanning path A on an outer wall of the grinding sleeve facing away from the working surface I of the first spiral groove so as to increase magnetic resistance of the magnetic lines of the grinding sleeve magnetic field passing through the solid of the grinding sleeve at the working surface I of the first spiral groove; and 2) when the bearing roller is a spherical roller, the surface of the grinding strip groove in contact with the rolling surface during grinding machining is denoted as the working surface I of the grinding strip groove, and the grinding strip is made of a magnetic conductive material; and the strip-shaped magnetic structure is arranged at one of the following two positions so as to form a grinding strip magnetic field with magnetic lines distributed on a normal section of the grinding strip groove in the grinding machining area:

a) the strip-shaped magnetic structure is embedded in the solid inside of the grinding strip along the scanning path B1 or the scanning path B2; and the working surface I of the grinding strip groove is embedded with one or multiple strip-shaped non-magnetic conductive materials along the scanning path B1 or the scanning path B2, or one or multiple strip-shaped grinding strip magnetic isolation grooves are arranged along the scanning path B1 or the scanning path B2 on a solid inner cavity side of the grinding strip facing away from the working surface I of the grinding strip groove so as to increase magnetic resistance of the magnetic lines of the grinding strip magnetic field passing through the solid of the grinding strip at the working surface I of the grinding strip groove; and b) the grinding strip mounting base is made of a magnetic conductive material, the strip-shaped magnetic structure is embedded in a middle part of the grinding strip mounting base relative to a surface layer on the back surface of the grinding strip along the scanning path B1 or the scanning path B2, and the grinding strip mounting base and the grinding strip are connected at both sides of the strip-shaped magnetic structure to conduct the grinding strip magnetic field; and the working surface I of the grinding strip groove is embedded with one or multiple strip-shaped non-magnetic conductive materials along the scanning path B1 or the scanning path B2, or one or multiple strip-shaped grinding strip magnetic isolation grooves are arranged along the scanning path B1 or the scanning path B2 on the back surface of the grinding strip facing away from the working surface I of the grinding strip groove so as to increase magnetic resistance of the magnetic lines of the grinding strip magnetic field passing through the solid of the grinding strip at the working surface I of the grinding strip groove; and the external circulation system further comprises a demagnetization unit, and the demagnetization unit is used for demagnetizing the bearing roller made of the ferromagnetic material magnetized by the grinding sleeve magnetic field of the cylindrical magnetic structure or the bearing roller made of the ferromagnetic material magnetized by the grinding strip magnetic field of the strip-shaped magnetic structure.

The present invention also provides a method for finish machining of a rolling surface of a bearing roller, employing the apparatus for the finish machining of the rolling surface of the bearing roller according to the present invention to realize batch-circulated finish machining of the rolling surface of the bearing roller, comprising the following steps of:

step 1: starting the radial expansion mechanism, so that the grinding strip assembly moves towards the inner surface of the grinding sleeve along the radial direction of the grinding strip assembly, and a space in the grinding machining area at each intersection of the first spiral groove and the grinding strip groove is capable of accommodating one bearing roller only;

step 2: starting the grinding strip assembly rotary driving member or the grinding sleeve rotary driving member, so that the grinding strip assembly and the grinding sleeve rotate relatively at an initial speed of 0 rpm to 10 rpm; and when the bearing roller is a spherical roller, starting the reciprocating motion system simultaneously;

step 3: starting the transmission subsystem, the sorting unit and the feeding unit; and adjusting operating speeds of the feeding unit, the transmission subsystem and the sorting unit, thus establishing a closed cycle of a spiral movement of the bearing roller along the first spiral groove between the grinding strip assembly and the grinding sleeve and the collection, sorting and feeding through the external circulation system;

step 4: adjusting the relative rotation speed of the grinding strip assembly and the grinding sleeve to a working rotation speed of 5 rpm to 60 rpm, and further adjusting the operating speeds of the feeding unit, the transmission subsystem and the sorting unit, so that storage quantities of the bearing rollers at all positions of the collection unit, the sorting unit, the feeding unit and the transmission subsystem in the external circulation system are matched and the external circulation is smooth and ordered;

step 5: filling a grinding liquid into the grinding machining area;

step 6, comprising:

1) adjusting the radial expansion mechanism, so that the grinding strip assembly further advances toward the inner surface of the grinding sleeve along the radial direction of the grinding strip assembly until the bearing roller in the grinding machining area contacts with the working surface of the first spiral groove and the working surface of the grinding strip groove respectively;

2) further adjusting the radial expansion mechanism to apply an average initial pressure of 0.5 N to 2 N to each bearing roller distributed in the grinding machining area; the bearing roller rotating around the axis thereof under the friction drive of the working surface of the first spiral groove or the working surface of the grinding strip groove, and moving along the grinding strip groove and the first spiral groove respectively under the pushing action of the working surface of the first spiral groove and the working surface of the grinding strip groove simultaneously; and the rolling surface sliding relative to the working surface of the first spiral groove and the working surface of the grinding strip groove, and the rolling surface starting to undergo grinding machining of the working surface of the first spiral groove and the working surface of the grinding strip groove;

step 7: further adjusting the radial expansion mechanism along with the stable operation of the grinding machining to apply an average working pressure of 2 N to 50 N to each bearing roller distributed in the grinding machining area; the bearing roller maintaining the contact relationship with the working surface of the first spiral groove and the working surface of the grinding strip groove, the rotation movement around the axis thereof and the movement relationship along the grinding strip groove and the first spiral groove in step 6, and the rolling surface continuously undergoing the grinding machining of the working surface of the first spiral groove and the working surface of the grinding strip groove;

step 8: when the grinding sleeve is of the split structure, adjusting the radial contraction mechanism to compensate the wear of the working surface of the first spiral groove in real time; sampling the bearing roller after a period of grinding machining; when a surface quality, a shape precision and a size consistency of the rolling surface dissatisfy technical requirements, continuing the grinding machining in the step; and when the surface quality, the shape precision and the size consistency of the rolling surface satisfy the technical requirements, entering step 9; and step 9: reducing the pressure applied to the bearing roller and finally making the pressure reach zero; stopping the operation of the sorting unit, the feeding unit and the transmission subsystem, and adjusting the relative rotation speed of the grinding strip assembly and the grinding sleeve to zero; stopping the operation of the reciprocating motion system when the reciprocating motion system is already started in step 2; stopping filling the grinding liquid into the grinding machining area; and returning the grinding strip assembly back to an off-working position along the radial direction of the grinding strip assembly.

The present invention also provides a method for finish machining of a rolling surface of a bearing roller, which is different from the previous method in that:

employing the apparatus for the finish machining of the rolling surface of the bearing roller above mentioned to realize batch-circulated finish machining of the rolling surface of the bearing roller made of the ferromagnetic material:

the specific steps of the method of the present invention are different from the specific steps of the previous method in that:

step 3: starting the transmission subsystem, the sorting unit, the feeding unit and the demagnetization unit; and adjusting operating speeds of the feeding unit, the transmission subsystem and the sorting unit, thus establishing a closed cycle of a spiral movement of the bearing roller along the first spiral groove between the grinding strip assembly and the grinding sleeve and the collection, sorting and feeding through the external circulation system;

step 6, wherein:

2) further adjusting the radial expansion mechanism to apply an average initial pressure of 0.5 N to 2 N to each bearing roller distributed in the grinding machining area; the cylindrical magnetic structure or the strip-shaped magnetic structure entering a working state, and a magnetic field intensity of the grinding sleeve magnetic field or the grinding strip magnetic field being adjusted, so that the bearing roller is driven to rotate around the axis thereof; meanwhile, the bearing roller moving along the grinding strip groove and the first spiral groove respectively under the pushing action of the working surface of the first spiral groove and the working surface of the grinding strip groove; and the rolling surface sliding relative to the working surface of the first spiral groove and the working surface of the grinding strip groove, and the rolling surface starting to undergo grinding machining of the working surface of the first spiral groove and the working surface of the grinding strip groove; and step 9: reducing the pressure applied to the bearing roller and finally making the pressure reach zero; stopping the operation of the sorting unit, the feeding unit and the transmission subsystem, and adjusting the relative rotation speed of the grinding strip assembly and the grinding sleeve to zero; stopping the operation of the reciprocating motion system when the reciprocating motion system is already started in step 2; switching the cylindrical magnetic structure or the strip-shaped magnetic structure to an off-working state, and stopping the operation of the demagnetization unit; stopping filling the grinding liquid into the grinding machining area; and returning the grinding strip assembly back to an off-working position along the radial direction of the grinding strip assembly.

Compared with the prior art, the present invention has the beneficial effects as follows.

For the finish machining of the rolling surface of the cylindrical roller or the tapered roller, the first spiral groove according to the present invention is arranged on the inner surface of the grinding sleeve, and each linear groove is arranged on one grinding strip of the grinding strip assembly which can be radially expanded and distributed in a circumferential columnar array. On one hand, the array radius of the grinding strip assembly according to the present invention is constant, so that the situation that the quantity of the linear grooves is limited by the circumference of the small end of the regular conical surface as the circumferences of the big end and the small end of the regular conical surface as the base surface of the grinding disc are different in the prior art may not occur. Meanwhile, the quantity of the cylindrical rollers or the tapered rollers participating in grinding is greatly improved than that of the prior art, which can give better play to the advantages of the comparative machining method. On the other hand, because rotational linear speeds of different positions of the first spiral groove around the axis of the grinding strip assembly relative to the linear groove are different, speeds of autorotation of the cylindrical roller or the tapered roller in different positions of the first spiral groove are different, a material removal rate of the rolling surface of the cylindrical roller or the tapered roller and a wear rate of a working surface of the grinding tool change with the position of the cylindrical roller or the tapered roller in the first spiral groove, thus affecting the improvement of dimension consistency of the rolling surface of the cylindrical roller or the tapered roller.

For the finish machining of the rolling surface of the spherical roller, according to the present invention, the concave arc groove in the prior art is extended and deformed into the first spiral groove and disposed in the inner surface of the grinding sleeve, and the single spiral groove in the prior art is extended and deformed into the linear grooves or second spiral grooves and the multiple linear grooves or second spiral grooves are disposed in one grinding strip of the grinding strip assembly which can be radially expanded and distributed in a circumferential columnar array. The grinding sleeve is coaxial with the grinding strip assembly, and meanwhile, the relative reciprocating linear motion or reciprocating spiral motion of the grinding strip assembly and the grinding sleeve is added to drive the spherical roller to rotate around the axis of the spherical roller. On one hand, each spiral of the first spiral groove which is extended and deformed by the concave arc groove in the prior art is at least equivalent to two concave arc grooves on the concave arc revolution in the prior art, and especially, axial lengths of the grinding sleeve and the grinding strip assembly are not restricted in terms of geometry and forming principle, so that lengths of the first spiral groove and the linear groove or the second spiral groove can be appropriately increased in production practice, and the quantity of the spherical rollers participating in grinding is greatly increased compared with that in the prior art, so that multi-sample direct comparative machining method can be better exerted. On the other hand, because the linear speeds of the reciprocating linear motion or reciprocating spiral motion of the linear groove or the second spiral groove at different positions relative to the first spiral groove are the same at the same time, and the speeds of autorotation of the spherical roller at different positions of the first spiral groove are the same, the material removal rate of the rolling surface of the spherical roller and the wear rate of the working surface of the grinding tool do not change with the position of the spherical roller in the first spiral groove, thus being beneficial to improving the dimension consistency of the rolling surface of the spherical roller.

BRIEF DESCRIPTION OF DRAWINGS

FIG. 1-2 is a three-dimensional structural diagram of the cylindrical roller;

FIG. 1-3 is a distribution schematic diagram of the cylindrical roller in a linear groove and a first spiral groove in a grinding machining state;

FIG. 1-4 is a schematic diagram showing a solid scanning relationship between a scanning surface of the linear groove and the cylindrical roller;

FIG. 1-5 is a schematic diagram showing a normal section outline of the scanning surface of the linear groove in finish machining of the cylindrical roller;

FIG. 1-6 is a schematic diagram showing a solid scanning relationship between a scanning surface of the first spiral groove and the cylindrical roller;

FIG. 1-7(*a*) is a schematic diagram I showing a contact relationship between the cylindrical roller and a working surface of the first spiral groove;

FIG. 1-7(*b*) is a schematic diagram II showing the contact relationship between the cylindrical roller and the working surface of the first spiral groove;

FIG. 1-8(*a*) is a schematic diagram of a conical surface radial expansion mechanism;

FIG. 1-8(*b*) is a sectional drawing of a sectioning position shown in FIG. 1-8(*a*);

FIG. 1-8(*c*) is a schematic diagram of a communicating-type fluid radial expansion mechanism;

FIG. 1-8(*d*) is a sectional drawing of a sectioning position shown in FIG. 1-8(*c*);

FIG. 1-8(*e*) is a schematic diagram of a micro-displacement unit radial expansion mechanism;

FIG. 1-8(*f*) is a sectional drawing of a sectioning position shown in FIG. 1-8(*e*);

FIG. 1-9 is a schematic diagram showing relative motion of a grinding tool kit and an external circulation system of a main machine of a horizontal grinding strip assembly rotary type in the finish machining of the cylindrical roller;

FIG. 1-10 is a schematic diagram showing a cylindrical roller of the main machine of the grinding strip assembly rotary type entering the linear groove via a feeding channel;

FIG. 1-11 is a schematic diagram showing relative motion of a grinding tool kit of a main machine of a vertical grinding strip assembly rotary type and the cylindrical roller entering an entrance of the first spiral groove via the linear groove;

FIG. 2-1(*a*) is a schematic diagram I showing a cylindrical magnetic structure of the cylindrical roller in finish machining and magnetic field distribution in a grinding machining area;

FIG. 2-1(*b*) is an enlarged drawing of a part A in FIG. 2-1(*a*), and is a schematic diagram showing that magnetic lines in the grinding machining area preferably pass through a cylindrical roller made of a ferromagnetic material;

FIG. 2-2(*a*) is a schematic diagram II showing the cylindrical magnetic structure of the cylindrical roller in the finish machining and the magnetic field distribution in the grinding machining area;

FIG. 2-2(*b*) is an enlarged drawing of a part B in FIG. 2-2(*a*), and is a schematic diagram showing that the magnetic lines in the grinding machining area preferably pass through the cylindrical roller made of the ferromagnetic material;

FIG. 2-3 is a schematic diagram III showing the cylindrical magnetic structure of the cylindrical roller in the finish machining and the magnetic field distribution in the grinding machining area;

FIG. 2-4 is a schematic diagram IV showing the cylindrical magnetic structure of the cylindrical roller in the finish machining and the magnetic field distribution in the grinding machining area;

FIG. 2-5 is a schematic diagram showing an external circulation system comprising a demagnetization unit of the main machine of the horizontal grinding strip assembly rotary type in the finish machining of the cylindrical roller;

FIG. 3-1 is a schematic diagram of a grinding tool kit for finish machining of a tapered roller;

FIG. 3-2(*a*) is a three-dimensional structural diagram of the tapered roller;

FIG. 3-2(*b*) is a two-dimensional structural diagram of the tapered roller;

FIG. 3-3 is a distribution schematic diagram of the tapered roller in a linear groove and a first spiral groove in a grinding machining state;

FIG. 3-4 is a schematic diagram showing a solid scanning relationship between a scanning surface of the linear groove and the tapered roller;

FIG. 3-5(*a*) is a schematic diagram showing a normal section outline of the scanning surface of the linear groove in the finish machining of the tapered roller;

FIG. 3-5(*b*) is a schematic diagram showing a normal section outline of a working surface of the linear groove in the finish machining of the tapered roller;

FIG. 3-6 is a schematic diagram showing a contact relationship between the tapered roller and the working surface of the linear groove;

FIG. 3-7 is a schematic diagram showing a solid scanning relationship between a scanning surface of the first spiral groove and the tapered roller;

FIG. 3-8 is a schematic diagram showing a contact relationship between the tapered roller and a working surface of the first spiral groove;

FIG. 3-9 is a schematic diagram showing relative motion of a grinding tool kit and an external circulation system of a main machine of a horizontal grinding strip assembly rotary type in the finish machining of the tapered roller;

FIG. 3-10 is a schematic diagram showing a tapered roller of the main machine of the horizontal grinding strip assembly rotary type entering the linear groove via a feeding channel;

FIG. 3-11 is a schematic diagram showing relative motion of a grinding tool kit of a main machine of a vertical grinding strip assembly rotary type and the tapered roller entering an entrance of the first spiral groove via the linear groove;

FIG. 4-1(*a*) is a schematic diagram showing a cylindrical magnetic structure of a tapered roller in finish machining and magnetic field distribution in a grinding machining area;

FIG. 4-1(*b*) is an enlarged drawing of a part C in FIG. 4-1(*a*), and is a schematic diagram showing that magnetic lines in the grinding machining area preferably pass through a tapered roller made of a ferromagnetic material;

FIG. 4-2(*a*) is a schematic diagram II showing the cylindrical magnetic structure of the tapered roller in the finish machining and the magnetic field distribution in the grinding machining area;

FIG. 4-2(*b*) is an enlarged drawing of a part D in FIG. 4-2(*a*), and is a schematic diagram showing that the magnetic lines in the grinding machining area preferably pass through the tapered roller made of the ferromagnetic material;

FIG. 4-3 is a schematic diagram III showing the cylindrical magnetic structure of the tapered roller in the finish machining and the magnetic field distribution in the grinding machining area;

FIG. 4-4 is a schematic diagram IV showing the cylindrical magnetic structure of the tapered roller in the finish machining and the magnetic field distribution in the grinding machining area;

FIG. 4-5 is a schematic diagram showing an external circulation system comprising a demagnetization unit of the main machine of the horizontal grinding strip assembly rotary type in the finish machining of the tapered roller;

FIG. 5-1(*a*) is a schematic diagram of a grinding tool kit for finish machining of a spherical roller;

FIG. 5-1(*b*) is a schematic structural diagram showing that a grinding strip groove of a grinding strip is a second spiral groove;

FIG. 5-2(*a*) is a three-dimensional structural diagram of a symmetric spherical roller without spherical base surface;

FIG. 5-2(*b*) is a two-dimensional structural diagram of the symmetric spherical roller without spherical base surface;

FIG. 5-2(*c*) is a three-dimensional structural diagram of a symmetric spherical roller with spherical base surface;

FIG. 5-2(*d*) is a two-dimensional structural diagram of the symmetric spherical roller with spherical base surface;

FIG. 5-2(*e*) is a three-dimensional structural diagram of an asymmetric spherical roller;

FIG. 5-2(*f*) is a two-dimensional structural diagram of the asymmetric spherical roller;

FIG. 5-3 is a distribution schematic diagram of the spherical roller in a linear groove and a first spiral groove in a grinding machining state;

FIG. 5-4(*a*) is a schematic diagram showing a solid scanning relationship between a scanning surface of the first spiral groove and the spherical roller;

FIG. 5-4(*b*) is an enlarged drawing of a part E in FIG. 5-4(*a*);

FIG. 5-5 is a schematic diagram showing a normal section outline of the scanning surface of the first spiral groove in the finish machining of the spherical roller;

FIG. 5-6 is a schematic diagram showing a contact relationship between the spherical roller and a working surface of the first spiral groove;

FIG. 5-7(*a*) is a schematic diagram showing a solid scanning relationship between a scanning surface of the linear groove and the spherical roller and the symmetric spherical roller with spherical base surface;

FIG. 5-7(*b* is a schematic diagram showing a solid scanning relationship between a scanning surface of the second spiral groove and the spherical roller and the symmetric spherical roller with spherical base surface;

FIG. 5-8 is a schematic diagram showing a contact relationship between the symmetric spherical roller with spherical base surface and the working surface of the linear groove;

FIG. 5-9(*a*) is a schematic diagram of a conical surface radial contraction mechanism;

FIG. 5-9(*b*) is a sectional drawing of a sectioning position shown in FIG. 5-9(*a*);

FIG. 5-9(*c*) is a schematic diagram of a communicating-type fluid radial contraction mechanism;

FIG. 5-9(*d*) is a sectional drawing of a sectioning position shown in FIG. 5-9(*c*);

FIG. 5-9(*e*) is a schematic diagram of a micro-displacement unit radial contraction mechanism;

FIG. 5-9(*f*) is a sectional drawing of a sectioning position shown in FIG. 5-9(*e*);

FIG. 5-10 is a schematic diagram showing relative motion of a grinding tool kit and an external circulation system of a main machine of a horizontal grinding strip assembly rotary type in the finish machining of the spherical roller;

FIG. 5-11 is a schematic diagram showing a spherical roller of the main machine of the horizontal grinding strip assembly rotary type entering the linear groove via a feeding channel;

FIG. 5-12 is a schematic diagram showing relative motion of a grinding tool kit of a main machine of a vertical grinding strip assembly rotary type and the spherical roller entering an entrance of the first spiral groove via the linear groove;

FIG. 6-1 is a schematic diagram I showing a strip-shaped magnetic structure of the spherical roller in finish machining and magnetic field distribution in a grinding machining area;

FIG. 6-2 is a schematic diagram II showing the strip-shaped magnetic structure of the spherical roller in the finish machining and the magnetic field distribution in the grinding machining area;

FIG. 6-3 is a schematic diagram III showing the strip-shaped magnetic structure of the spherical roller in the finish machining and the magnetic field distribution in the grinding machining area;

FIG. 6-4 is a schematic diagram IV showing the strip-shaped magnetic structure of the spherical roller in the finish machining and the magnetic field distribution in the grinding machining area; and FIG. 6-5 is a schematic diagram showing an external circulation system comprising a demagnetization unit of the main machine of the horizontal grinding strip assembly rotary type in the finish machining of the spherical roller.

In the drawings:

Figure 1:
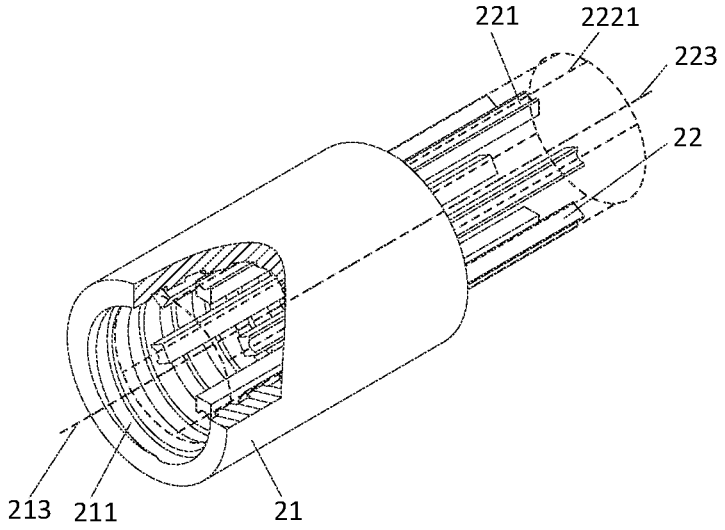
FIG. 1-1 is a schematic diagram of a grinding tool kit for finish machining of a cylindrical roller.

11 refers to grinding sleeve unit strip mounting base; 12 refers to grinding strip mounting base; 13 refers to basic shaft sleeve; 131 refers to guide sleeve A; 1311 refers to guide hole A; 132 refers to tapered shaft sleeve; 1321 refers to inner conical surface; 14 refers to basic mandrel; 141 refers to guide sleeve B; 1411 refers to guide hole B; 142 refers to tapered mandrel; 1421 refers to outer conical surface; 151 refers to guide post A; 152 refers to guide post B; 161 refers to shaft sleeve-shaped cylinder; 162 refers to shaft sleeve-shaped cylinder; 163 refers to female cavity; 164 refers to cylinder sleeve; 165 refers to piston rod; 17 refers to micro-displacement unit; and 171 refers to push rod;

21 refers to grinding sleeve; 210 refers to grinding sleeve unit strip; 211 refers to first spiral groove; 2111 refers to working surface of first spiral groove; 211111 refers to working surface I of first spiral groove; 21112 refers to working surface II of first spiral groove, 2112 refers to scanning surface of first spiral groove; 21121 refers to scanning surface I of first spiral groove; 21122 refers to scanning surface II of first spiral groove; 2113 refers to normal section of first spiral groove, 21131 refers to normal section outline A; 2121 refers to cylindrical helix A; 213 refers to axis of grinding sleeve; 2130 refers to auxiliary straight line A; 2131 refers to axial section of grinding sleeve; 214 refers to vertical line A; 215 refers to guide side; 217 refers to cylindrical magnetic structure; 2171 refers to magnetic line of grinding sleeve magnetic field; 218 refers to spiral belt-shaped non-magnetic conductive material; 2181 refers to grinding sleeve isolation groove; and 219 refers to magnetic sleeve;

22 refers to grinding strip; 221 refers to linear groove; 2211 refers to working surface of linear groove; 22111 refers to working surface I of linear groove; 22112 refers to working surface II of linear groove; 22121 refers to scanning surface I of linear groove; 22122 refers to scanning surface II of linear groove; 2213 refers to normal section of linear groove; 22131 refers to normal section outline B; 2221 refers to straight line B; 2222 refers to cylindrical helix B; 223 refers to axis of grinding strip assembly; 2230 refers to auxiliary straight line B; 2231 refers to axial section of grinding strip assembly; 224 refers to vertical line B; 225 refers to feeding waiting area; 226 refers to extensible supporting piece; 227 refers to strip-shaped magnetic structure; 2271 refers to magnetic line of grinding strip magnetic field; 228 refers to strip-shaped non-magnetic conductive material; and 2281 refers to grinding strip isolation groove;

31 refers to axis of bearing roller; 32 refers to rolling surface; 320 refers to axial section profile; 321 refers to contact line I; 3211 refers to cross contact line I; 3212 refers to cross contact line II; 322 refers to contact line II; 33 refers to spherical base surface; 331 refers to contact line III; 34 refers to end surface rounding; 341 refers to contact line IV; and 35 refers to maximum diameter truncated circle;

41 refers to collection unit; 42 refers to sorting unit; 43 refers to feeding unit; 431 refers to feeding channel; and 44 refers to demagnetization unit;

N refers to contact point between end surface rounding of cylindrical roller and working surface II of first spiral groove; $O_1$ refers to center of mass of cylindrical roller; $O_2$ refers to center of mass of tapered roller; and $O_3$ refers to circle center of maximum diameter truncated circle of spherical roller; and $\alpha$ refers to included angle between axis of spherical roller and axis of grinding sleeve; $\beta$ refers to included angle between axis of spherical roller and straight line B; $\xi$ refers to included angle between axis of spherical roller and axis of grinding strip assembly; $\gamma$ refers to included angle between axis of tapered roller and straight line B; $\delta$ refers to included angle between axis of tapered roller and axis of grinding sleeve; $\theta$ refers to semi-angle of included angle of two straight-line segments of normal section outline of scanning surface of linear groove; $\Phi$ refers to half cone angle of tapered roller; d refers to embedded depth; d' refers to depth of isolation groove; r refers to radius of maximum diameter truncated circle of spherical roller; $R_c$ refers to radius of curvature of axial section profile of rolling surface; t refers to width of non-magnetic conductive material; and t' refers to width of isolation groove.

DETAILED DESCRIPTION

The present invention will be further described in detail below with reference to the accompany drawings and embodiments. The embodiments described below with reference to the accompanying drawings are exemplary and are intended to explain the present invention, but should not be construed as limiting the present invention. Moreover, the dimensions, materials, shapes, relative configuration, and the like of the components described in the following embodiments are not intended to limit the scope of the present invention to these specific ones unless otherwise specified.

Embodiment 1 of grinding tool kit: a grinding tool kit for finish machining of a rolling surface of a cylindrical roller.

As shown in FIG. 1-1, the grinding tool kit comprises a grinding sleeve 21 and a grinding strip assembly. During grinding machining, the grinding sleeve 21 is coaxial with the grinding strip assembly; in the figure, reference numeral 213 refers to an axis of the grinding sleeve 21, reference numeral 223 refers to an axis of the grinding strip assembly, and the grinding strip assembly passes through the grinding sleeve 21. An inner surface of the grinding sleeve 21 is provided with one or a plurality of first spiral grooves; and the first spiral groove 211 is a cylindrical spiral groove. The grinding strip assembly comprises at least three grinding strips 22 distributed in a circumferential columnar array, a surface of each grinding strip 22 opposite to the inner surface of the grinding sleeve 21 is a front surface of the grinding strip 22, the front surface of each grinding strip 22 is provided with one linear groove 221 penetrating through the grinding strip 22 along a length direction of the grinding strip 22. The inner surface of the grinding sleeve 21 shown in FIG. 1-1 is only provided with one first spiral groove 211, and reference numeral 2221 refers to a straight line B, as shown in FIG. 1-4.

Figures 1, 2:
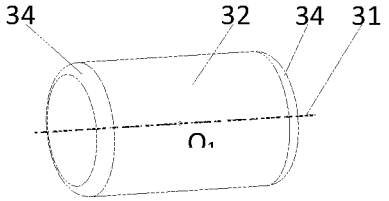

FIG. 1-2 is a three-dimensional structure of a cylindrical roller to be machined. A surface of the cylindrical roller comprises a rolling surface 32, an end surface rounding 34 and an end plane located at one end, and an end surface rounding 34 and an end plane located at the other end.

Figures 1, 2, 3:
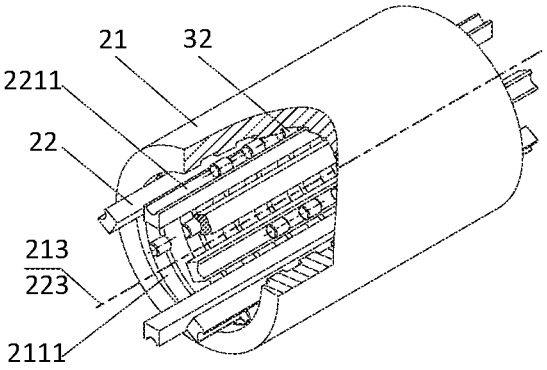

As shown in FIG. 1-1 and FIG. 1-3 (FIG. 1-3 is a distribution schematic diagram of the cylindrical roller in the first spiral groove 211 and the linear groove 221 in a grinding machining state, wherein in the figure, one grinding strip on the left side is sectioned to show the distribution of the cylindrical roller in the first spiral groove 211), and a surface of the first spiral groove 211 comprises a working surface 2111 of the first spiral groove that is in contact with the cylindrical roller during grinding machining and a non-working surface (not marked in the figure) that is not in contact with the cylindrical roller. A surface of the linear groove 221 comprises a working surface 2211 of the linear groove that is in contact with the cylindrical roller during grinding machining and a non-working surface (not marked in the figure) that is not in contact with the cylindrical roller.

As shown in FIG. 1-1, FIG. 1-3, FIG. 1-9 and FIG. 1-11, during grinding machining, one cylindrical roller is distributed at each intersection of the first spiral groove 211 and the linear groove 221. Corresponding to each intersection, an area enclosed by the working surface 2111 of the first spiral groove and the working surface 2211 of the linear groove is a grinding machining area. The grinding strip assembly and the grinding sleeve 21 rotate relatively around an axis 223 of the grinding strip assembly, and the grinding strip 22 applies a working pressure to the cylindrical roller distributed in the first spiral groove 211 along a radial direction of the grinding strip assembly, referring to FIG. 1-8(*a*), FIG. 1-8(*b*), FIG. 1-8(*c*), FIG. 1-8(*d*), FIG. 1-8(*e*) and FIG. 1-8(*f*). The cylindrical roller is in contact with the working surface 2111 of the first spiral groove and the working surface 2211 of the linear groove respectively in the grinding machining area. The cylindrical roller rotates around an axis of the cylindrical roller under the friction drive of the working surface 2111 of the first spiral groove, and simultaneously moves along the first spiral groove and the linear groove 221 respectively under the pushing action of the working surface 2211 of the linear groove and the working surface 2111 of the first spiral groove, and the rolling surface 32 slides relative to the working surface 2111 of the first spiral groove and the working surface 2211 of the linear groove, so that grinding machining of the rolling surface 32 is realized.

The working surface 2211 of the linear groove is on a scanning surface 2212 of the linear groove, and the scanning surface 2212 of the linear groove is a scanning surface with equal section. As shown in FIG. 1-1, FIG. 1-3 and FIG. 1-4, the cylindrical roller is taken as a scanning outline B of solid scanning of the scanning surface 2212 of the linear groove, a scanning path B of the scanning surface 2212 of the linear groove is a straight line parallel to an array axis of the grinding strip assembly, the scanning path B passing through a center of mass $O_1$ of the cylindrical roller (on the axis of the cylindrical roller) is denoted as a straight line B 2221, a distance from the straight line B 2221 to the array axis is an array radius, and the array axis is an axis of the grinding strip assembly. The axis 31 of the cylindrical roller as the scanning outline B coincides with the straight line B 2221. Solid scanning is carried out on the scanning outline B along the scanning path B, and then a groove surface formed by enveloping of the scanning outline B on the front surface of the grinding strip 22 is the scanning surface 2212 of the linear groove.

A normal section of the linear groove 221 is vertical to a plane of the straight line B 2221. As shown in FIG. 1-4 and FIG. 1-5, in the normal section 2213 of the linear groove, a normal section outline A 22131 of the scanning surface of the linear groove is a circular arc A, and a radius of curvature of the circular arc A is equal to a radius of curvature of the rolling surface 32. In the normal section of the linear groove 2213, an initial outline of the working surface 2211 of the linear groove is the circular arc A, or is a discontinuous circular arc A, or is a V shape externally tangent with the circular arc A, or a polygon externally tangent with the circular arc A.

During grinding machining, as shown in FIG. 1-3, the rolling surface 32 is in contact with the working surface 2211 of the linear groove.

A specific meaning that the scanning surface 2212 of the linear groove is a scanning surface with equal section, is that: in the normal section 2213 of the linear groove at different positions of the linear groove 221, the normal section outline A 22131 of the scanning surface of the linear groove keeps unchanged.

It may be understood that a relationship between the scanning surface 2212 of the linear groove and the working surface 2211 of the linear groove in the present invention is that the scanning surface 2212 of the linear groove is a continuous surface, the working surface 2211 of the linear groove and the scanning surface 2212 of the linear groove have the same shape, position and boundary, and under the premise of not affecting a contact relationship between the cylindrical roller and the working surface 2211 of the linear groove and not affecting grinding uniformity of the rolling surface 32, the working surface 2211 of the linear groove may be discontinuous.

In the present invention, it is recommended that all the linear grooves 221 be uniformly distributed around the axis 223 of the grinding strip assembly.

The working surface of the first spiral groove is on a scanning surface 2112 of the first spiral groove, and the scanning surface 2112 of the first spiral groove is a scanning surface with equal section. The working surface 2111 of the first spiral groove comprises a working surface I 21111 of the first spiral groove in contact with the rolling surface 32 during grinding machining and a working surface II 21112 of the first spiral groove in contact with the end surface rounding 34 at one end of the cylindrical roller. The working surface I 21111 of the first spiral groove and the working surface II 21112 of the first spiral groove are on a scanning surface I 21121 of the first spiral groove and a scanning surface II 21122 of the first spiral groove respectively. As shown in FIG. 1-1, FIG. 1-3 and FIG. 1-6, the cylindrical roller is taken as a scanning outline A of solid scanning of the scanning surface 2112 of the first spiral groove, a scanning path A of the scanning surface 2112 of the first spiral groove is a cylindrical helix, the cylindrical helix is a cylindrical equidistant helix or a cylindrical non-equidistant helix, the scanning path A passing through the center of mass $O_1$ of the cylindrical roller is denoted as a cylindrical helix A 2121, all the cylindrical helices A 2121 are on the same cylindrical surface, and an axis of the cylindrical helix A is the axis of the grinding sleeve 21. The axis 31 of the cylindrical roller as the scanning outline A is parallel to the axis 213 of the grinding sleeve. Solid scanning is carried out on the scanning outline A along the scanning path A, then a groove surface formed by enveloping of the rolling surface 32 of the cylindrical roller as the scanning outline A on the inner surface of the grinding sleeve 21 and the end surface rounding 34 at one end is the scanning surface 2112 of the first spiral groove. The groove surface formed by the enveloping of the rolling surface 32 is the scanning surface I 21121 of the first spiral groove, and the groove surface formed by the enveloping of the end surface rounding 34 is the scanning surface II 21122 of the first spiral groove.

During grinding machining, the array radius is equal to a radius of the cylindrical helix A 2121.

Under the constraint of the working surface 2211 of the linear groove, the rolling surface 32 is in line contact with the working surface I 21111 of the first spiral groove, and the end surface rounding 34 at one end of the cylindrical roller is in contact with the working surface II 21112 of the first spiral groove.

As shown in FIG. 1-7(*a*) and FIG. 1-7(*b*), reference numeral 322 refers to a contact line II between the rolling surface 32 and the working surface I 21111 of the first spiral groove. As shown in FIG. 1-7(*a*), when the scanning path A is a cylindrical equidistant helix, because a helical rise angle of the cylindrical equidistant helix is a constant angle, the end surface rounding 34 at one end of the cylindrical roller is in line contact with the working surface II 21112 of the first spiral groove, and reference numeral 341 is a contact line IV between the end surface rounding 34 and the working surface II 21112 of the first spiral groove. As shown in FIG. 1-7(*b*), when the scanning path A is a cylindrical non-equidistant helix, as a helical rise angle of the cylindrical non-equidistant helix is not a constant angle, the end surface rounding 34 at one end of the cylindrical roller is in point contact with the working surface II 21112 of the first spiral groove, a position of a contact point N on the end surface rounding 34 changes with a position of the cylindrical roller on the first spiral groove 211.

A specific meaning that the scanning surface 2112 of the first spiral groove is a scanning surface with equal section, is that: an axial section outline of the scanning surface 2112 of the first spiral groove keeps unchanged in the axial section of the grinding sleeve at different positions of the first spiral groove 211.

It may be understood that a relationship between the scanning surface 2112 of the first spiral groove and the working surface 2111 of the first spiral groove is that: the scanning surface 2112 of the first spiral groove is a continuous surface, the working surface 2111 of the first spiral groove and the scanning surface 2112 of the first spiral groove have the same shape, position and boundary, and under the premise of not affecting a contact relationship between the cylindrical roller and the working surface 2111 of the first spiral groove and not affecting grinding uniformity of the rolling surface 32, the working surface 2111 of the first spiral groove may be discontinuous.

In the present invention, it is recommended that all the first spiral grooves 211 be uniformly distributed around the axis 213 of the grinding sleeve.

Embodiment 2 of grinding tool kit: a grinding tool kit for finish machining of a rolling surface of a cylindrical roller made of a ferromagnetic material (such as GCr15, G20CrNi2MoA, Cr4Mo4V30 and the like).

The main differences between the grinding tool kit and the grinding tool kit according to Embodiment 1 of grinding tool kit are as follows:

The grinding sleeve 21 is made of a magnetic conductive material, as shown in FIG. 2-1(*a*) and FIG. 2-1(*b*), wherein FIG. 2-1(*b*) is an enlargement of a part A in FIG. 2-1(*a*). A cylindrical magnetic structure 217 is embedded in the grinding sleeve 21 to form a grinding sleeve magnetic field with magnetic lines distributed in an axial section of the grinding sleeve 21 in the grinding machining area. Reference numeral 2171 refers to the magnetic lines of the grinding sleeve magnetic field. The working surface I 21111 of the first spiral groove is embedded with one or more spiral belt-shaped non-magnetic conductive materials 218 along the scanning path A, so as to increase magnetic resistance of the magnetic lines 2171 of the grinding sleeve magnetic field passing through the solid of the grinding sleeve 21 at the working surface I 21111 of the first spiral groove. In FIG. 2-1(*a*) and FIG. 2-1(*b*), the working surface I 21111 of the first spiral groove is embedded with one spiral belt-shaped non-magnetic conductive material 218.

On one hand, a width t and an embedded depth d of the spiral belt-shaped non-magnetic conductive material 218 and a distance between two adjacent spiral belt-shaped non-magnetic conductive materials need to meet structural strength and rigidity requirements of the working surface I 21111 of the first spiral groove. On the other hand, it is required to ensure that the magnetic lines 2171 of the grinding sleeve magnetic field in the grinding machining area preferentially pass through the cylindrical roller that is in contact with the working surface I 21111 of the first spiral groove during grinding machining.

The cylindrical magnetic structure 217 may be a permanent-magnetic structure or an electromagnetic structure or an electrically-controlled permanent-magnetic structure. The magnetic conductive material is made of a soft magnetic structural material with high magnetic permeability, such as soft iron, low carbon steel, medium carbon steel, soft magnetic alloy, and the like. The spiral belt-shaped non-magnetic conductive material 218 is made of a non-ferromagnetic structural material, such as nonferrous metal, austenitic stainless steel, and the like.

Embodiment 3 of grinding tool kit: a grinding tool kit for finish machining of a rolling surface of a cylindrical roller made of a ferromagnetic material (such as GCr15, G20CrNi2MoA, Cr4Mo4V30 and the like).

The main differences between the grinding tool kit and the grinding tool kit according to Embodiment 2 of grinding tool kit are as follows:

As shown in FIG. 2-2(*a*) and FIG. 2-2(*b*), FIG. 2-2(*b*) is an enlargement of a part B in FIG. 2-2(*a*). The working surface I 21111 of the first spiral groove is not embedded with the spiral belt-shaped non-magnetic conductive material along the scanning path A, but one or multiple spiral belt-shaped grinding sleeve magnetic isolation grooves 2181 or multiple annular belt-shaped grinding sleeve magnetic isolation grooves 2181 are arranged along the scanning path A on a solid inner cavity side of the grinding sleeve 21 facing away from the working surface I of the first spiral groove so as to increase magnetic resistance of the magnetic lines 2171 of the grinding sleeve magnetic field passing through the solid of the grinding sleeve 21 at the working surface I 21111 of the first spiral groove.

A width t' and an embedded depth d' of the grinding sleeve isolation groove 2181 and a distance between two adjacent grinding sleeve isolation grooves need to meet structural strength and rigidity requirements of the working surface I 21111 of the first spiral groove. On the other hand, it is required to ensure that the magnetic lines 2171 of the grinding sleeve magnetic field in the grinding machining area preferentially pass through the cylindrical roller that is in contact with the working surface I 21111 of the first spiral groove during grinding machining.

Embodiment 4 of grinding tool kit: a grinding tool kit for finish machining of a rolling surface of a tapered roller.

Figures 1, 2, 3, 4:
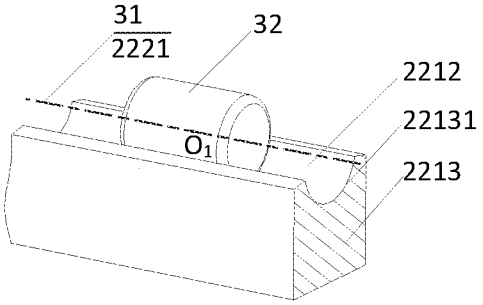

As shown in FIG. 3-1, the grinding tool kit comprises a grinding sleeve 21 and a grinding strip assembly. During grinding machining, the grinding sleeve 21 is coaxial with the grinding strip assembly; in the figure, reference numeral 213 refers to an axis of the grinding sleeve 21, reference numeral 223 refers to an axis of the grinding strip assembly, and the grinding strip assembly passes through the grinding sleeve 21. An inner surface of the grinding sleeve 21 is provided with one or a plurality of first spiral grooves; and the first spiral groove 211 is a cylindrical first spiral groove. The grinding strip assembly comprises at least three grinding strips 22 distributed in a circumferential columnar array, a surface of each grinding strip 22 opposite to the inner surface of the grinding sleeve 21 is a front surface of the grinding strip 22, the front surface of each grinding strip 22 is provided with one linear groove 221 penetrating through the grinding strip 22 along a length direction of the grinding strip 22. The inner surface of the grinding sleeve 21 shown in FIG. 3-1 is only provided with one first spiral groove 211, and reference numeral 2221 refers to a straight line B, as shown in FIG. 3-4.

FIG. 3-2(*a*) and FIG. 3-2(*b*) show a three-dimensional structure and a two-dimensional structure of a tapered roller to be machined respectively. A surface of the tapered roller comprises a rolling surface 32, an end surface rounding 34 and a spherical base surface 33 located at a big head-end, and an end surface rounding 34 and an end plane located at a small-head end.

As shown in FIG. 3-1 and FIG. 3-3 (FIG. 1-3 is a distribution schematic diagram of the tapered roller in the first spiral groove 211 and the linear groove 221 in a grinding machining state, wherein in the figure, one grinding strip on the left side is sectioned to show the distribution of the tapered roller in the first spiral groove 211), and a surface of the first spiral groove 211 comprises a working surface 2111 of the first spiral groove that is in contact with the tapered roller during grinding machining and a non-working surface (not marked in the figure) that is not in contact with the tapered roller. A surface of the linear groove 221 comprises a working surface 2211 of the linear groove that is in contact with the tapered roller during grinding machining and a non-working surface (not marked in the figure) that is not in contact with the tapered roller.

As shown in FIG. 3-1, FIG. 3-3, FIG. 3-9 and FIG. 3-11, during grinding machining, one tapered roller is distributed at each intersection of the first spiral groove 211 and the linear groove 221. Corresponding to each intersection, an area enclosed by the working surface 2111 of the first spiral groove and the working surface 2211 of the linear groove is a grinding machining area. The grinding strip assembly and the grinding sleeve 21 rotate relatively around an axis 223 of the grinding strip assembly, and the grinding strip 22 applies a working pressure to the cylindrical roller distributed in the first spiral groove 211 along a radial direction of the grinding strip assembly, referring to FIG. 1-8(*a*), FIG. 1-8(*b*), FIG. 1-8(*c*), FIG. 1-8(*d*), FIG. 1-8(*e*) and FIG. 1-8(*f*). The tapered roller is in contact with the working surface 2111 of the first spiral groove and the working surface 2211 of the linear groove respectively in the grinding machining area. The tapered roller rotates around an axis of the cylindrical roller under the friction drive of the working surface 2111 of the first spiral groove, and simultaneously moves along the first spiral groove and the linear groove 221 respectively under the pushing action of the working surface 2211 of the linear groove and the working surface 2111 of the first spiral groove, and the rolling surface 32 slides relative to the working surface 2111 of the first spiral groove and the working surface 2211 of the linear groove, so that grinding machining of the rolling surface 32 is realized.

Figures 1, 2, 3, 4, 5:
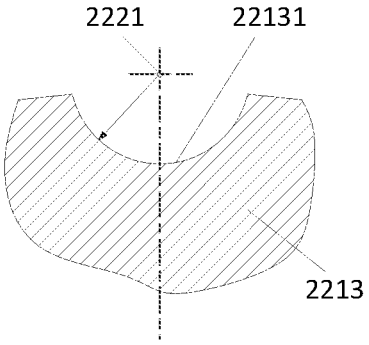

The working surface 2211 of the linear groove is on a scanning surface 2212 of the linear groove, and the scanning surface 2212 of the linear groove is a scanning surface with equal section. As shown in FIG. 3-1, FIG. 3-3 and FIG. 3-4, the tapered roller is taken as a scanning outline B of solid scanning of the scanning surface 2212 of the linear groove, a scanning path B of the scanning surface 2212 of the linear groove is a straight line parallel to an array axis of the grinding strip assembly, the scanning path B passing through a center of mass $O_2$ of the tapered roller (on the axis of the tapered roller) is denoted as a straight line B 2221, a distance from the straight line B 2221 to the array axis is an array radius, and the array axis is an axis of the grinding strip assembly. The axis 31 of the tapered roller as the scanning outline B is within an axial section of the grinding strip assembly. Reference numeral 2231 refers to the axial section of the grinding strip assembly. The small-head end of the tapered roller is closer to the axis 223 of the grinding strip assembly than the big-head end. An included angle between the axis 31 of the tapered roller and the straight line B 2221 is denoted as $\gamma$, a half cone angle of the tapered roller is denoted as $\phi$, and $\gamma+\varphi<45°$. Solid scanning is carried out on the scanning outline B along the scanning path B, and then two V-shaped side faces formed by enveloping of the rolling surface 32 of the tapered roller as the scanning outline B on the front surface of the grinding strip 22 are the scanning surface 2212 of the linear groove. In FIG. 3-4, a circular arc surface at a bottom of the linear groove 221 is a scanning surface formed by enveloping of the end surface rounding 34 at the small-head end of the tapered roller, as shown in FIG. 3-5(*a*) and FIG. 3-5(*b*).

A normal section of the linear groove 221 is vertical to a plane of the straight line B 2221. When the rolling surface 32 has no convexity, as shown in FIG. 3-4 and FIG. 3-5(*a*), in the normal section 2213 of the linear groove, a normal section outline A 22131 of the scanning surface of the linear groove refers to two straight-line segments, and included angles between the two straight-line segments and the axial section 2231 of the grinding strip assembly are equal, and denoted as $\theta$, and $\sin\varphi=\sin\gamma\sin\theta$. When the rolling surface 32 is designed with convexity, compared with the normal section outline A 22131, the normal section outline of the scanning surface of the linear groove refers to two curved segments slightly concave into the solid of the grinding strip 22. As shown in FIG. 3-5(*b*), in order to avoid the interference between the end surface rounding 34 of the small-head end of the tapered roller and the circular arc surface at the bottom of the linear groove 221 during grinding machining, a material with a certain depth below the circular arc surface is removed to form a non-working surface of the linear groove 221, as shown in the figure, such as a rectangular groove surface below a circular arc dotted line, as shown in FIG. 3-6.

During grinding machining, as shown in FIG. 3-6, the rolling surface 32 is in line contact with the two V-shaped side faces of the working surface 2211 of the linear groove respectively. Reference numeral 321 refers to a contact line I between the rolling surface 32 and the two V-shaped side faces.

A specific meaning that the scanning surface 2212 of the linear groove is a scanning surface with equal section, is that: in the normal section 2213 of the linear groove at different positions of the linear groove 221, the normal section outline A 22131 of the scanning surface of the linear groove keeps unchanged.

It may be understood that a relationship between the scanning surface 2212 of the linear groove and the working surface 2211 of the linear groove in the present invention is that the scanning surface 2212 of the linear groove is a continuous surface, the working surface 2211 of the linear groove and the scanning surface 2212 of the linear groove have the same shape, position and boundary, and under the premise of not affecting a contact relationship between the tapered roller and the working surface 2211 of the linear groove and not affecting grinding uniformity of the rolling surface 32, the working surface 2211 of the linear groove may be discontinuous.

In the present invention, it is recommended that all the linear grooves 221 be uniformly distributed around the axis 223 of the grinding strip assembly.

The working surface of the first spiral groove is on a scanning surface 2112 of the first spiral groove, and the scanning surface 2112 of the first spiral groove is a scanning surface with equal section. The working surface 2111 of the first spiral groove comprises a working surface I 21111 of the first spiral groove in contact with the rolling surface 32 during grinding machining and a working surface II 21112 of the first spiral groove in contact with the end surface rounding 34 at the big head-end surface of the tapered roller. The big head-end surface comprises the spherical base surface 33 of the tapered roller or further comprises the end surface rounding 34 at the big head-end. The working surface I 21111 of the first spiral groove and the working surface II 21112 of the first spiral groove are on a scanning surface I 21121 of the first spiral groove and a scanning surface II 21122 of the first spiral groove respectively. As shown in FIG. 3-1, FIG. 3-3 and FIG. 3-7, the tapered roller is taken as a scanning outline A of solid scanning of the scanning surface 2112 of the first spiral groove, a scanning path A of the scanning surface 2112 of the first spiral groove is a cylindrical helix, the cylindrical helix is a cylindrical equidistant helix or a cylindrical non-equidistant helix, the scanning path A passing through the center of mass $O_2$ of the cylindrical roller is denoted as a cylindrical helix A 2121, all the cylindrical helices A 2121 are on the same cylindrical surface, and an axis of the cylindrical helix A is the axis of the grinding sleeve 21. The axis 31 of the tapered roller as the scanning outline A is within an axial section of the grinding sleeve 21. Reference numeral 2131 refers to the axial section of the grinding sleeve. An included angle between the axis 31 of the tapered roller and the axis 213 of the grinding sleeve is denoted as $\delta$, and $\delta=\gamma$. Solid scanning is carried out on the scanning outline A along the scanning path A, then a groove surface formed by enveloping of the rolling surface 32 of the tapered roller as the scanning outline A on the inner surface of the grinding sleeve 21 is the scanning surface I 21121 of the first spiral groove, and a groove surface formed by enveloping of the big head-end surface of the tapered roller as the scanning outline A as the scanning outline A is the scanning surface II 21122 of the first spiral groove.

During grinding machining, the array radius is equal to a radius of the cylindrical helix A 2121.

Under the constraint of the working surface 2211 of the linear groove, the rolling surface 32 is in line contact with the working surface I 21111 of the first spiral groove, and the big head-end surface is in contact with the working surface II 21112 of the first spiral groove.

As shown in FIG. 3-8, reference numeral 322 refers to a contact line II between the rolling surface 32 and the working surface I 21111 of the first spiral groove, and reference numeral 331 refers to a contact line III between the big head-end surface and the working surface II 21112 of the first spiral groove.

A specific meaning that the scanning surface 2112 of the first spiral groove is a scanning surface with equal section, is that: an axial section outline of the scanning surface 2112 of the first spiral groove keeps unchanged in the axial section 2131 of the grinding sleeve at different positions of the first spiral groove 211.

It may be understood that a relationship between the scanning surface 2112 of the first spiral groove and the working surface 2111 of the first spiral groove is that: the scanning surface 2112 of the first spiral groove is a continuous surface, the working surface 2111 of the first spiral groove and the scanning surface 2112 of the first spiral groove have the same shape, position and boundary, and under the premise of not affecting a contact relationship between the tapered roller and the working surface 2111 of the first spiral groove and not affecting grinding uniformity of the rolling surface 32, the working surface 2111 of the first spiral groove may be discontinuous.

It is recommended that all the first spiral grooves 211 be uniformly distributed around the axis 213 of the grinding sleeve.

Embodiment 5 of grinding tool kit: a grinding tool kit for finish machining of a rolling surface of a tapered roller.

The main differences between the grinding tool kit and the grinding tool kit according to Embodiment 4 of grinding tool kit are as follows:

the big head-end surface comprises the spherical base surface 33 of the tapered roller or comprises the end surface rounding 34 of the big head-end of the tapered roller or comprises the spherical base surface 33 and the end surface rounding 34 of the big head-end.

Embodiment 6 of grinding tool kit: a grinding tool kit for finish machining of a rolling surface of a tapered roller made of a ferromagnetic material (such as GCr15, G20CrNi2MoA, Cr4Mo4V30 and the like).

The main differences between the grinding tool kit and the grinding tool kit according to Embodiment 4 of grinding tool kit and the grinding tool kit according to Embodiment 5 of grinding tool kit are as follows:

The grinding sleeve 21 is made of a magnetic conductive material, as shown in FIG. 4-1(*a*) and FIG. 4-1(*b*), wherein FIG. 4-1(*b*) is an enlargement of a part C in FIG. 4-1(*a*). A cylindrical magnetic structure 217 is embedded in the grinding sleeve 21 to form a grinding sleeve magnetic field with magnetic lines distributed in an axial section of the grinding sleeve 21 in the grinding machining area. Reference numeral 2171 refers to the magnetic lines of the grinding sleeve magnetic field. The working surface I 21111 of the first spiral groove is embedded with one or more spiral belt-shaped non-magnetic conductive materials 218 along the scanning path A, so as to increase magnetic resistance of the magnetic lines 2171 of the grinding sleeve magnetic field passing through the solid of the grinding sleeve 21 at the working surface I 21111 of the first spiral groove. In FIG. 4-1(*a*) and FIG. 4-1(*b*), the working surface I 21111 of the first spiral groove is embedded with one spiral belt-shaped non-magnetic conductive material 218.

On one hand, a width t and an embedded depth d of the spiral belt-shaped non-magnetic conductive material 218 and a distance between two adjacent spiral belt-shaped non-magnetic conductive materials need to meet structural strength and rigidity requirements of the working surface I 21111 of the first spiral groove. On the other hand, it is required to ensure that the magnetic lines 2171 of the grinding sleeve magnetic field in the grinding machining area preferentially pass through the tapered roller that is in contact with the working surface I 21111 of the first spiral groove during grinding machining.

The cylindrical magnetic structure 217 may be a permanent-magnetic structure or an electromagnetic structure or an electrically-controlled permanent-magnetic structure. The magnetic conductive material is made of a soft magnetic structural material with high magnetic permeability, such as soft iron, low carbon steel, medium carbon steel, soft magnetic alloy, and the like. The spiral belt-shaped non-magnetic conductive material 218 is made of a non-ferromagnetic structural material, such as nonferrous metal, austenitic stainless steel, and the like.

Embodiment 7 of grinding tool kit: a grinding tool kit for finish machining of a rolling surface of a tapered roller made of a ferromagnetic material (such as GCr15, G20CrNi2MoA, Cr4Mo4V30 and the like).

The main differences between the grinding tool kit and the grinding tool kit according to Embodiment 6 of grinding tool kit are as follows:

As shown in FIG. 4-2(*a*) and FIG. 4-2(*b*), FIG. 4-2(*b*) is an enlargement of a part D in FIG. 4-2(*a*). The working surface I 21111 of the first spiral groove is not embedded with the spiral belt-shaped non-magnetic conductive material along the scanning path A, but one or multiple spiral belt-shaped grinding sleeve magnetic isolation grooves 2181 or multiple annular belt-shaped grinding sleeve magnetic isolation grooves 2181 are arranged along the scanning path A on a solid inner cavity side of the grinding sleeve 21 facing away from the working surface I of the first spiral groove so as to increase magnetic resistance of the magnetic lines 2171 of the grinding sleeve magnetic field passing through the solid of the grinding sleeve 21 at the working surface I 21111 of the first spiral groove.

A width t' and an embedded depth d' of the grinding sleeve isolation groove 218 and a distance between two adjacent grinding sleeve isolation grooves need to meet structural strength and rigidity requirements of the working surface I 21111 of the first spiral groove. On the other hand, it is required to ensure that the magnetic lines 2171 of the grinding sleeve magnetic field in the grinding machining area preferentially pass through the tapered roller that is in contact with the working surface I 21111 of the first spiral groove during grinding machining.

Embodiment 8 of grinding tool kit: a grinding tool kit for finish machining of a rolling surface of a spherical roller.

Figures 1, 2, 3, 4, 5, 6:
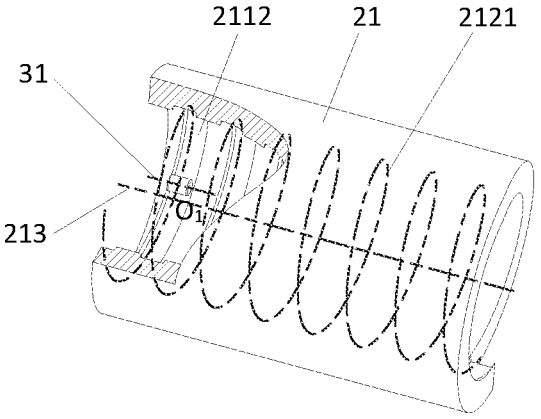
Figures 1, 2, 3, 4, 5, 6, 7, 7A:
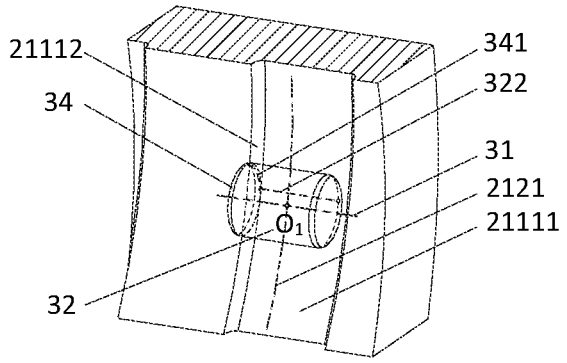
Figures 1, 2, 3, 4, 5, 6, 7, 7B:
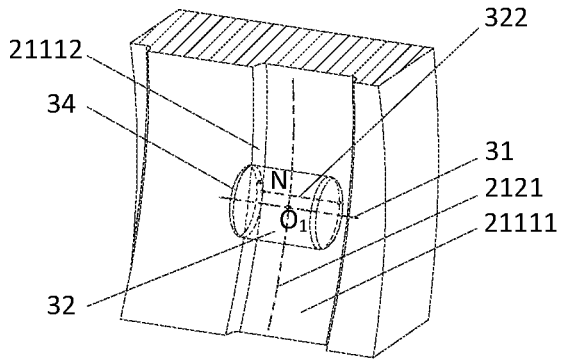
Figures 1, 2, 3, 4, 5, 6, 7, 8, 8B:
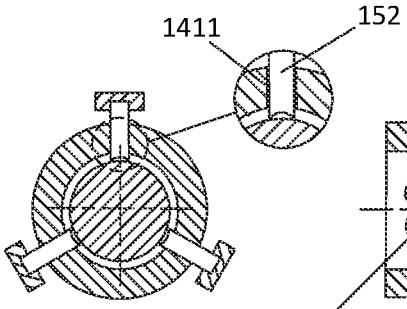
Figures 1, 2, 3, 4, 5, 6, 7, 8, 8A:
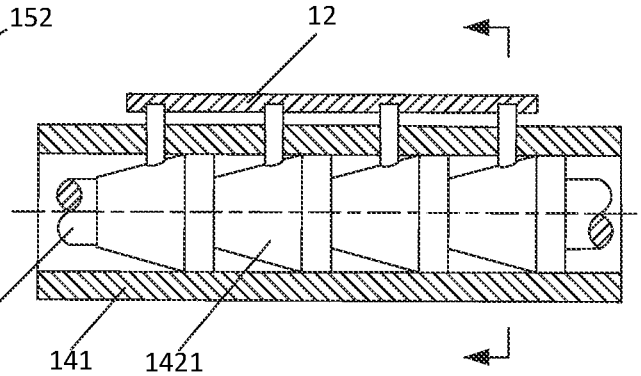
Figures 1, 2, 3, 4, 5, 6, 7, 8, 8D:
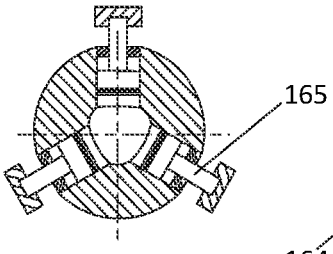
Figures 1, 2, 3, 4, 5, 6, 7, 8, 8C:
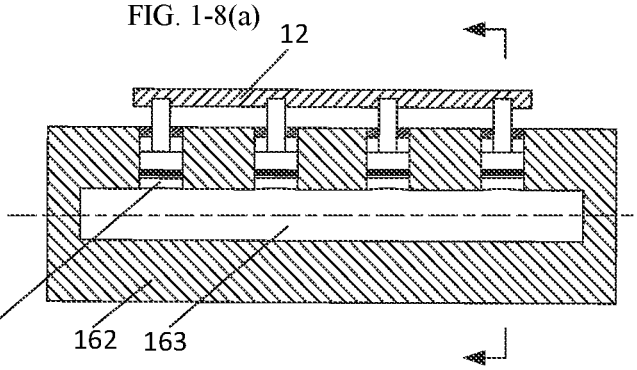
Figures 1, 2, 3, 4, 5, 6, 7, 8, 8F:
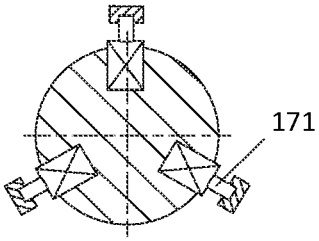
Figures 1, 2, 3, 4, 5, 6, 7, 8, 8E:
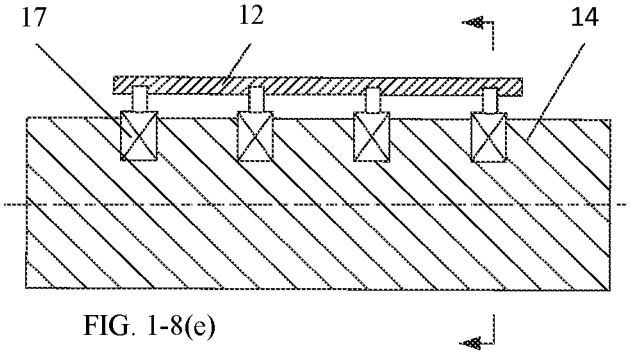
Figures 1, 2, 3, 4, 5, 6, 7, 8, 9:
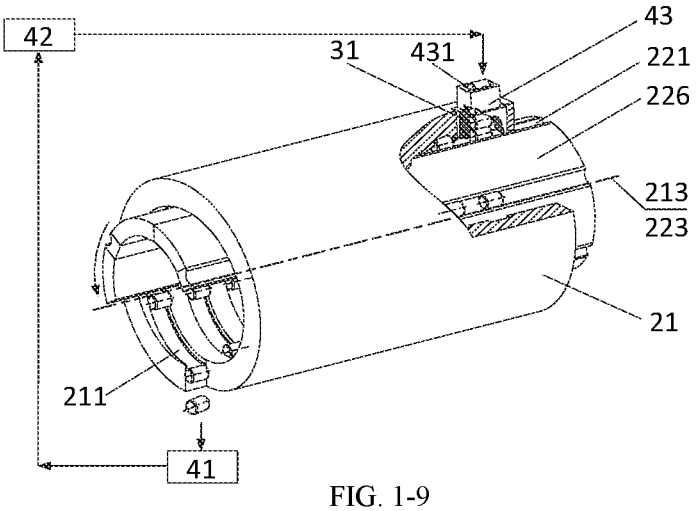
Figures 1, 2, 3, 4, 5, 6, 7, 8, 9, 10:
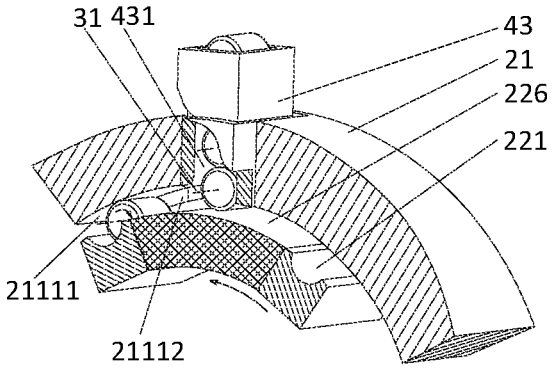
Figures 1, 2, 3, 4, 5, 6, 7, 8, 9, 10, 11:
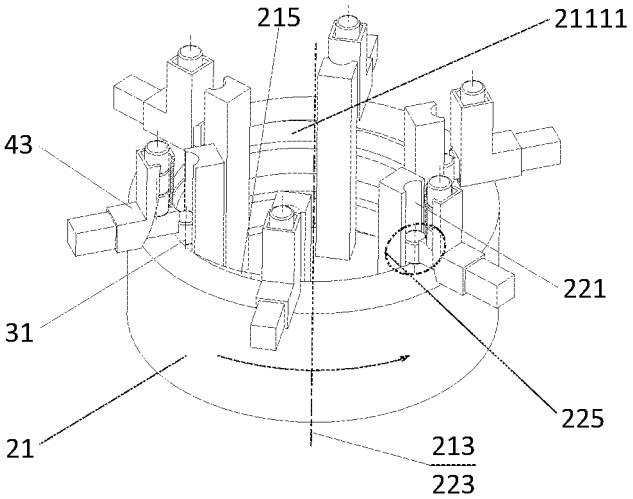
Figures 1A, 2:
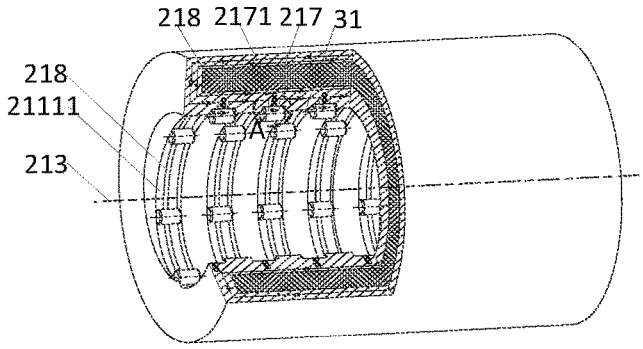
Figures 1B, 2:
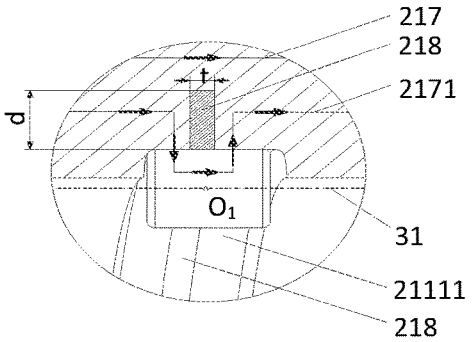
Figures 2, 2A:
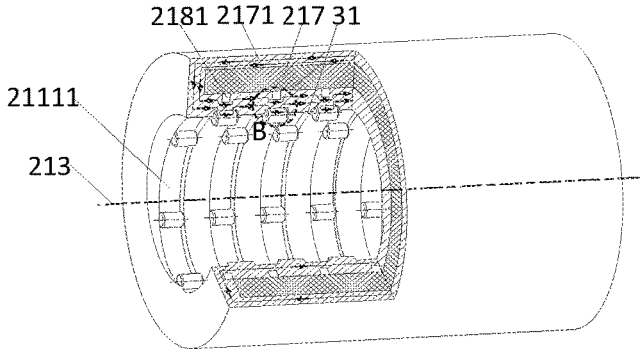
Figures 2, 2B:
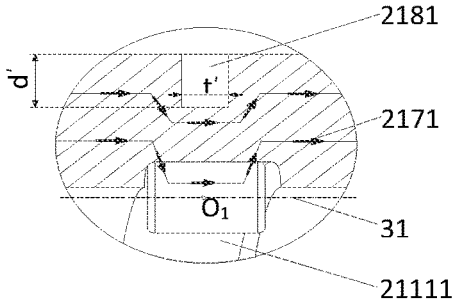
Figures 2, 3:
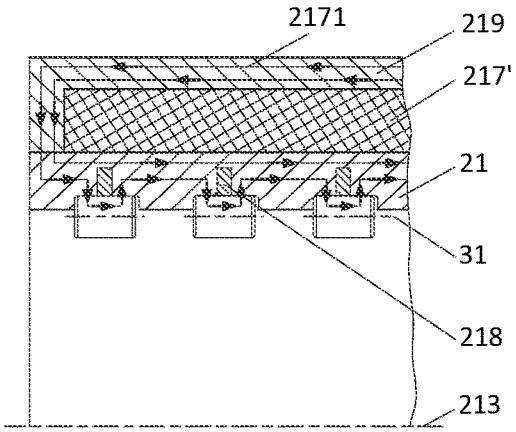
Figures 2, 3, 4:
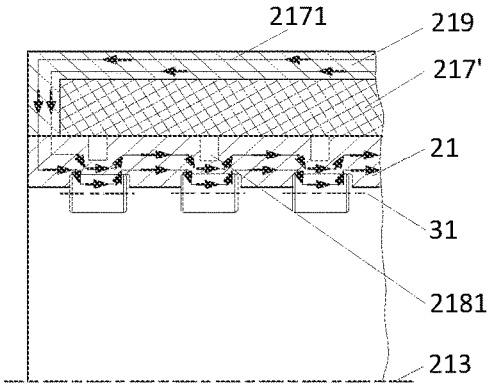
Figure 3:
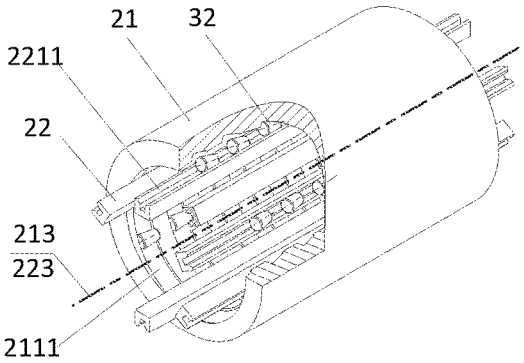
Figures 3, 4:
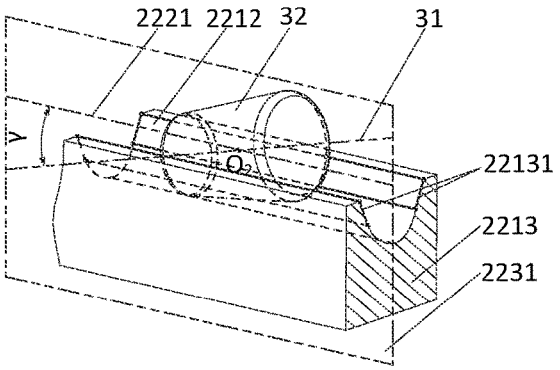
Figures 3, 4, 5, 5A:
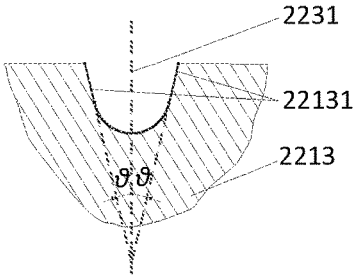
Figures 3, 4, 5, 5B:
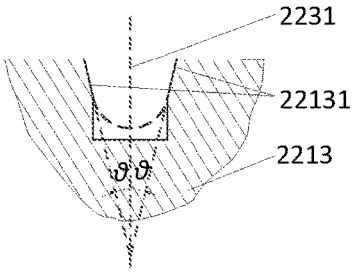
Figures 3, 4, 5, 6:
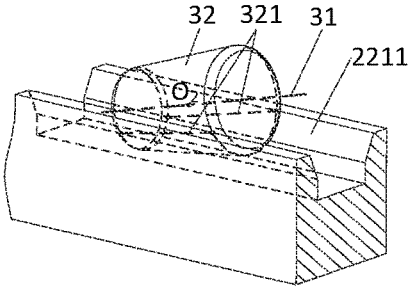
Figures 3, 4, 5, 6, 7:
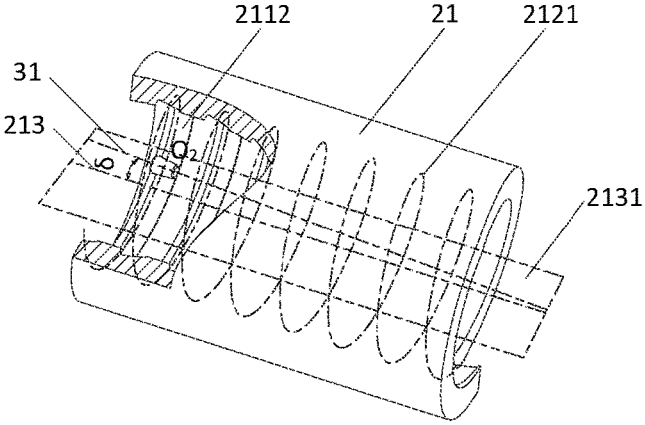
Figures 3, 4, 5, 6, 7, 8:
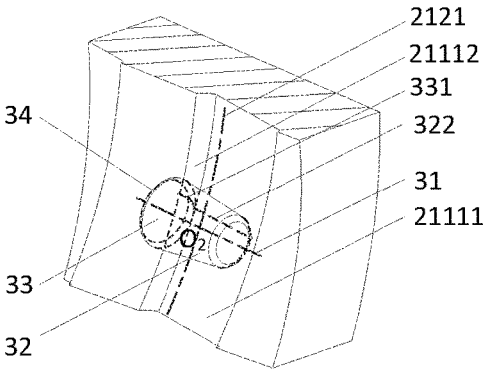
Figures 3, 4, 5, 6, 7, 8, 9:
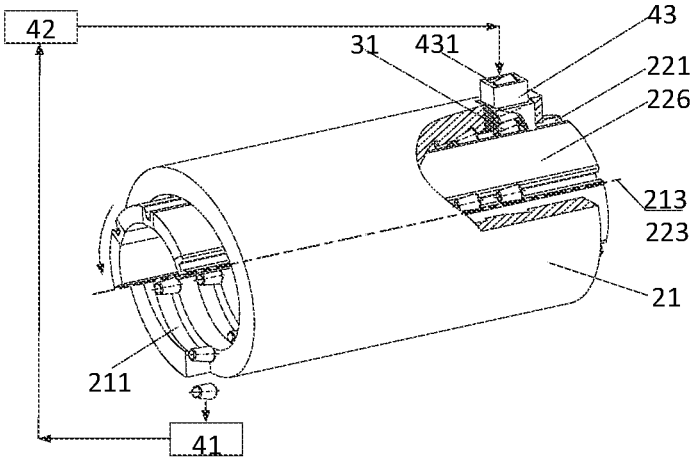
Figures 3, 4, 5, 6, 7, 8, 9, 10:
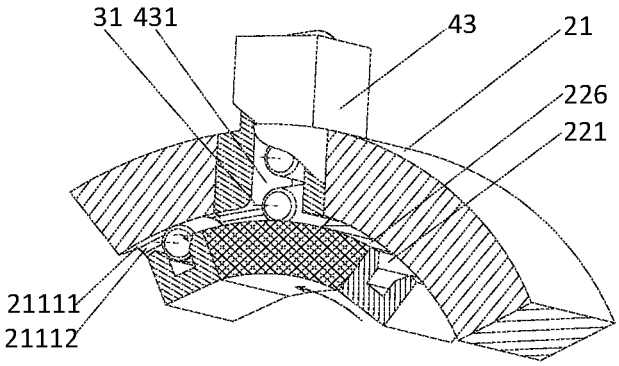
Figures 3, 4, 5, 6, 7, 8, 9, 10, 11:
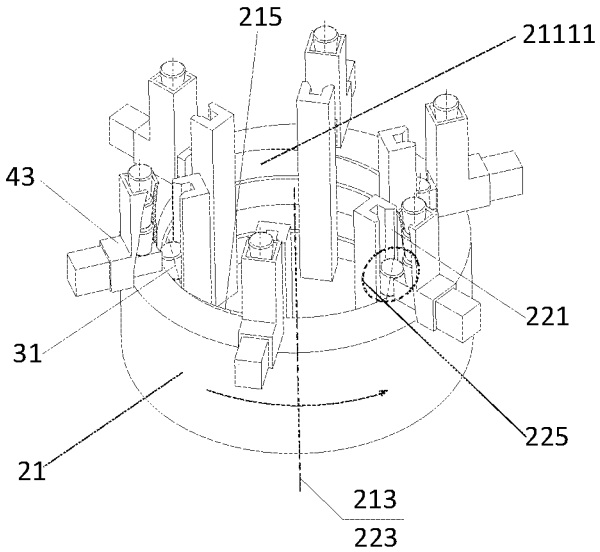
Figures 1A, 4:
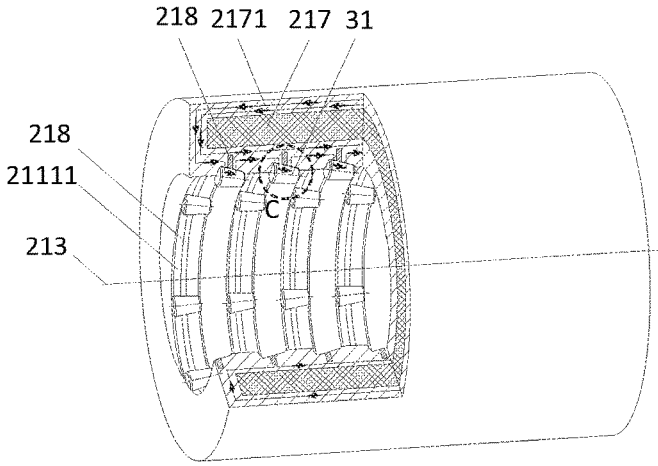
Figures 1B, 4:
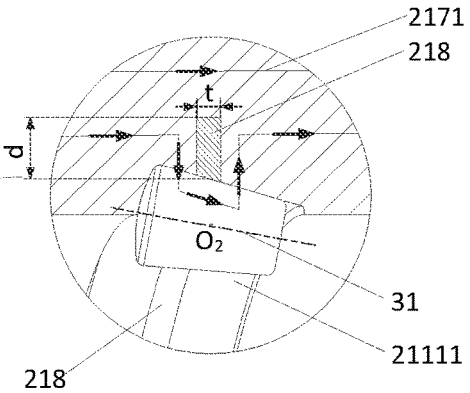
Figures 2A, 4:
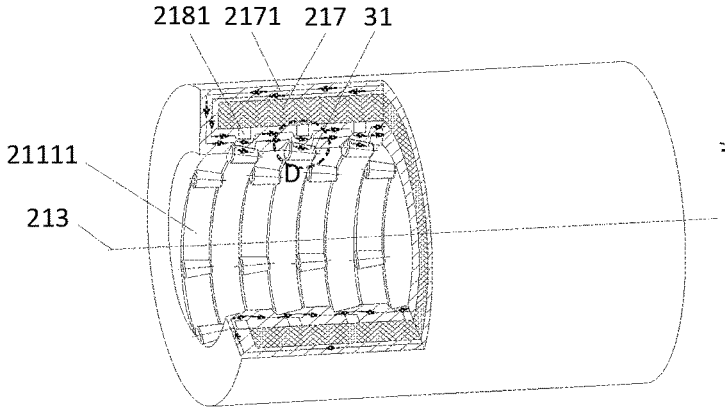
Figures 2B, 4:
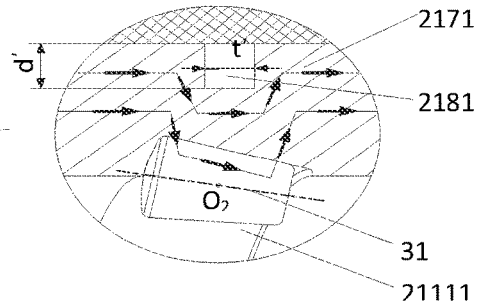
Figures 3, 4:
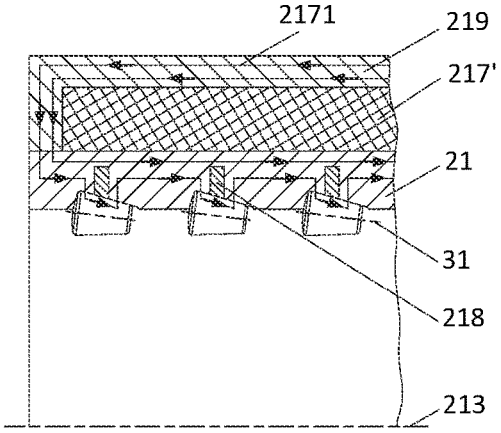
Figure 4:
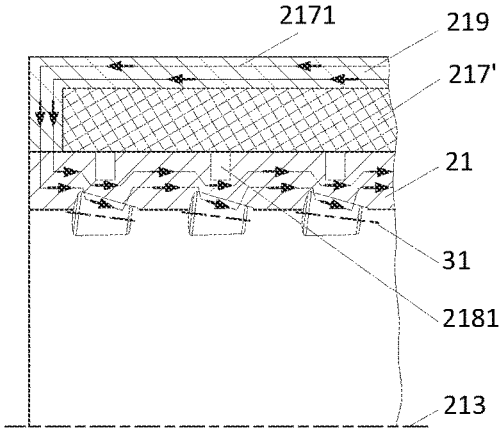
Figures 4, 5:
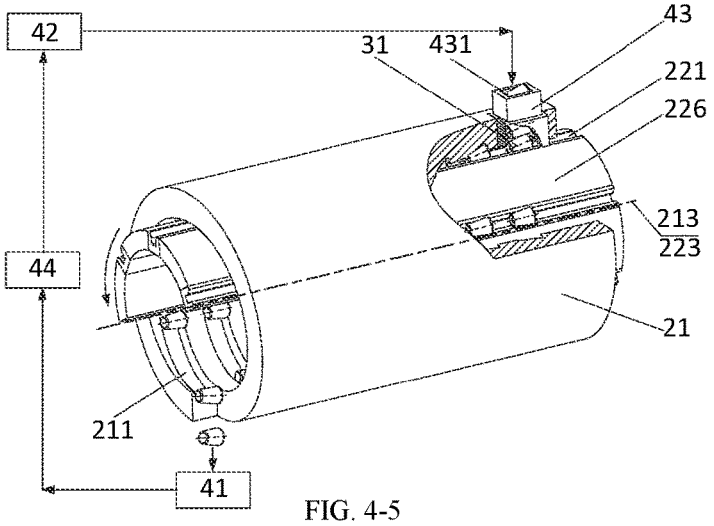
Figures 1A, 5:
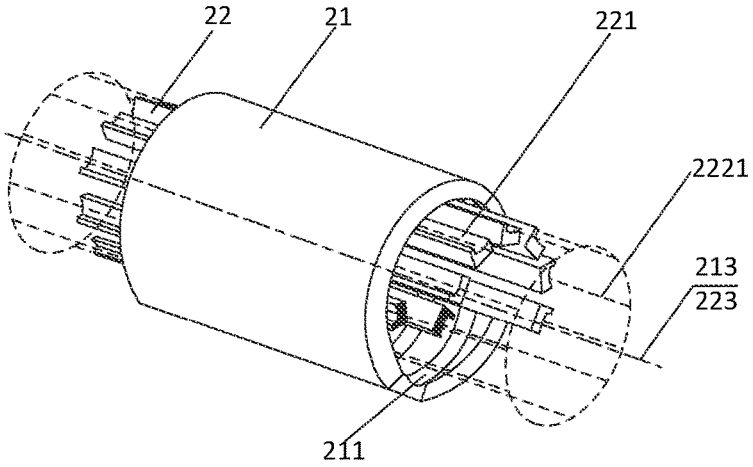
Figures 1B, 5:
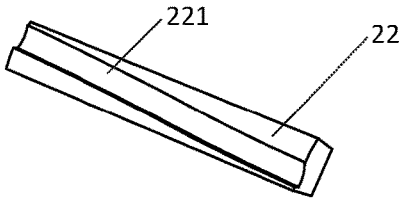
Figures 2A, 5:
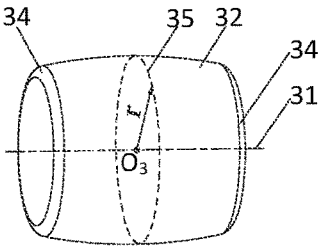
Figures 2B, 5:
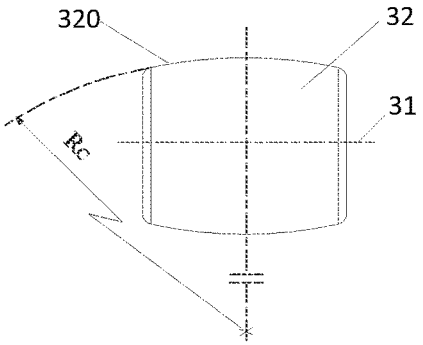
Figures 2C, 5:
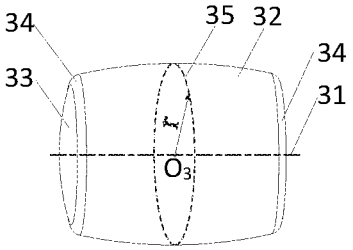
Figures 2D, 5:
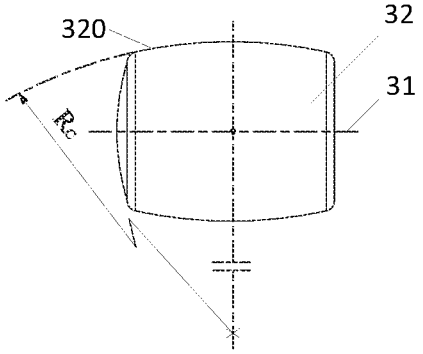
Figures 2E, 5:
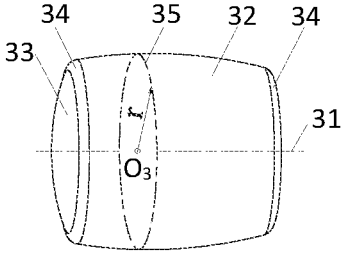
Figures 2F, 5:
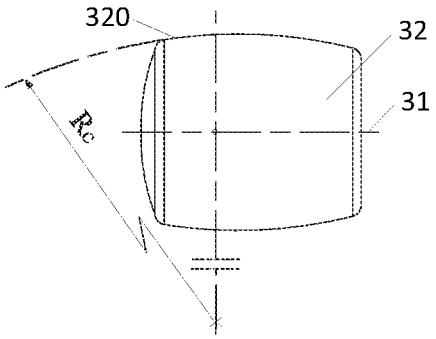
Figures 3, 5:
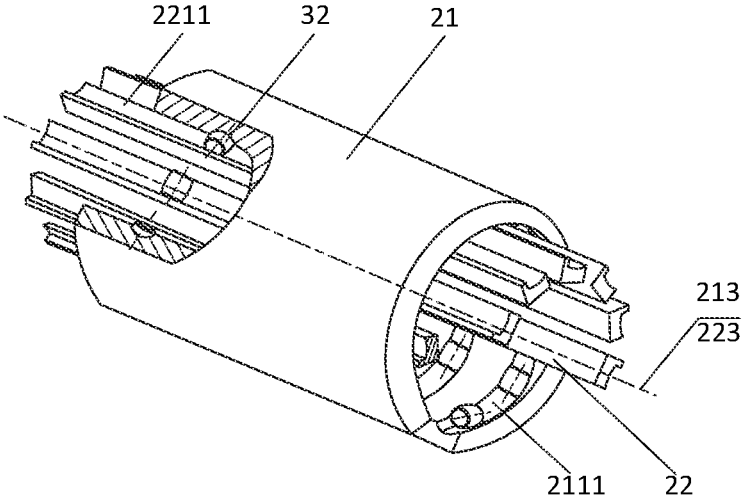
Figures 4A, 5:
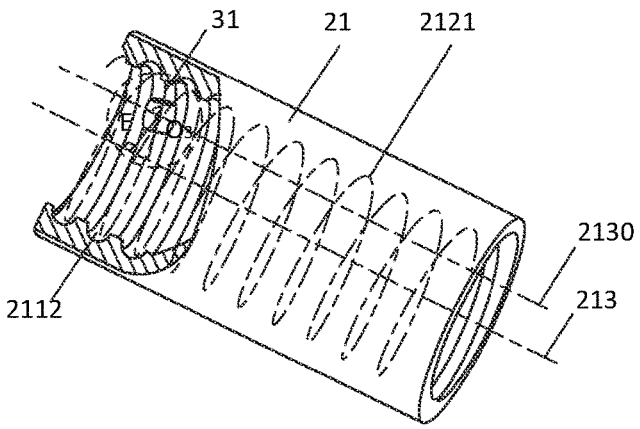
Figures 4B, 5:
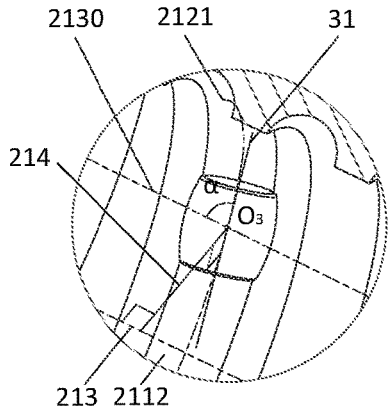
Figure 5:
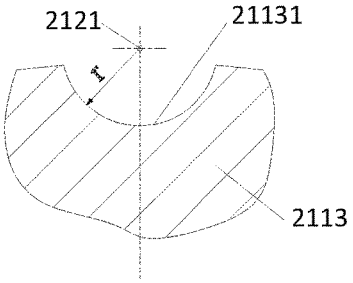
Figures 5, 6:
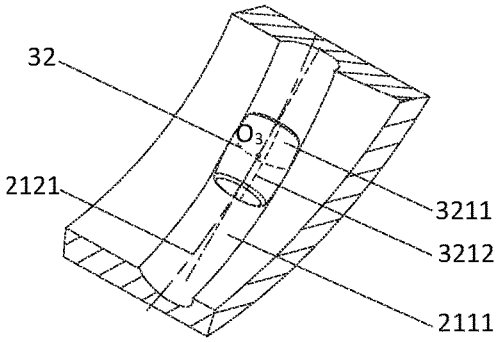
Figures 5, 6, 7, 7A:
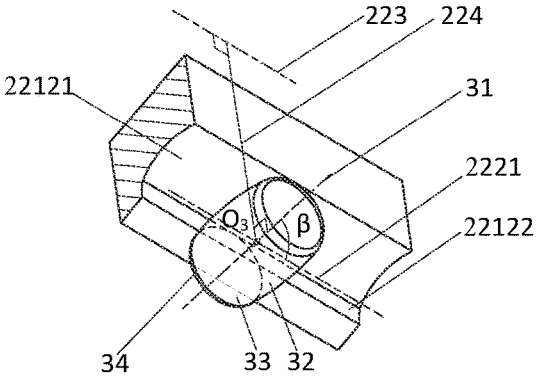
Figures 5, 6, 7, 7B:
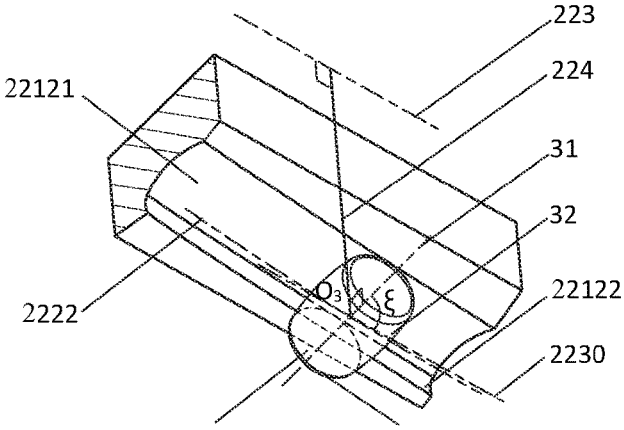
Figures 5, 6, 7, 8:
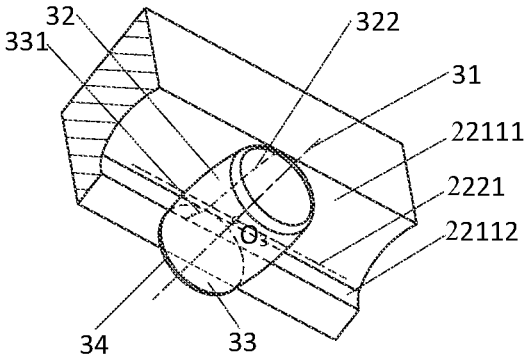
Figures 5, 6, 7, 8, 9, 9B:
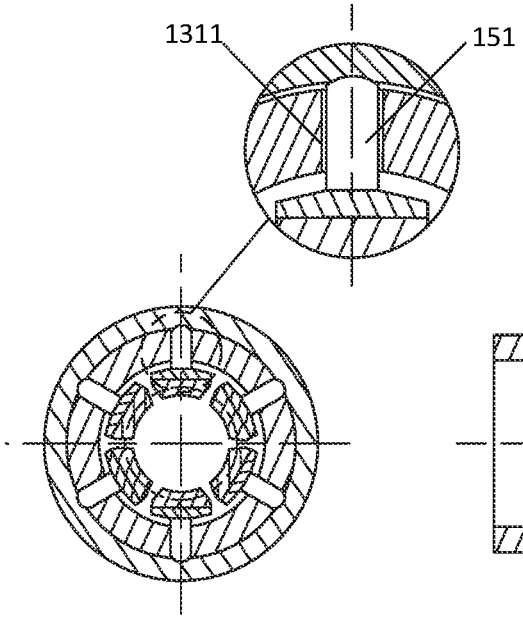
Figures 5, 6, 7, 8, 9, 9A:
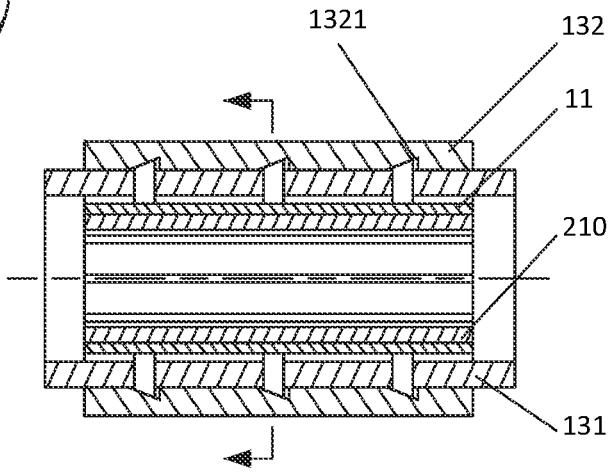
Figures 5, 6, 7, 8, 9, 9D:
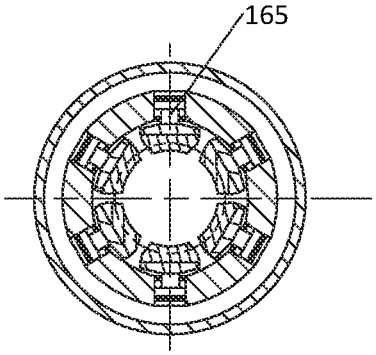
Figures 5, 6, 7, 8, 9, 9C:
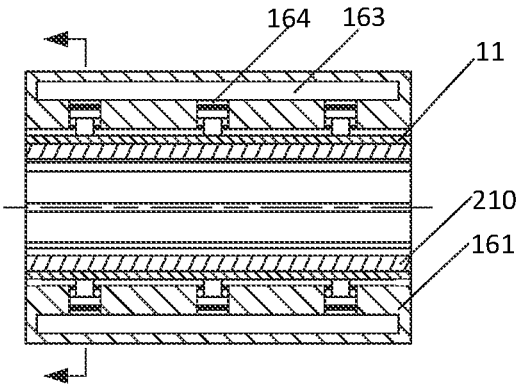
Figures 5, 6, 7, 8, 9, 9E, 9F:
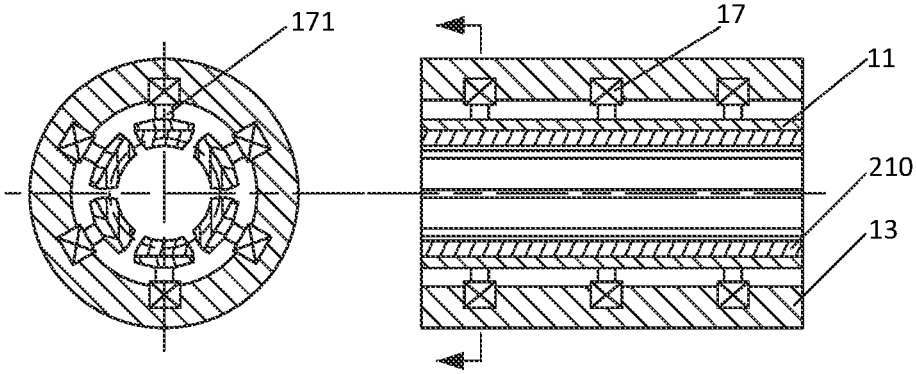
Figures 5, 6, 7, 8, 9, 10:
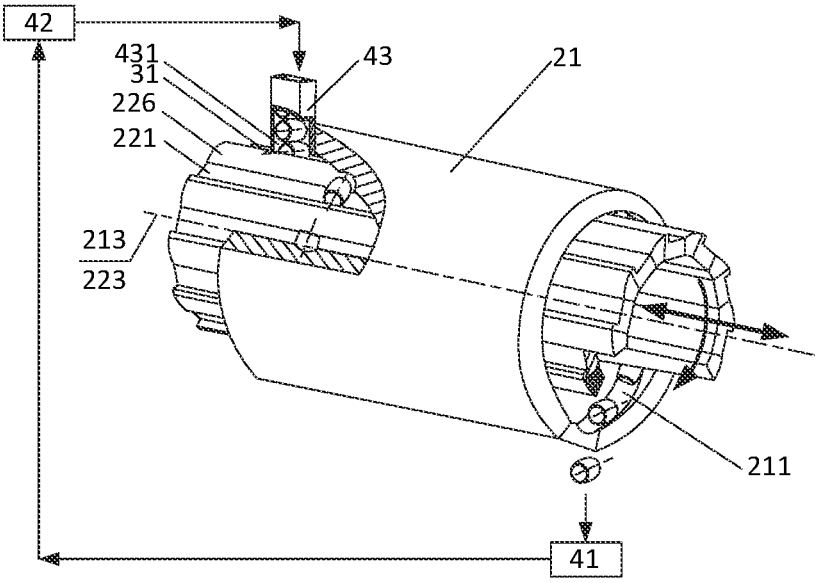
Figures 5, 6, 7, 8, 9, 10, 11:
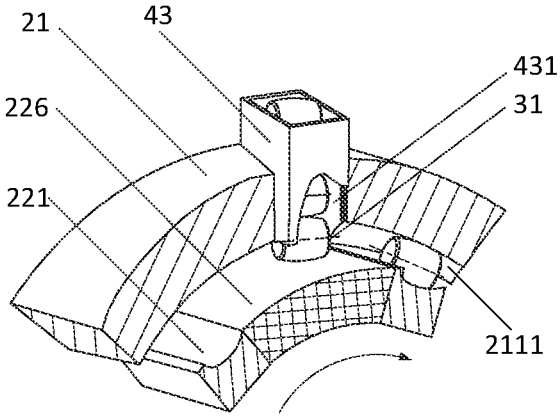
Figures 5, 6, 7, 8, 9, 10, 11, 12:
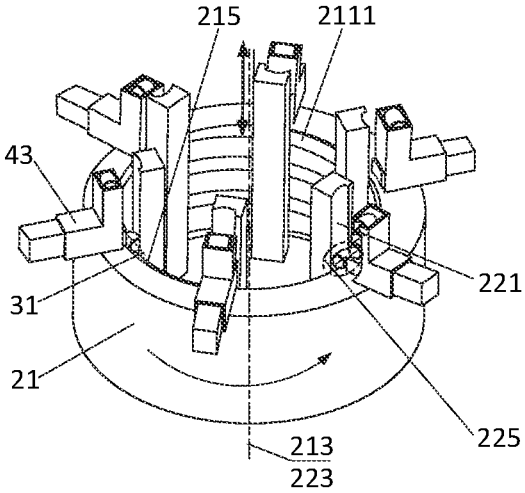
Figures 1, 6:
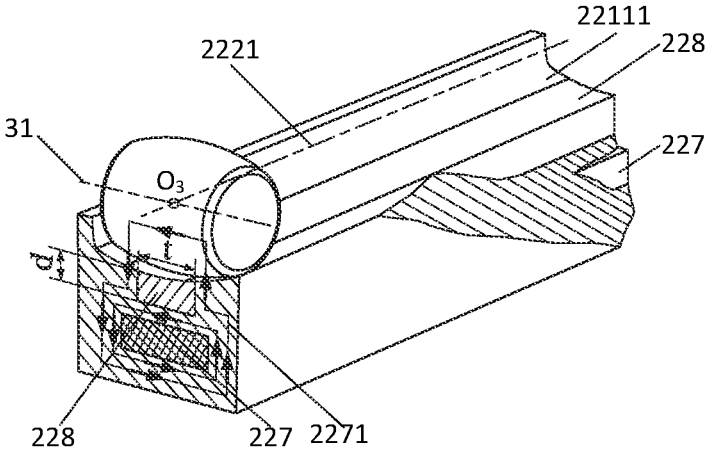
Figures 2, 6:
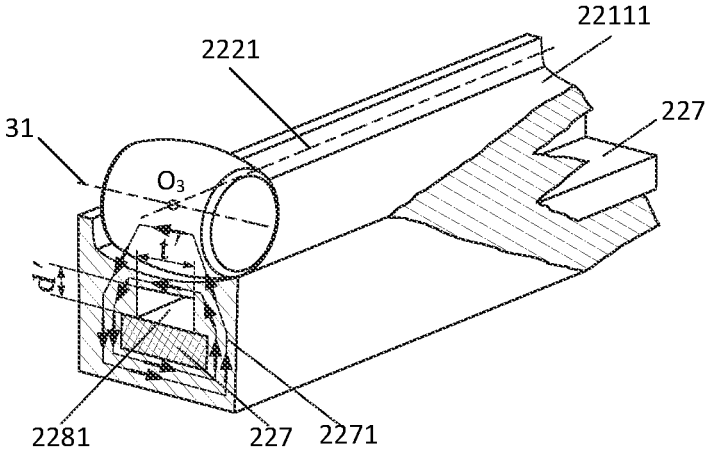
Figures 3, 6:
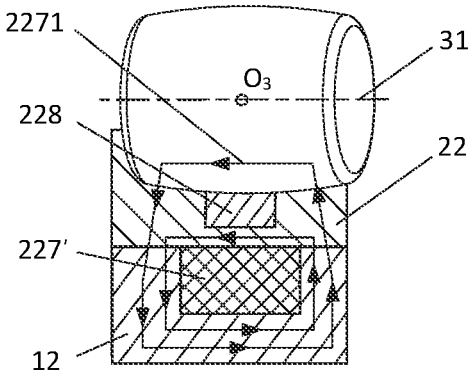
Figures 4, 6:
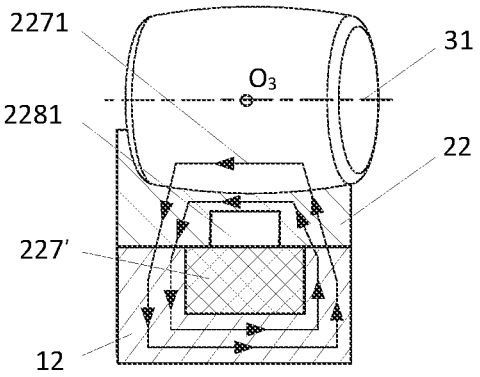
Figures 5, 6:
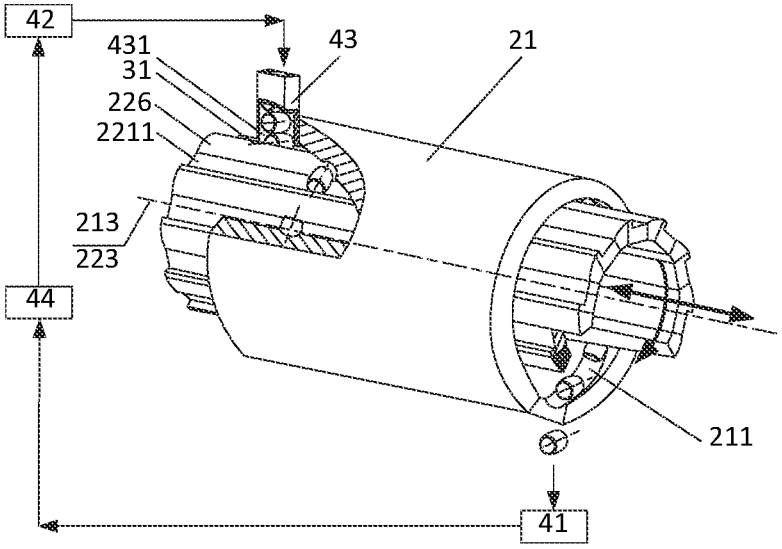

As shown in FIG. 5-1(*a*), the grinding tool kit comprises a grinding sleeve 21 and a grinding strip assembly. During grinding machining, the grinding sleeve 21 is coaxial with the grinding strip assembly; in the figure, reference numeral 213 refers to an axis of the grinding sleeve 21, reference numeral 223 refers to an axis of the grinding strip assembly, and the grinding strip assembly passes through the grinding sleeve 21. An inner surface of the grinding sleeve 21 is provided with one or a plurality of first spiral grooves 211. The grinding strip assembly comprises at least three grinding strips 22 distributed in a circumferential columnar array, a surface of each grinding strip 22 opposite to the inner surface of the grinding sleeve 21 is a front surface of the grinding strip 22, the front surface of each grinding strip 22 is provided with one grinding strip groove 221 penetrating through the grinding strip 22 along a length direction of the grinding strip 22. The grinding strip groove is a linear groove 221 or a second spiral groove. The first spiral groove 211 and the second spiral groove are both cylindrical spiral grooves. The inner surface of the grinding sleeve 21 shown in FIG. 5-1(*a*) is only provided with one first spiral groove 211, and the grinding strip groove arranged at the front surface of each grinding strip 22 is the linear groove 221. The two grinding strips in the right side of the figure are sectioned to display the first spiral groove 211, and reference numeral 2221 refers to a straight line B, as shown in FIG. 5-7(*a*). FIG. 5-1(*b*) shows that the grinding strip groove is the grinding strip 22 of the second spiral groove.

A type of a spherical roller to be machined comprises a symmetric spherical roller without spherical base surface, a symmetric spherical roller with spherical base surface and an asymmetric spherical roller. FIG. 5-2(*a*) and FIG. 5-2(*b*) show a three-dimensional structure and a two-dimensional structure of the symmetric spherical roller without spherical base surface respectively. FIG. 5-2(*c*) and FIG. 5-2(*d*) show a three-dimensional structure and a two-dimensional structure of the symmetric spherical roller with spherical base surface respectively. FIG. 5-2(*e*) and FIG. 5-2(*f*) show a three-dimensional structure and a two-dimensional structure of the asymmetric spherical roller respectively. As shown in FIG. 5-2(*a*), FIG. 5-2(*c*) and FIG. 5-2(*e*), along an axis 31 of the spherical roller, from one end to the other end, a diameter of a cross-sectional truncated circle of the rolling surface 32 is increased to the maximum and then gradually decreased from the maximum, wherein a cross-sectional truncated circle with a largest diameter is denoted as a maximum diameter truncated circle 35. For the symmetric spherical roller without spherical base surface and the symmetric spherical roller with spherical base surface, the maximum diameter truncated circle 35 is within a solid of the spherical roller. For the asymmetric spherical roller, the maximum diameter truncated circle 35 is within the solid of the spherical roller or is without the solid of the spherical roller. As shown in FIG. 5-2(*a*) and FIG. 5-2(*b*), a surface of the symmetric spherical roller without spherical base surface comprises a rolling surface 32, an end surface rounding 34 and an end plane at one end, and an end surface rounding 34 and an end plane at the other end. The rolling surface 32 is symmetrical relative to the maximum diameter truncated circle 35. As shown in FIG. 5-2(*c*) and FIG. 5-2(*d*), a surface of the symmetric spherical roller with spherical base surface comprises a rolling surface 32, an end surface rounding 34 and a spherical base surface 33 at one end, and an end surface rounding 34 and an end plane at the other end. The rolling surface 32 is symmetrical relative to the maximum diameter truncated circle 35. As shown in FIG. 5-2(*e*) and FIG. 5-2(*f*), a surface of the asymmetric spherical roller comprises a rolling surface 32, an end surface rounding 34 and a spherical base surface 33 at a big head-end, and an end surface rounding 34 and an end plane at a small-head end. The rolling surface 32 is asymmetrical relative to the maximum diameter truncated circle 35.

As shown in FIG. 5-1(*a*) and FIG. 5-3 (FIG. 5-3 is a distribution schematic diagram of the spherical roller in the first spiral groove 211 and the linear groove 221 in a grinding machining state, wherein in the figure, one grinding strip in the right side is sectioned and one grinding strip is hidden to display distribution of the spherical roller in the first spiral groove 211). A surface of the first spiral groove 211 comprises a working surface 2111 of the first spiral groove that is in contact with the spherical roller during grinding machining and a non-working surface (not marked in the figure) that is not in contact with the spherical roller. A surface of the grinding strip groove comprises a working surface of the grinding strip groove (FIG. 5-3 shows the working surface 2211 of the linear groove) that is in contact with the spherical roller during grinding machining and a non-working surface (not marked in the figure) that is not in contact with the spherical roller.

As shown in FIG. 5-1(*a*), FIG. 5-1(*b*), FIG. 5-3, FIG. 5-10 and FIG. 5-12, during grinding machining, one spherical roller is distributed at each intersection of the first spiral groove 211 and the grinding strip groove. Corresponding to each intersection, an area enclosed by the working surface 2111 of the first spiral groove and the working surface of the grinding strip groove is a grinding machining area. The grinding strip assembly and the grinding sleeve 21 rotate relatively around an axis 223 of the grinding strip assembly, and meanwhile, the grinding strip assembly and the grinding sleeve 21 makes relative reciprocating linear motion along the axis 223 of the grinding strip assembly or makes relative reciprocating spiral motion around the axis 223 of the grinding strip assembly. The grinding strip 22 applies a working pressure to the spherical roller distributed in the first spiral groove 211 along a radial direction of the grinding strip assembly, referring to FIG. 1-8(*a*), FIG. 1-8(*b*), FIG. 1-8(*c*), FIG. 1-8(*d*), FIG. 1-8(*e*) and FIG. 1-8(*f*). The spherical roller is in contact with the working surface 2111 of the first spiral groove and the working surface of the grinding strip groove respectively in the grinding machining area. The spherical roller rotates around an axis of the spherical roller under the friction drive of the working surface of the grinding strip groove, and simultaneously moves along the first spiral groove 211 and the grinding strip groove respectively under the pushing action of the working surface of the grinding strip groove and the working surface 2111 of the first spiral groove, and the rolling surface 32 of the spherical roller slides relative to the working surface 2111 of the first spiral groove and the working surface of the grinding strip groove, so that grinding machining of the rolling surface 32 is realized. When the grinding strip groove is the linear groove 221, the working surface of the grinding strip groove is the working surface 2211 of the linear groove, and when the grinding strip groove is the second spiral groove, the working surface of the grinding strip groove is the working surface of the second spiral groove.

The first spiral groove 211 is continuous or discontinuous. When the first spiral groove 211 is continuous, the grinding sleeve 21 is of an integrated structure. When the first spiral groove 211 is discontinuous, the grinding sleeve 21 is of a split structure, and the grinding sleeve 21 with the split structure consists of at least three grinding sleeve unit strips 210 distributed in a circumferential columnar array. As shown in FIG. 5-9(*a*), FIG. 5-9(*b*), FIG. 1-8(*c*), FIG. 5-9(*d*), FIG. 1-8(*e*) and FIG. 5-9(*f*), each first spiral groove 211 is intermittently distributed in the inner surface of the grinding sleeve 21 formed by a front surface of each grinding sleeve unit strip 210. A gap is provided between adjacent grinding sleeve unit strips 210 along a circumferential direction of the grinding sleeve 21 so as to facilitate the synchronous inward contraction of each grinding sleeve unit strip 210 along a radial direction of the grinding sleeve 21 to compensate wear of the working surface 2111 of the first spiral groove in the grinding machining process.

The working surface 2111 of the first spiral groove is on a scanning surface 2112 of the first spiral groove, and the scanning surface 2112 of the first spiral groove is a scanning surface with equal section. As shown in FIG. 5-1(*a*), FIG. 5-3, FIG. 5-4(*a*) and FIG. 5-4(*b*), FIG. 5-4(*b*) is an enlargement of a part E in FIG. 5-4(*a*). The spherical roller is taken as a scanning outline A of solid scanning of the scanning surface 2112 of the first spiral groove, a scanning path A of the scanning surface 2112 of the first spiral groove is a cylindrical equidistant helix, the scanning path A passing through a center of mass $O_3$ of the maximum diameter truncated circle 35 of the rolling surface 32 of the spherical roller (on the axis of the spherical roller) is denoted as a cylindrical helix A 2121, all the cylindrical helices A 2121 are on the same cylindrical surface, and an axis of the cylindrical helix A 2121 is the axis of the grinding sleeve 21. The cylindrical helix A 2121 and the axis 31 of the spherical roller as the scanning outline A are tangent to the circle center $O_3$, and a helical rise angle of the cylindrical helix A 2121 is denoted as λ. An included angle between the axis 31 of the spherical roller and the axis 213 of the grinding sleeve is denoted as α, as shown in FIG. 5-4(*b*), reference numeral 2130 is an auxiliary straight line A parallel to the axis 213 of the grinding sleeve and passing through the circle center $O_3$, and $\alpha+\lambda=90°$. A vertical line A 214 of the circle center $O_3$ to the axis 213 of the grinding sleeve is vertical to the axis 31 of the spherical roller. A radius of curvature of an axial section profile 320 of the rolling surface 32 is denoted as $R_c$ (as shown in FIG. 5-2(*b*), FIG. 5-2(*d*) and FIG. 5-2(*f*)), a radius of the cylindrical helix A 2121 is denoted as $R_0$, and a radius of the maximum diameter truncated circle 35 is denoted as r (as shown in FIG. 5-2(*a*), FIG. 5-2(*c*) and FIG. 5-2(*e*)), then $R_c=R_0(1+\tan^2\lambda)+r$. Solid scanning is carried out on the scanning outline A along the scanning path A, then a groove surface formed by enveloping of the scanning outline A on the inner surface of the grinding sleeve 21 is the scanning surface 2112 of the first spiral groove.

A normal section of the first spiral groove 211 is a plane perpendicular to a tangent of the cylindrical helix A 2121 and passing through a point of tangency of the tangent. As shown in FIG. 5-5, in the normal section 2113 of the first spiral groove, a normal section outline A 21131 of the scanning surface of the first spiral groove is a circular arc B, and a radius of curvature of the circular arc B is equal to the radius of the maximum diameter truncated circle 35. In the normal section 2113 of the first spiral groove, an initial outline of the working surface 2111 of the first spiral groove is the circular arc B or a discontinuous circular arc B, or is a V shape externally tangent with the circular arc B, or a polygon externally tangent with the circular arc B.

During grinding machining, as shown in FIG. 5-6, the rolling surface 32 is in cross line contact with the working surface 2111 of the first spiral groove. A cross contact line I 3211 is longitudinally distributed along a bottom of the working surface 2111 of the first spiral groove, and a cross contact line II 3212 is transversely distributed along the working surface 2111 of the first spiral groove.

A specific meaning that the scanning surface 2112 of the first spiral groove is a scanning surface with equal section, is that: in the normal section 2113 of the first spiral groove at different positions of the first spiral groove 211, the normal section outline A 22131 keeps unchanged.

It may be understood that a relationship between the scanning surface 2112 of the first spiral groove and the working surface 2111 of the first spiral groove in the present invention is that the scanning surface 2112 of the first spiral groove is a continuous surface, the working surface 2111 of the first spiral groove and the scanning surface 2112 of the first spiral groove have the same shape, position and boundary, and under the premise of not affecting a contact relationship between the spherical roller and the working surface 2111 of the first spiral groove and not affecting grinding uniformity of the rolling surface 32, the working surface 2111 of the first spiral groove may be discontinuous.

In the present invention, it is recommended that all the first spiral grooves 211 be uniformly distributed around the axis 213 of the grinding sleeve.

The working surface of the grinding strip groove is on a scanning surface of the grinding strip groove, and the scanning surface of the grinding strip groove is a scanning surface with equal section. When the spherical roller is a symmetric spherical roller without spherical base surface, the working surface of the grinding strip groove comprises a working surface I of the grinding strip groove in contact with a rolling surface 32 of the symmetric spherical roller without spherical base surface during grinding machining or further comprises a working surface II of the grinding strip groove in contact with an end surface rounding 34 of the symmetric spherical roller without spherical base surface; when the spherical roller is a symmetric spherical roller with spherical base surface, the working surface of the grinding strip groove comprises a working surface I of the grinding strip groove in contact with a rolling surface 32 of the symmetric spherical roller with spherical base surface during grinding machining and a working surface II of the grinding strip groove in contact with a reference end surface of the symmetric spherical roller with spherical base surface; and when the spherical roller is an asymmetric spherical roller, the working surface of the grinding strip groove comprises a working surface I of the grinding strip groove in contact with a rolling surface 32 of the asymmetric spherical roller during grinding machining and a working surface II of the grinding strip groove in contact with a big head-end surface of the asymmetric spherical roller. The reference end surface comprises the spherical base surface of the symmetric spherical roller with spherical base surface 33 or further comprises the end surface rounding 34 at the same end as the spherical base surface 33, and the big head-end surface comprises the spherical base surface 33 of the asymmetric spherical roller or further comprises the end surface rounding 34 of the big head-end of the asymmetric spherical roller. The working surface I of the grinding strip groove is on a scanning surface I of the grinding strip groove, and the working surface II of the grinding strip groove is on a scanning surface II of the grinding strip groove.

When the grinding strip groove is the linear groove 221, the working surface I of the grinding strip groove is a working surface I 22111 of the linear groove, and the working surface II of the grinding strip groove is a working surface II 22112 of the linear groove. When the scanning surface of the grinding strip groove is the scanning surface of the linear groove, the scanning surface I of the grinding strip groove is a scanning surface I 22121 of the linear groove, and the scanning surface II of the grinding strip groove is a scanning surface II 22122 of the linear groove. As shown in FIG. 5-1(*a*), FIG. 5-3 and FIG. 5-7(*a*), the spherical roller as the scanning outline A of solid scanning of the scanning surface 2112 of the first spiral groove is taken as the scanning outline B1 of solid scanning of the scanning surface of the linear groove, the scanning path B1 of the scanning surface of the linear groove is a straight line parallel to the array axis of the grinding strip assembly, and the scanning path B1 passing through the center $O_3$ is demoted as a straight line B 2221. A distance from the straight line B 2221 to the array axis is an array radius, and the array axis is the axis of the grinding strip assembly. An included angle between the axis 31 of the spherical roller as the scanning outline B1 and the straight line B 2221 is denoted as β, and β=α. A vertical line B 224 of the circle center $O_3$ to the axis 223 of the grinding strip assembly is vertical to the axis 31 of the spherical roller. Solid scanning is carried out on the scanning outline B1 along the scanning path B1, then a groove surface formed by enveloping of a rolling surface 32 of the spherical roller as the scanning outline B1 on the front surface 22 of the grinding strip 22 is the scanning surface I 22121 of the linear groove, and a groove surface formed by enveloping of the end surface rounding 34 at one end of the symmetric spherical roller without spherical base surface as the scanning outline B1 or the reference end surface of the symmetric spherical roller with spherical base surface as the scanning outline B1 or the big head-end surface of the asymmetric spherical roller as the scanning outline B1 is the scanning surface II 22122 of the linear groove.

When the grinding strip groove is the second spiral groove, the working surface I of the grinding strip groove is a working surface I of the second spiral groove, the working surface II of the grinding strip groove is a working surface II of the second spiral groove, the scanning surface of the grinding strip groove is a scanning surface of the second spiral groove, the scanning surface I of the grinding strip groove is a scanning surface I of the second spiral groove, and the scanning surface II of the grinding strip groove is a scanning surface II of the second spiral groove. As shown in FIG. 5-1(*a*), FIG. 5-1(*b*), FIG. 5-3 and FIG. 5-7(*b*), the spherical roller as a scanning outline A of solid scanning of the scanning surface 2112 of the first spiral groove is taken as a scanning outline B2 of solid scanning of the scanning surface of the grinding strip groove, and a scanning path B2 of the scanning surface of the second spiral groove is a cylindrical equidistant helix. The scanning path B2 passing through the circle center $O_3$ is denoted as a cylindrical helix B 2222, all the cylindrical helices B 2222 are on the same cylindrical surface. An axis of the cylindrical helix B 2222 is the array axis of the grinding strip assembly, a radius of the cylindrical helix B 2222 is an array radius of the grinding strip assembly, and the array axis is the axis of the grinding strip assembly. An included angle between the axis 31 of the spherical roller as the scanning outline B2 and the axis of the grinding strip assembly is denoted as ξ, and ξ=α. A vertical line B 224 of the circle center $O_3$ to the axis 223 of the grinding strip assembly is vertical to the axis 31 of the spherical roller. A rotation direction of the cylindrical helix B 2222 is opposite to that of the cylindrical helix A 2121. Solid scanning is carried out on the scanning outline B2 along the scanning path B2, then a groove surface formed by enveloping of the rolling surface 32 of the spherical roller as the scanning outline B2 on the front surface of the grinding strip 22 is the scanning surface I of the second spiral groove, and a groove surface formed by enveloping of the end surface rounding 34 at one end of the symmetric spherical roller without spherical base surface as the scanning outline B1 or the reference end surface of the symmetric spherical roller with spherical base surface as the scanning outline B1 or the big head-end surface of the asymmetric spherical roller as the scanning outline B1 is the scanning surface II of the second spiral groove. In the present invention, a helical rise angle of the cylindrical helix B 2222 is denoted as ξ, as shown in FIG. 5-7(*b*), reference numeral 2230 refers to an auxiliary straight line B parallel to the axis 223 of the grinding strip assembly and passing through the circle center $O_3$, and it is recommended that ζ+λ=90°.

During grinding machining, the array radius is equal to a radius of the cylindrical helix A 2121.

Under the constraint of the working surface 2111 of the first spiral groove, the rolling surface 32 is in line contact with the working surface I of the grinding strip groove. For the symmetric spherical roller without spherical base surface, when the grinding strip groove is designed with the working surface II of the grinding strip groove, the end surface rounding 34 at one end of the symmetric spherical roller without spherical base surface is in line contact with the working surface II of the grinding strip groove. For the symmetric spherical roller with spherical base surface or the asymmetric spherical roller, the reference end surface of the symmetric spherical roller with spherical base surface or the big head-end surface of the asymmetric spherical roller is in line contact with the working surface II of the grinding strip groove.

As shown in FIG. 5-8, reference numeral 322 refers to a contact line II between the rolling surface 32 of the symmetric spherical roller with spherical base surface and the working surface I 22111 of the linear groove, and reference numeral 331 refers to a contact line III between the reference end surface of the symmetric spherical roller with spherical base surface and the working surface II 22112 of the linear groove.

A normal section of the linear groove 221 is vertical to a plane of the straight line B 2221. A normal section of the second spiral groove is a plane perpendicular to a tangent of the cylindrical helix B 2222 and passing through a point of tangency of the tangent. A specific meaning that the scanning surface of the grinding strip groove is a scanning surface with equal section, is that: in the normal section of the grinding strip groove at different positions of the grinding strip groove, the normal section outline of the scanning surface of the grinding strip groove keeps unchanged.

It may be understood that a relationship between the scanning surface of the grinding strip groove and the working surface of the grinding strip groove in the present invention is that the scanning surface of the grinding strip groove is a continuous surface, the working surface of the grinding strip groove and the scanning surface of the grinding strip groove have the same shape, position and boundary, and under the premise of not affecting a contact relationship between the spherical roller and the working surface of the grinding strip groove and not affecting grinding uniformity of the rolling surface 32, the working surface of the grinding strip groove may be discontinuous.

In the present invention, it is recommended that all the grinding strip grooves be uniformly distributed around the axis 223 of the grinding strip assembly.

Embodiment 9 of grinding tool kit: a grinding tool kit for finish machining of a rolling surface of a spherical roller.

The main differences between the grinding tool kit and the grinding tool kit according to Embodiment 8 of grinding tool kit are as follows:

the reference end surface comprises the spherical base surface 33 of the symmetric spherical roller with spherical base surface or comprises the end surface rounding at the same end as the spherical base surface or comprises the spherical base surface 33 and the end surface rounding 34 at the same end as the spherical base, and the big head-end surface comprises the spherical base surface 33 of the asymmetric spherical roller or comprises the end surface rounding 34 of the big head-end of the asymmetric spherical roller or comprises the spherical base surface 33 and the end surface rounding 34 of the big head-end.

Embodiment 10 of grinding tool kit: a grinding tool kit for finish machining of a rolling surface of a spherical roller made of a ferromagnetic material (such as GCr15, G20CrNi2MoA, Cr4Mo4V30 and the like).

The main differences between the grinding tool kit and the grinding tool kit according to Embodiment 8 of grinding tool kit or according to Embodiment 8 of grinding tool kit are as follows:

the grinding strip 22 is made of a magnetic conductive material, as shown in FIG. 6-1, and the strip-shaped magnetic structure 227 is embedded in the solid inside of the grinding strip 22 along the scanning path B1 or the scanning path B2 so as to form a grinding sleeve magnetic field with magnetic lines distributed on a normal section of the grinding strip groove in the grinding machining area, and reference numeral 2271 refers to the magnetic lines of the grinding strip magnetic field. The working surface I of the grinding strip groove is embedded with one or multiple strip-shaped non-magnetic conductive materials 228 along the scanning path B1 or the scanning path B2 so as to increase magnetic resistance of the magnetic lines 2271 of the grinding strip magnetic field passing through the solid of the grinding strip 22 at the working surface I of the grinding strip groove. FIG. 6-1 shows an example that the grinding strip groove is the linear groove, wherein the working surface I of the grinding strip groove is embedded with one strip-shaped non-magnetic conductive material 228.

On one hand, a width t and an embedded depth d of the strip-shaped non-magnetic conductive material 228 and a distance between two adjacent strip-shaped non-magnetic conductive materials need to meet structural strength and rigidity requirements of the working surface I of the grinding strip groove. On the other hand, it is required to ensure that the magnetic lines 2271 of the grinding strip magnetic field in the grinding machining area preferentially pass through the spherical roller that is in contact with the working surface I of the grinding strip groove during grinding machining.

The strip-shaped magnetic structure 227 may be a permanent-magnetic structure or an electromagnetic structure or an electrically-controlled permanent-magnetic structure. The magnetic conductive material is made of a soft magnetic structural material with high magnetic permeability, such as soft iron, low carbon steel, medium carbon steel, soft magnetic alloy, and the like. The strip-shaped non-magnetic conductive material 228 is made of a non-ferromagnetic structural material, such as nonferrous metal, austenitic stainless steel, and the like.

Embodiment 11 of grinding tool kit: a grinding tool kit for finish machining of a rolling surface of a spherical roller made of a ferromagnetic material (such as GCr15, G20CrNi2MoA, Cr4Mo4V30 and the like).

The main differences between the grinding tool kit and the grinding tool kit according to Embodiment 10 of grinding tool kit are as follows:

as shown in FIG. 6-2, the working surface I of the grinding strip groove is not embedded with the strip-shaped non-magnetic conductive material along the scanning path B1 or the scanning path B2, but one or multiple strip-shaped grinding strip magnetic isolation grooves 2281 are arranged along the scanning path B1 or the scanning path B2 on a solid inner cavity side of the grinding strip 22 facing away from the working surface I of the grinding strip groove so as to increase magnetic resistance of the magnetic lines 2271 of the grinding strip magnetic field passing through the solid of the grinding strip 22 at the working surface I of the grinding strip groove. FIG. 6-2 shows an example that the grinding strip groove is the linear groove.

On one hand, a width t' and an embedded depth d' of the grinding strip isolation groove and 228 and a distance between two adjacent grinding strip isolation grooves need to meet structural strength and rigidity requirements of the working surface I of the grinding strip groove. On the other hand, it is required to ensure that the magnetic lines 2271 of the grinding strip magnetic field in the grinding machining area preferentially pass through the spherical roller that is in contact with the working surface I of the grinding strip groove during grinding machining.

Embodiment 1 of apparatus: an apparatus for finish machining of a rolling surface of a cylindrical roller.

The apparatus comprises a main machine, an external circulation system, a grinding sleeve fixture, a grinding strip assembly fixture and the grinding tool kit according to Embodiment 1 of grinding tool kit.

The grinding sleeve fixture is used for clamping the grinding sleeve 21.

The grinding strip assembly fixture is used for clamping the grinding strip assembly. The grinding strip assembly fixture comprises one group of grinding strip mounting bases 12 which are distributed in a circumferential columnar array and used for fixedly connecting the grinding strip 22 and a radial expansion mechanism located in a center of the grinding strip assembly fixture. A back surface (surface facing away from the front surface of the grinding strip 22) of the grinding strip 22 is fixedly connected to a surface of the grinding strip mounting base 12 located at a periphery of the grinding strip assembly fixture. As shown in FIG. 1-8(*a*), FIG. 1-8(*b*), FIG. 1-8(*c*), FIG. 1-8(*d*), FIG. 1-8(*e*) and FIG. 1-8(*f*), the radial expansion mechanism comprises a radial expansion member and a basic mandrel coaxial with the grinding strip assembly. The axis 223 of the grinding strip assembly is an axis of the grinding strip assembly fixture. The basic mandrel is connected to the main machine. The radial expansion member is connected to the grinding strip mounting bases 12 and the basic mandrel respectively, used for driving all the grinding strip mounting bases 12 and the grinding strips 22 on the grinding strip mounting bases to expand and load outward synchronously along a radial direction of the grinding strip assembly fixture and transmit torque between the basic mandrel and the grinding strip mounting bases 12.

The radial expansion mechanism is one of a conical surface radial expansion mechanism, a communicating-type fluid pressure radial expansion mechanism and a micro-displacement unit radial expansion mechanism.

As shown in FIG. 1-8(*a*) and FIG. 1-8(*b*), the basic mandrel of the conical surface radial expansion mechanism comprises a guide sleeve B 141 and a tapered mandrel 142. An inner surface of the guide sleeve B 141 is an inner cylindrical surface, a circumference of the guide sleeve B 141 is provided with guide holes B 1411, and all the guide holes B 1411 are arranged along the radial direction of the grinding strip assembly fixture. The tapered mandrel 142 is provided with is provided with a coaxial outer cylindrical surface and a plurality of outer conical surfaces 1421, and the outer cylindrical surface of the tapered mandrel 142 is in sliding fit with the inner cylindrical surface of the guide sleeve B 141. A radial expansion member of the conical surface radial expansion mechanism is a guide post B 152, one end of the guide post B 152 is fixedly connected with the grinding strip mounting base 12, an end surface at the other end of the guide post B 152 is tangent to the outer conical surface 1421, and a cylindrical surface of the guide post B152 is in sliding fit with the guide hole B 1411. When the tapered mandrel 142 moves toward a small end of the outer conical surface 1421 relative to the guide sleeve B 141, the guide post B 152 pushes the grinding strip mounting base 12 and the grinding strip 22 on the grinding strip mounting base to expand outward synchronously along the radial direction of the grinding strip assembly under the action of the outer conical surface 1421. The guide post B 152 transmits torque between the guide sleeve B 141 and the grinding strip mounting base 12.

As shown in FIG. 1-8(*c*) and FIG. 1-8(*d*), the basic mandrel of the communicating-type fluid pressure radial expansion mechanism is a shaft sleeve-shaped cylinder 161 with a female cavity 163 and a plurality of cylinder sleeves 164. The cylinder sleeves 164 are arranged along a periphery of the shaft sleeve-shaped cylinder 161 and the radial direction of the grinding strip assembly fixture. The female cavity 163 is communicated with the cylinder sleeve 164 and filled with hydraulic oil or compressed air. A radial expansion member of the communicating-type fluid pressure radial expansion mechanism is a piston rod 165 arranged in each cylinder sleeve 164, a piston end of the piston rod 165 slides in the cylinder sleeve 164, and the other end of the piston rod 165 is fixedly connected with the grinding strip mounting base 12. When a pressure of the hydraulic oil or the compressed air in the female cavity 163 is increased, the piston rod 165 pushes the grinding strip mounting base 12 and the grinding strip 22 on the grinding strip mounting base to expand outward synchronously along the radial direction of the grinding strip assembly. The piston rod 165 transmits torque between the shaft sleeve-shaped cylinder 161 and the grinding strip mounting base 12.

As shown in FIG. 1-8(*e*) and FIG. 1-8(*f*), the radial expansion member of the micro-displacement unit radial expansion mechanism is a micro-displacement unit 17. The micro-displacement unit 17 is one of telescopic units that can generate one-dimensional micro-displacement, such as an electrostrictive unit, a magnetostrictive unit, a telescopic motor unit, an ultrasonic motor unit, a pneumatic unit, a hydraulic unit, and the like. The micro-displacement unit 17 is installed on the periphery of the basic mandrel 14 and arranged along the radial direction of the grinding strip assembly fixture. The micro-displacement unit is provided with a push rod 171, and the push rod 171 is fixedly connected with the grinding strip mounting base 12. Under the control of a controller, all the push rods 171 generate the same micro-displacement along the radial direction of the grinding strip assembly fixture and push the grinding strip mounting base 12 and the grinding strip 22 on the grinding strip mounting base to expand outward synchronously along the radial direction of the grinding strip assembly fixture. The micro-displacement unit 17 transmits torque between the basic mandrel 14 and the grinding strip mounting base 12.

According to different positions of the axis 213 of the grinding sleeve, a configuration of the main machine comprise a horizontal configuration and a vertical configuration. When the axis 213 of the grinding sleeve is in a horizontal plane, the configuration of the main machine is a horizontal configuration, as shown in FIG. 1-9. When the axis 213 of the grinding sleeve is vertical to the horizontal plane, the configuration of the main machine is a vertical configuration, as shown in FIG. 1-11.

According to different relative rotation modes of the grinding tool kit, the configuration of the main machine is a grinding strip assembly rotary type or a grinding sleeve rotary type. For the main machine of the grinding strip assembly rotary type, the main machine comprises a grinding strip assembly rotary driving member and a grinding sleeve fixture clamping member. The grinding strip assembly rotary driving member is used for clamping the basic mandrel in the grinding strip assembly fixture and driving the grinding strip assembly to rotate. The grinding sleeve fixture clamping member is used for clamping the grinding sleeve fixture. For the main machine of the grinding sleeve rotary type, the main machine comprises a grinding sleeve rotary driving member and a grinding strip assembly fixture clamping member. The grinding sleeve rotary driving member is used for clamping the grinding sleeve fixture and driving the grinding sleeve 21 to rotate. The grinding strip assembly fixture clamping member is used for clamping the basic mandrel in the grinding strip assembly fixture.

As shown in FIG. 1-9 (FIG. 1-9 is a schematic diagram showing relative motion of a grinding tool kit and an external circulation system of the main machine of the horizontal grinding strip assembly rotary type, wherein the grinding strip in the left part and an extensible supporting piece are hidden to show that the cylindrical roller leaves the grinding machining area from an exit of the first spiral groove 211), the external circulation system comprises a collection unit 41, a sorting unit 42, a feeding unit 43 and a transmission subsystem.

The collection unit 41 is arranged at the exit of the first spiral groove 211 and used for collecting cylindrical rollers leaving the grinding machining area from the exit of each first spiral groove 211.

The sorting unit 42 is used for sorting the cylindrical rollers into a queue required by the feeding unit 43, and the queue is a serial queue of cylindrical rollers one after another between adjacent cylindrical rollers with rolling surfaces facing each other or between adjacent cylindrical rollers with end faces facing each other.

As shown in FIG. 1-9 and FIG. 1-10, for the main machine of the grinding strip assembly rotary type, the feeding unit 43 is arranged at an entrance of the first spiral groove 211, and a frame of the feeding unit 43 maintains a fixed relative position with the grinding sleeve 21. The feeding unit 43 is provided with a feeding channel 431, and the feeding channel 431 intersects the first spiral groove 211 at the entrance. During the rotation of the grinding strip assembly, when any linear groove 221 is opposite to the feeding channel 431, the feeding unit 43 feeds the cylindrical roller into the linear groove 221 through the feeding channel 431. FIG. 1-10 shows an example that the cylindrical roller of the main machine of the horizontal grinding strip assembly rotary type enters the linear groove 221 through the feeding channel 431.

As shown in FIG. 1-11, for the main machine of the grinding sleeve rotary type, the feeding unit 43 is arranged at one end of the grinding sleeve 21 located at the entrance of the first spiral groove 211, and the frame of the feeding unit 43 and the grinding sleeve 21 keep a fixed relative position in a direction of the axis 213 of the grinding sleeve, while the frame of the feeding unit 43 and the linear groove 221 keep a fixed relative position in a circumferential direction of the grinding strip assembly. An area of each linear groove 221 located outside an end surface of the grinding sleeve 21 and close to the end surface is a feeding waiting area 225, and the end surface is located at an entrance end of the first spiral groove 211. During the rotation of the grinding strip assembly, when the entrance of any first spiral groove 211 is opposite to the linear groove 221, the feeding unit 43 feeds the cylindrical roller into the entrance of the first spiral groove 211 through the feeding waiting area 225. FIG. 1-11 shows an example that the cylindrical roller of the main machine of the vertical grinding strip assembly rotary type enters the entrance of the first spiral groove 211 through the feeding waiting area 225 of the linear groove 221.

The transmission subsystem is used for transmitting the cylindrical roller between the units in the external circulation system.

During the grinding machining process, an external circulation moving path of the cylindrical roller in the external circulation system is: from the exit of the first spiral groove 211 to the entrance of the first spiral groove 211 through the collection unit 41, the sorting unit 42 and the feeding unit 43 in turn. A spiral moving path of the cylindrical roller between the grinding strip assembly and the grinding sleeve 21 along the first spiral groove 211 is combined with the external circulation moving path in the external circulation system to form one sealed circle.

As shown in FIG. 1-10, for the main machine of the grinding strip assembly rotary type, the grinding strip assembly fixture further comprises an extensible supporting piece 226. The extensible supporting piece 226 is arranged between two adjacent grinding strips 22, and is connected with the grinding strip 22 or the grinding strip mounting base 12 fixedly connected with the grinding strip 22. A surface of the extensible supporting piece 226 relative to the inner surface of the grinding sleeve 21 is in smooth transition with the front surface of the adjacent grinding strip 22. During the rotation of the grinding strip assembly, the extensible supporting piece 226 is used for supporting the cylindrical roller about to enter the linear groove 221 opposite to the feeding channel 431 at the entrance of the first spiral groove 211. The extensible supporting piece 226 is an extensible structure or a block structure made of a material with low elastic modulus, and the extensible supporting piece 226 extends synchronously along a circumferential direction of the grinding strip assembly fixture when the grinding strip assembly expands outward synchronously along the radial direction of the grinding strip assembly fixture.

Embodiment 2 of apparatus: an apparatus for finish machining of a rolling surface of a cylindrical roller made of a ferromagnetic material (such as GCr15, G20CrNi2MoA, Cr4Mo4V30 and the like).

The main differences between the apparatus and the apparatus according to Embodiment 1 of apparatus are as follows:

The cylindrical magnetic structure is arranged at one of the following two positions so as to form a grinding sleeve magnetic field with magnetic lines distributed on an axial section of the grinding sleeve 21 in the grinding machining area:

1) As shown in FIG. 2-1(*a*), FIG. 2-1(*b*), FIG. 2-2(*a*) and FIG. 2-2(*b*), FIG. 2-1(*b*) is an enlargement of a part A in 2-1(*a*), and FIG. 2-2(*b*) is an enlargement of a part B in 2-2(*a*). The cylindrical magnetic structure 217 is embedded in a solid inside of the grinding sleeve 21, and reference numeral 2171 refers to of the grinding sleeve magnetic field.
2) The grinding sleeve fixture further comprises a magnetic sleeve 219 made of a magnetic conductive material, and the grinding sleeve fixture clamps the grinding sleeve 21 through the magnetic sleeve 219. As shown in FIG. 2-3, the cylindrical magnetic structure 217' is embedded in a middle part of an inner wall of the magnetic sleeve 219, the magnetic sleeve 219 is sleeved on a periphery of the grinding sleeve 21, and the magnetic sleeve 219 is connected with the grinding sleeve 21 at both ends of the cylindrical magnetic structure 217' to conduct the grinding sleeve magnetic field. Reference numeral 2171 refers to magnetic lines of the grinding sleeve magnetic field. Due to the same connection at both ends, only the connection between the magnetic sleeve 219 and the grinding sleeve 21 at one end of the cylindrical magnetic structure 217' is shown in FIG. 2-3.

The grinding sleeve 21 is made of a magnetic conductive material, and the working surface I 21111 of the first spiral groove is embedded with one or multiple spiral belt-shaped non-magnetic conductive materials 218 along the scanning path A so as to increase magnetic resistance of the magnetic lines 2171 of the grinding sleeve magnetic field passing through the solid of the grinding sleeve 21 at the working surface I 21111 of the first spiral groove. In FIG. 2-1(*a*), FIG. 2-1(*b*) and FIG. 2-3, the working surface I 21111 of the first spiral groove is embedded with one spiral belt-shaped non-magnetic conductive material 218.

On one hand, a width t and an embedded depth d of the spiral belt-shaped non-magnetic conductive material 218 and a distance between two adjacent spiral belt-shaped non-magnetic conductive materials need to meet structural strength and rigidity requirements of the working surface I 21111 of the first spiral groove. On the other hand, it is required to ensure that the magnetic lines 2171 of the grinding sleeve magnetic field in the grinding machining area preferentially pass through the cylindrical roller that is in contact with the working surface I 21111 of the first spiral groove during grinding machining.

The cylindrical magnetic structure may be a permanent-magnetic structure or an electromagnetic structure or an electrically-controlled permanent-magnetic structure. The magnetic conductive material is made of a soft magnetic structural material with high magnetic permeability, such as soft iron, low carbon steel, medium carbon steel, soft magnetic alloy, and the like. The spiral belt-shaped non-magnetic conductive material 218 is made of a non-ferromagnetic structural material, such as nonferrous metal, austenitic stainless steel, and the like.

The external circulation system in the apparatus further comprises a demagnetization unit 44, as shown in FIG. 2-1(*a*), FIG. 2-1(*b*), FIG. 2-3, and FIG. 2-5 (FIG. 2-5 is a schematic diagram showing the external circulation system comprising the demagnetization unit of the main machine of the horizontal grinding strip assembly rotary type in the finish machining of the cylindrical roller, wherein the grinding strip in the left part of the figure and an extensible supporting piece are hidden show that the cylindrical roller leaves the grinding machining area from the exit of the first spiral groove 211), and the demagnetization unit 44 is used for demagnetizing the cylindrical roller made of the ferromagnetic material magnetized by the grinding sleeve magnetic field of the cylindrical magnetic structure.

Embodiment 3 of apparatus: an apparatus for finish machining of a rolling surface of a cylindrical roller made of a ferromagnetic material (such as GCr15, G20CrNi2MoA, Cr4Mo4V30 and the like).

The main differences between the apparatus and the apparatus according to Embodiment 2 of apparatus are as follows:

When the cylindrical magnetic structure 217 is embedded in a solid inside of the grinding sleeve 21, as shown in FIG. 2-2(*a*) and FIG. 2-2(*b*), wherein FIG. 2-2(*b*) is an enlargement of a part B in FIG. 2-2(*a*), the working surface I 21111 of the first spiral groove is not embedded with the spiral belt-shaped non-magnetic conductive material along the scanning path A, but one or multiple spiral belt-shaped grinding sleeve magnetic isolation grooves 2181 or multiple annular belt-shaped grinding sleeve magnetic isolation grooves 2181 are arranged along the scanning path A on a solid inner cavity side of the grinding sleeve 21 facing away from the working surface I of the first spiral groove so as to increase magnetic resistance of the magnetic lines 2171 of the grinding sleeve magnetic field passing through the solid of the grinding sleeve 21 at the working surface I 21111 of the first spiral groove.

When the cylindrical magnetic structure 217' is embedded in a middle part of the inner wall of the magnetic sleeve 219, as shown in FIG. 2-4, the working surface I 21111 of the first spiral groove is not embedded with the spiral belt-shaped non-magnetic conductive material along the scanning path A, but one or multiple spiral belt-shaped grinding sleeve magnetic isolation grooves 2181 or multiple annular belt-shaped grinding sleeve magnetic isolation grooves 2181 are arranged along the scanning path A on an outer wall of the grinding sleeve 21 facing away from the working surface I of the first spiral groove so as to increase magnetic resistance of the magnetic lines 2171 of the grinding sleeve magnetic field passing through the solid of the grinding sleeve 21 at the working surface I 21111 of the first spiral groove.

On one hand, a width t' and an embedded depth d' of the grinding sleeve isolation groove 218 and a distance between two adjacent grinding sleeve isolation grooves need to meet structural strength and rigidity requirements of the working surface I 21111 of the first spiral groove. On the other hand, it is required to ensure that the magnetic lines 2171 of the grinding sleeve magnetic field in the grinding machining area preferentially pass through the cylindrical roller that is in contact with the working surface I 21111 of the first spiral groove during grinding machining.

Embodiment 4 of apparatus: an apparatus for finish machining of a rolling surface of a tapered roller.

The apparatus comprises an external circulation system, the main machine according to Embodiment 1 of apparatus, the grinding sleeve fixture according to Embodiment 1 of apparatus, the grinding strip assembly fixture according to Embodiment 1 of apparatus, and the grinding tool kit according to Embodiment 4 of grinding tool kit.

As shown in FIG. 3-9 (FIG. 3-9 is a schematic diagram showing relative motion of a grinding tool kit and an external circulation system of the main machine of the horizontal grinding strip assembly rotary type, wherein the grinding strip in the left part and an extensible supporting piece are hidden to show that the tapered roller leaves the grinding machining area from an exit of the first spiral groove 211), the external circulation system comprises a collection unit 41, a sorting unit 42, a feeding unit 43 and a transmission subsystem.

The collection unit 41 is arranged at an exit of the first spiral groove 211 and used for collecting tapered rollers leaving the grinding machining area from the exit of each first spiral groove 211.

The sorting unit 42 is used for sorting the tapered rollers into a queue required by the feeding unit 43, and adjusting pointing directions of small-head ends of the tapered rollers to be consistent, and the queue is a serial queue of tapered rollers one after another between adjacent tapered rollers with rolling surfaces facing each other or between adjacent tapered rollers with end faces facing each other.

As shown in FIG. 3-9 and FIG. 3-10, for the main machine of the grinding strip assembly rotary type, the feeding unit 43 is arranged at an entrance of the first spiral groove 211, and a frame of the feeding unit 43 maintains a fixed relative position with the grinding sleeve 21. The feeding unit 43 is provided with a feeding channel 431, and the feeding channel 431 intersects the first spiral groove 211 at the entrance. During the rotation of the grinding strip assembly, when any linear groove is opposite to the feeding channel 431, the feeding unit 43 feeds the tapered roller into the linear groove 221 through the feeding channel 431. FIG. 3-10 shows an example that the tapered roller of the main machine of the grinding strip assembly rotary type enters the linear groove 221 through the feeding channel 431.

As shown in FIG. 3-11, for the main machine of the grinding sleeve rotary type, the feeding unit 43 is arranged at one end of the grinding sleeve 21 located at the entrance of the first spiral groove 211, and the frame of the feeding unit 43 and the grinding sleeve 21 keep a fixed relative position in a direction of the axis 213 of the grinding sleeve, while the frame of the feeding unit 43 and the linear groove 221 keep a fixed relative position in a circumferential direction of the grinding strip assembly. An area of each linear groove 221 located outside an end surface of the grinding sleeve 21 and close to the end surface is a feeding waiting area 225, and the end surface is located at an entrance end of the first spiral groove 211. During the rotation of the grinding strip assembly, when the entrance of any first spiral groove 211 is opposite to the linear groove 221, the feeding unit 43 feeds the tapered roller into the entrance of the first spiral groove 211 through the feeding waiting area 225. FIG. 3-11 shows an example that the tapered roller of the main machine of the vertical grinding sleeve rotary type enters the entrance of the first spiral groove 211 through the feeding waiting area 225 of the linear groove 221.

The transmission subsystem is used for transmitting the tapered roller between the units in the external circulation system.

During the grinding machining process, an external circulation moving path of the tapered roller in the external circulation system is: from the exit of the first spiral groove 211 to the entrance of the first spiral groove 211 through the collection unit 41, the sorting unit 42 and the feeding unit 43 in turn. A spiral moving path of the tapered roller between the grinding strip assembly and the grinding sleeve 21 along the first spiral groove 211 is combined with the external circulation moving path in the external circulation system to form one sealed circle.

As shown in FIG. 3-10, for the main machine of the grinding strip assembly rotary type, the grinding strip assembly fixture further comprises an extensible supporting piece 226. The extensible supporting piece 226 is arranged between two adjacent grinding strips 22, and is connected with the grinding strip 22 or the grinding strip mounting base 12 fixedly connected with the grinding strip 22. A surface of the extensible supporting piece 226 relative to the inner surface of the grinding sleeve 21 is in smooth transition with the front surface of the adjacent grinding strip 22. During the rotation of the grinding strip assembly, the extensible supporting piece 226 is used for supporting the tapered roller about to enter the linear groove 221 opposite to the feeding channel 431 at the entrance of the first spiral groove 211. The extensible supporting piece 226 is an extensible structure or a block structure made of a material with low elastic modulus, and the extensible supporting piece 226 extends synchronously along a circumferential direction of the grinding strip assembly fixture when the grinding strip assembly expands outward synchronously along the radial direction of the grinding strip assembly fixture.

Embodiment 5 of apparatus: an apparatus for finish machining of a rolling surface of a tapered roller.

The main differences between the apparatus and the apparatus according to Embodiment 4 of apparatus are as follows: the grinding tool kit according to Embodiment 5 of grinding tool kit is used as the grinding tool kit of the apparatus.

Embodiment 6 of apparatus: an apparatus for finish machining of a rolling surface of a tapered roller made of a ferromagnetic material (such as GCr15, G20CrNi2MoA, Cr4Mo4V30 and the like).

The main differences between the apparatus and the apparatus according to Embodiment 4 of apparatus or according to Embodiment 5 of apparatus are as follows:

The cylindrical magnetic structure is arranged at one of the following two positions so as to form a grinding sleeve magnetic field with magnetic lines distributed on an axial section of the grinding sleeve 21 in the grinding machining area:

1) As shown in FIG. 4-1(*a*) and FIG. 4-1(*b*), FIG. 4-1(*b*) is an enlargement of a part C in FIG. 4-1(*a*). The cylindrical magnetic structure 217 is embedded in the solid inside of the grinding sleeve 21, and reference numeral 2171 refers to magnetic lines of the grinding sleeve magnetic field.
2) The grinding sleeve fixture further comprises a magnetic sleeve 219 made of a magnetic conductive material, and the grinding sleeve fixture clamps the grinding sleeve 21 through the magnetic sleeve 219. As shown in FIG. 4-3, the cylindrical magnetic structure 217' is embedded in a middle part of an inner wall of the magnetic sleeve 219, the magnetic sleeve 219 is sleeved on a periphery of the grinding sleeve 21, and the magnetic sleeve 219 is connected with the grinding sleeve 21 at both ends of the cylindrical magnetic structure 217' to conduct the grinding sleeve magnetic field. Reference numeral 2171 refers to magnetic lines of the grinding sleeve magnetic field. Due to the same connection at both ends, only the connection between the magnetic sleeve 219 and the grinding sleeve 21 at one end of the cylindrical magnetic structure 217' is shown in FIG. 4-3.

The grinding sleeve 21 is made of a magnetic conductive material, and the working surface I 21111 of the first spiral groove is embedded with one or multiple spiral belt-shaped non-magnetic conductive materials 218 along the scanning path A so as to increase magnetic resistance of the magnetic lines 2171 of the grinding sleeve magnetic field passing through the solid of the grinding sleeve 21 at the working surface I 21111 of the first spiral groove. In FIG. 4-1(*a*), FIG. 4-1(*b*) and FIG. 4-3, the working surface I 21111 of the first spiral groove is embedded with one spiral belt-shaped non-magnetic conductive material 218.

On one hand, a width t and an embedded depth d of the spiral belt-shaped non-magnetic conductive material 218 and a distance between two adjacent spiral belt-shaped non-magnetic conductive materials need to meet structural strength and rigidity requirements of the working surface I 21111 of the first spiral groove. On the other hand, it is required to ensure that the magnetic lines 2171 of the grinding sleeve magnetic field in the grinding machining area preferentially pass through the tapered roller that is in contact with the working surface I 21111 of the first spiral groove during grinding machining.

The cylindrical magnetic structure may be a permanent-magnetic structure or an electromagnetic structure or an electrically-controlled permanent-magnetic structure. The magnetic conductive material is made of a soft magnetic structural material with high magnetic permeability, such as soft iron, low carbon steel, medium carbon steel, soft magnetic alloy, and the like. The spiral belt-shaped non-magnetic conductive material 218 is made of a non-ferromagnetic structural material, such as nonferrous metal, austenitic stainless steel, and the like.

The external circulation system in the apparatus further comprises a demagnetization unit 44, as shown in FIG. 4-1(*a*), FIG. 4-1(*b*), FIG. 4-3, and FIG. 4-5 (FIG. 4-5 is a schematic diagram showing the external circulation system comprising the demagnetization unit of the main machine of the horizontal grinding strip assembly rotary type in the finish machining of the tapered roller, wherein the grinding strip in the left part of the figure and an extensible supporting piece are hidden to show that the tapered roller leaves the grinding machining area from the exit of the first spiral groove 211), and the demagnetization unit 44 is used for demagnetizing the tapered roller made of the ferromagnetic material magnetized by the grinding sleeve magnetic field of the cylindrical magnetic structure.

Embodiment 7 of apparatus: an apparatus for finish machining of a rolling surface of a tapered roller made of a ferromagnetic material (such as GCr15, G20CrNi2MoA, Cr4Mo4V30 and the like).

The main differences between the apparatus and the apparatus according to Embodiment 6 of apparatus are as follows:

when the cylindrical magnetic structure 217 is embedded in a solid inside of the grinding sleeve 21, as shown in FIG. 4-2(*a*) and FIG. 4-2(*b*), wherein FIG. 4-2(*b*) is an enlargement of a part D in FIG. 4-2(*a*), the working surface I 21111 of the first spiral groove is not embedded with the spiral belt-shaped non-magnetic conductive material along the scanning path A, but one or multiple spiral belt-shaped grinding sleeve magnetic isolation grooves 2181 or multiple annular belt-shaped grinding sleeve magnetic isolation grooves 2181 are arranged along the scanning path A on a solid inner cavity side of the grinding sleeve 21 facing away from the working surface I of the first spiral groove so as to increase magnetic resistance of the magnetic lines 2171 of the grinding sleeve magnetic field passing through the solid of the grinding sleeve 21 at the working surface I 21111 of the first spiral groove.

When the cylindrical magnetic structure 217' is embedded in a middle part of the inner wall of the magnetic sleeve 219, as shown in FIG. 4-4, the working surface I 21111 of the first spiral groove is not embedded with the spiral belt-shaped non-magnetic conductive material along the scanning path A, but one or multiple spiral belt-shaped grinding sleeve magnetic isolation grooves 2181 or multiple annular belt-shaped grinding sleeve magnetic isolation grooves 2181 are arranged along the scanning path A on an outer wall of the grinding sleeve 21 facing away from the working surface I of the first spiral groove so as to increase magnetic resistance of the magnetic lines 2171 of the grinding sleeve magnetic field passing through the solid of the grinding sleeve 21 at the working surface I 21111 of the first spiral groove.

On one hand, a width t' and an embedded depth d' of the grinding sleeve isolation groove 218 and a distance between two adjacent grinding sleeve isolation grooves need to meet structural strength and rigidity requirements of the working surface I 21111 of the first spiral groove. On the other hand, it is required to ensure that the magnetic lines 2171 of the grinding sleeve magnetic field in the grinding machining area preferentially pass through the cylindrical roller that is in contact with the working surface I 21111 of the first spiral groove during grinding machining.

Embodiment 8 of apparatus: an apparatus for finish machining of a rolling surface of a spherical roller.

The apparatus comprises a grinding sleeve fixture, a main machine, an external circulation system, the grinding strip assembly fixture according to Embodiment 1 of apparatus and the grinding tool kit according to Embodiment 8 of grinding tool kit.

The main differences between the grinding sleeve fixture and the grinding sleeve fixture according to Embodiment 1 of apparatus are as follows:

When the grinding sleeve 21 is of the split structure, as shown in FIG. 5-9(*a*), FIG. 5-9(*b*), FIG. 1-8(*c*), FIG. 5-9(*d*), 5-9(*e*) and FIG. 5-9(*f*), the grinding sleeve fixture comprises one group of grinding sleeve unit strip mounting bases 11 which are distributed in a circumferential columnar array and used for fixedly connecting the grinding sleeve unit strips 210 and a radial contraction mechanism located at the periphery of the grinding sleeve unit strip mounting base 11. The radial contraction mechanism comprises a radial contraction member and a basic shaft sleeve coaxial with the grinding sleeve. The axis 213 of the grinding sleeve is an axis of the grinding sleeve fixture. The basic shaft sleeve is connected to the main machine. The radial contraction member is connected to the grinding sleeve unit strip mounting bases 11 and the basic shaft sleeve respectively, and used for driving all the grinding sleeve unit strip mounting bases 11 and the grinding sleeve unit strips 210 on the grinding sleeve unit strip mounting bases to contract inward synchronously along a radial direction of the grinding sleeve fixture to compensate wear of the working surface 2111 of the first spiral groove and transmit torque between the basic shaft sleeve and the grinding sleeve unit strip mounting bases 11.

The radial contraction mechanism is one of a conical surface radial contraction mechanism, a communicating-type fluid pressure radial contraction mechanism and a micro-displacement unit radial contraction mechanism.

As shown in FIGS. 5-9(*a*) and 5-9(*b*), the basic shaft sleeve of the conical surface radial contraction mechanism comprises a guide sleeve A 131 and a tapered shaft sleeve 132. An outer surface of the guide sleeve A 131 is an outer cylindrical surface, a circumference of the guide sleeve A 131 is provided with guide holes A 1311, and all the guide holes A 1311 are arranged along the radial direction of the grinding sleeve fixture. The tapered shaft sleeve 132 is provided with a coaxial inner cylindrical surface and a plurality of inner conical surfaces 1321, and the inner cylindrical surface of the tapered shaft sleeve 132 is in sliding fit with the outer cylindrical surface of the guide sleeve A 131. A radial expansion member of the conical surface radial expansion mechanism is a guide post A 151, one end of the guide post A 151 is fixedly connected with the grinding sleeve unit strip mounting base 11, an end surface at the other end of the guide post A 151 is tangent to the inner conical surface 1321, and a cylindrical surface of the guide post A 151 is in sliding fit with the guide hole A 1311. When the tapered shaft sleeve 132 moves toward a big end of the inner conical surface 1321 relative to the guide sleeve A 131, the guide post A 151 pushes the grinding sleeve unit strip mounting base 11 and the grinding sleeve unit strip 210 on the grinding sleeve unit strip mounting base to contract inward synchronously along the radial direction of the grinding sleeve 21 under the action of the inner conical surface 1321. The guide post A 151 transmits torque between the guide sleeve A 131 and the grinding sleeve unit strip mounting base 11.

As shown in FIG. 5-9(*c*) and FIG. 5-9(*d*), the basic shaft sleeve of the communicating-type fluid pressure radial expansion mechanism is a shaft sleeve-shaped cylinder 161 with a female cavity 163 and a plurality of cylinder sleeves 164. The cylinder sleeves 164 are arranged along an inner circumference of the shaft sleeve-shaped cylinder 161 and the radial direction of the grinding sleeve fixture. The female cavity 163 is communicated with the cylinder sleeve 164 and filled with hydraulic oil or compressed air. A radial expansion member of the communicating-type fluid pressure radial expansion mechanism is a piston rod 165 arranged in each cylinder sleeve 164, a piston end of the piston rod 165 slides in the cylinder sleeve 164, and the other end of the piston rod 165 is fixedly connected with the grinding sleeve unit strip mounting base 11. When a pressure of the hydraulic oil or the compressed air in the female cavity 163 is increased, the piston rod 165 pushes the grinding sleeve unit strip mounting base 11 and the grinding sleeve unit strip 210 on the grinding sleeve unit strip mounting base to contract inward synchronously along the radial direction of the grinding sleeve 21. The piston rod 165 transmits torque between the shaft sleeve-shaped cylinder 161 and the grinding sleeve unit strip mounting base 11.

As shown in FIG. 5-9(*e*) and FIG. 5-9(*f*), the radial expansion member of the micro-displacement unit radial expansion mechanism is a micro-displacement unit 17. The micro-displacement unit 17 is one of telescopic units that can generate one-dimensional micro-displacement, such as an electrostrictive unit, a magnetostrictive unit, a telescopic motor unit, an ultrasonic motor unit, a pneumatic unit, a hydraulic unit, and the like. The micro-displacement unit 17 is installed on the inner circumference of the basic shaft sleeve 13 and arranged along the radial direction of the grinding sleeve fixture. The micro-displacement unit is provided with a push rod 171, and the push rod 171 is fixedly connected with the grinding sleeve unit strip mounting base 11. Under the control of a controller, all the push rods 171 generate the same micro-displacement along the radial direction of the grinding strip assembly fixture and push the grinding sleeve unit strip mounting base 11 and the grinding sleeve unit strip 210 on the grinding sleeve unit strip mounting base to contract inward synchronously along the radial direction of the grinding sleeve fixture. The micro-displacement unit 17 transmits torque between the basic shaft sleeve 13 and the grinding sleeve unit strip mounting base 11.

The main differences between the main machine and the main machine according to Embodiment 1 of apparatus are as follows:

The main machine further comprises a reciprocating motion system. For the main machine of the grinding strip assembly rotary type, when the grinding strip groove is the linear groove 221, the reciprocating motion system is used for driving the grinding strip assembly rotary driving member and the grinding sleeve fixture clamping member to make relative reciprocating linear motion along the axis 223 of the grinding strip assembly, referring to FIG. 5-10(*b*). When the grinding strip groove is the second spiral groove, the reciprocating motion system is used for driving the grinding strip assembly rotary driving member and the grinding sleeve fixture clamping member to make relative reciprocating linear motion along the axis 223 of the grinding strip assembly or make relative reciprocating spiral motion around the axis 223 of the grinding strip assembly.

For the main machine of the grinding sleeve rotary type, when the grinding strip groove is the linear groove 221, the reciprocating motion system is used for driving the grinding strip assembly fixture clamping member and the grinding sleeve rotary driving member to make relative reciprocating linear motion along the axis 223 of the grinding strip assembly, referring to FIG. 5-12(*b*). When the grinding strip groove is the second spiral groove, the reciprocating motion system is used for driving the grinding strip assembly fixture clamping member and the grinding sleeve rotary driving member to make relative reciprocating linear motion along the axis 223 of the grinding strip assembly or make relative reciprocating spiral motion around the axis 223 of the grinding strip assembly.

In the present invention, when the grinding strip groove is the second spiral groove, it is recommended that the reciprocating motion system is used for driving the grinding strip assembly fixture clamping member and the grinding sleeve rotary driving member to make relative reciprocating spiral motion along the cylindrical helix B 2222.

As shown in FIG. 5-10 (FIG. 5-10 is a schematic diagram showing relative motion of a grinding tool kit and an external circulation system of the main machine of the grinding strip assembly rotary type, wherein the grinding strip in the right part and an extensible supporting piece are hidden to show that the spherical roller leaves the grinding machining area from an exit of the first spiral groove 211, and the grinding strip groove in the figure is the linear groove 221), the external circulation system comprises a collection unit 41, a sorting unit 42, a feeding unit 43 and a transmission subsystem.

The collection unit 41 is arranged at the exit of the first spiral groove 211 and used for collecting spherical rollers leaving the grinding machining area from the exit of each first spiral groove 211.

The sorting unit 42 is used for sorting the spherical rollers into a queue required by the feeding unit 43, and the queue is a serial queue of spherical rollers one after another between adjacent cylindrical rollers with rolling surfaces facing each other or between adjacent spherical rollers with end faces facing each other. When the spherical roller is an asymmetric spherical roller, the sorting unit 42 is further used for adjusting pointing directions of small-head ends of the spherical rollers to be consistent.

As shown in FIG. 5-10 and FIG. 5-11, for the main machine of the grinding strip assembly rotary type, the feeding unit 43 is arranged at an entrance of the first spiral groove 211, and a frame of the feeding unit 43 maintains a fixed relative position with the grinding sleeve 21. The feeding unit 43 is provided with a feeding channel 431, and the feeding channel 431 intersects the first spiral groove 211 at the entrance. During the rotation of the grinding strip assembly, when any grinding strip groove is opposite to the feeding channel 431, the feeding unit 43 feeds the spherical roller into the grinding strip groove through the feeding channel 431. FIG. 5-11 shows an example that the spherical roller of the grinding strip assembly rotary type enters the linear groove 221 through the feeding channel 431.

As shown in FIG. 5-12, for the main machine of the grinding sleeve rotary type, the feeding unit 43 is arranged at one end of the grinding sleeve 21 located at the entrance of the first spiral groove 211, and the frame of the feeding unit 43 and the grinding sleeve 21 keep a fixed relative position in a direction of the axis 213 of the grinding sleeve, while the frame of the feeding unit 43 and the grinding strip groove keep a fixed relative position in a circumferential direction of the grinding strip assembly. An area of each grinding strip groove located outside an end surface of the grinding sleeve 21 and close to the end surface is a feeding waiting area 225, and the end surface is located at an entrance end of the first spiral groove 211. During the rotation of the grinding strip assembly, when the entrance of any first spiral groove 211 is opposite to the grinding strip groove, the feeding unit 43 feeds the spherical roller into the entrance of the first spiral groove 211 through the feeding waiting area 225. FIG. 5-12 shows an example that the spherical roller of the vertical grinding sleeve rotary type enters the entrance of the first spiral groove 211 through the feeding waiting area 225 of the linear groove 221.

The transmission subsystem is used for transmitting the spherical roller between the units in the external circulation system.

During the grinding machining process, an external circulation moving path of the spherical roller in the external circulation system is: from the exit of the first spiral groove 211 to the entrance of the first spiral groove 211 through the collection unit 41, the sorting unit 42 and the feeding unit 43 in turn. A spiral moving path of the spherical roller between the grinding strip assembly and the grinding sleeve 21 along the first spiral groove 211 is combined with the external circulation moving path in the external circulation system to form one sealed circle.

As shown in FIG. 5-11, for the main machine of the grinding strip assembly rotary type, the grinding strip assembly fixture further comprises an extensible supporting piece 226. The extensible supporting piece 226 is arranged between two adjacent grinding strips 22, and is connected with the grinding strip 22 or the grinding strip mounting base 12 fixedly connected with the grinding strip 22. A surface of the extensible supporting piece 226 relative to the inner surface of the grinding sleeve 21 is in smooth transition with the front surface of the adjacent grinding strip 22. During the rotation of the grinding strip assembly, the extensible supporting piece 226 is used for supporting the spherical roller about to enter the grinding strip groove opposite to the feeding channel 431 at the entrance of the first spiral groove 211. The extensible supporting piece 226 is an extensible structure or a block structure made of a material with low elastic modulus, and the extensible supporting piece 226 extends synchronously along a circumferential direction of the grinding strip assembly fixture when the grinding strip assembly expands outward synchronously along the radial direction of the grinding strip assembly fixture. FIG. 5-11 shows an example that the grinding strip groove is the linear groove.

Embodiment 9 of apparatus: an apparatus for finish machining of a rolling surface of a spherical roller.

The main differences between the apparatus and the apparatus according to Embodiment 8 of apparatus are as follows: the grinding tool kit according to Embodiment 9 of grinding tool kit is used as the grinding tool kit of the apparatus.

Embodiment 10 of apparatus: an apparatus for finish machining of a rolling surface of a spherical roller made of a ferromagnetic material (such as GCr15, G20CrNi2MoA, Cr4Mo4V30 and the like).

The main differences between the apparatus and the apparatus according to Embodiment 8 of apparatus or according to Embodiment 9 of apparatus are as follows:

The strip-shaped magnetic structure is arranged at one of the following two positions so as to form a grinding strip magnetic field with magnetic lines distributed on a normal section of the grinding strip groove in the grinding machining area:

1) As shown in FIG. 6-1, the strip-shaped magnetic structure 227 is embedded in the solid inside of the grinding strip 22 along the scanning path B1 or the scanning path B2, and reference numeral 2271 refers to the magnetic lines of the grinding strip magnetic field.
2) The grinding strip mounting base 12 is made of a magnetic conductive material, as shown in FIG. 6-3, and the strip-shaped magnetic structure 227' is embedded in a middle part of a surface layer of the grinding strip mounting base 12 opposite to a back surface of the grinding strip 22 along the scanning path B1 or the scanning path B2, and the grinding strip mounting base 12 is connected with the grinding strip 22 on both sides of the strip-shaped magnetic structure 227' to conduct the grinding strip magnetic field. Reference numeral 2271 refers to the magnetic lines of the grinding strip magnetic field.

The grinding strip 22 is made of a magnetic conductive material. The working surface I of the grinding strip groove is embedded with one or multiple strip-shaped non-magnetic conductive materials 228 along the scanning path B1 or the scanning path B2 so as to increase magnetic resistance of the magnetic lines 2271 of the grinding strip magnetic field passing through the solid of the grinding strip 22 at the working surface I of the grinding strip groove. FIG. 6-1 shows an example that the grinding strip groove is the linear groove. In FIG. 6-1 and FIG. 6-3, the working surface I of the grinding strip groove is embedded with one strip-shaped non-magnetic conductive material 228.

On one hand, a width t and an embedded depth d of the strip-shaped non-magnetic conductive material 228 and a distance between two adjacent strip-shaped non-magnetic conductive materials need to meet structural strength and rigidity requirements of the working surface I of the grinding strip groove. On the other hand, it is required to ensure that the magnetic lines 2271 of the grinding strip magnetic field in the grinding machining area preferentially pass through the spherical roller that is in contact with the working surface I of the grinding strip groove during grinding machining.

The strip-shaped magnetic structure may be a permanent-magnetic structure or an electromagnetic structure or an electrically-controlled permanent-magnetic structure. The magnetic conductive material is made of a soft magnetic structural material with high magnetic permeability, such as soft iron, low carbon steel, medium carbon steel, soft magnetic alloy, and the like. The strip-shaped non-magnetic conductive material 228 is made of a non-ferromagnetic structural material, such as nonferrous metal, austenitic stainless steel, and the like.

The external circulation system in the apparatus further comprises a demagnetization unit 44, as shown in FIG. 6-1, FIG. 6-3, and FIG. 6-5 (FIG. 6-5 is a schematic diagram showing the external circulation system comprising the demagnetization unit of the main machine of the horizontal grinding strip assembly rotary type in the finish machining of the spherical roller, wherein the grinding strip in the right part of the figure and an extensible supporting piece are hidden to show that the spherical roller leaves the grinding machining area from the exit of the first spiral groove 211), and the demagnetization unit 44 is used for demagnetizing the spherical roller made of the ferromagnetic material magnetized by the grinding strip magnetic field of the strip-shaped magnetic structure.

Embodiment 11 of apparatus: an apparatus for finish machining of a rolling surface of a spherical roller made of a ferromagnetic material (such as GCr15, G20CrNi2MoA, Cr4Mo4V30 and the like).

The main differences between the apparatus and the apparatus according to Embodiment 10 of apparatus are as follows:

When the strip-shaped magnetic structure 227 is embedded in the solid inside of the grinding strip 22 along the scanning path B1 or the scanning path B2, as shown in FIG. 6-2, one or more strip-shaped grinding strip magnetic isolation grooves 2281 are arranged along the scanning path B1 or the scanning path B2 on a solid inner cavity side of the grinding strip 22 facing away from the working surface I of the grinding strip groove so as to increase magnetic resistance of the magnetic lines 2271 of the grinding strip magnetic field passing through the solid of the grinding strip 22 at the working surface I of the grinding strip groove. FIG. 6-2 shows an example that the grinding strip groove is the linear groove.

When the strip-shaped magnetic structure 227' is embedded in the middle part of the surface layer of the grinding strip mounting base 12 relative to the back surface of the grinding strip 22 along the scanning path B1 or the scanning path B2, as shown in FIG. 6-4, one or more strip-shaped grinding strip magnetic isolation grooves 2281 are arranged along the scanning path B1 or the scanning path B2 on the back surface of the grinding strip 22 facing away from the working surface I of the grinding strip groove so as to increase magnetic resistance of the magnetic lines 2271 of the grinding strip magnetic field passing through the solid of the grinding strip 22 at the working surface I of the grinding strip groove.

On one hand, a width t' and an embedded depth d' of the grinding strip isolation groove and 2281 and a distance between two adjacent grinding strip isolation grooves need to meet structural strength and rigidity requirements of the working surface I of the grinding strip groove. On the other hand, it is required to ensure that the magnetic lines 2271 of the grinding strip magnetic field in the grinding machining area preferentially pass through the spherical roller that is in contact with the working surface I of the grinding strip groove during grinding machining.

Embodiment 1 of method: a method for finish machining of a rolling surface of a bearing roller.

The bearing roller is one of a cylindrical roller, a tapered roller and a spherical roller.

When the bearing roller is a cylindrical roller, the apparatus according to Embodiment 1 of apparatus is adopted in the method, for batch-circulated finish machining of a rolling surface of the cylindrical roller. When the bearing roller is a tapered roller, the apparatus according to Embodiment 4 of apparatus or according to Embodiment 5 of apparatus is adopted in the method, for batch-circulated finish machining of a rolling surface of the tapered roller. When the bearing roller is a spherical roller, the apparatus according to Embodiment 8 of apparatus or according to Embodiment 9 of apparatus is adopted in the method, for batch-circulated finish machining of a rolling surface of the spherical roller.

A free abrasive grinding mode or fixed abrasive grinding mode is employed.

When the bearing roller is a cylindrical roller or a tapered roller, a material of the working surface 2211 of the linear groove and a material of the working surface 2111 of the first spiral groove are respectively selected, such that a sliding friction driving moment generated by a friction pair consisting of the material of the working surface 2111 of the first spiral groove and the material of the bearing roller on the rotation of the bearing roller around the axis of the bearing roller under grinding working conditions is larger than a sliding friction resisting moment generated by a friction pair consisting of the material of the working surface 2211 of the linear groove and the material of the bearing roller on the rotation of the bearing roller around the axis of the bearing roller, thereby driving the bearing roller to continuously rotate around the axis of the bearing roller. The working surface 2211 of the linear groove is made of a fixed abrasive material when the fixed abrasive grinding is employed. When free abrasive grinding is employed, and PTFE is selected as the material of the working surface 2211 of the linear groove, and polymethylmethacrylate or cast iron is selected as the material of the working surface 2111 of the first spiral groove, the bearing roller made of GCr15, G20CrNi2MoA, Cr4Mo4V and other materials can continuously rotate around the axis of the bearing roller.

When the bearing roller is a spherical roller, a material of the working surface of the grinding strip groove and the material of the working surface 2111 of the first spiral groove are respectively selected, such that a sliding friction driving moment generated by a friction pair consisting of the material of the working surface of the grinding strip groove and the material of the spherical roller on the rotation of the spherical roller around the axis of the spherical roller under grinding working conditions is larger than a sliding friction resisting moment generated by a friction pair consisting of the material of the working surface 2111 of the first spiral groove and the material of the spherical roller on the rotation of the spherical roller around the axis of the spherical roller, thereby driving the spherical roller to continuously rotate around the axis of the spherical roller. The working surface 2111 of the first spiral groove is made of a fixed abrasive material when the fixed abrasive grinding is employed. When free abrasive grinding is employed, and PTFE is selected as the material of the working surface 2111 of the first spiral groove, and polymethylmethacrylate or cast iron is selected as the material of the working surface of the grinding strip groove, the spherical roller made of GCr15, G20CrNi2MoA, Cr4Mo4V and other materials can continuously rotate around the axis of the spherical roller.

As shown in FIG. 1-9, FIG. 1-10, FIG. 1-11, FIG. 3-9, FIG. 3-10, FIG. 3-11, FIG. 5-10, FIG. 5-11 and FIG. 5-12, during grinding machining, for the main machine of the grinding strip assembly rotary type, the grinding strip assembly makes rotational motion relative to the grinding sleeve 21 around the axis 223 of the grinding strip assembly under the drive of the grinding strip assembly rotary driving member. For the main machine of the grinding sleeve rotary type, the grinding sleeve makes rotational motion relative to the grinding strip assembly around the axis 213 of the grinding sleeve under the drive of the grinding sleeve rotary driving member.

Under the drive of the radial expansion mechanism, the grinding strip assembly advances and expands to the inner surface of the grinding sleeve 21 along the radial direction of the grinding strip assembly, and applies a working pressure to the bearing roller distributed in the first spiral groove 211, as shown in FIG. 1-8(*a*), FIG. 1-8(*b*), FIG. 1-8(*c*), FIG. 1-8(*d*), FIG. 1-8(*e*), FIG. 1-8(*f*), FIG. 1-9, FIG. 1-11, FIG. 3-9, FIG. 3-11, FIG. 5-10 and FIG. 5-12.

When the bearing roller is a spherical roller, for the main machine of the grinding strip assembly rotary type, when the grinding strip groove the is the linear groove 221, as shown in FIG. 5-10, the reciprocating motion system drives the grinding strip assembly and the grinding sleeve 21 to make relative reciprocating linear motion along the axis 223 of the grinding strip assembly. When the grinding strip groove is the second spiral groove, the reciprocating motion system drives the grinding strip assembly and the grinding sleeve 21 to make relative reciprocating linear motion along the axis 223 of the grinding strip assembly or make relative reciprocating spiral motion around the axis 223 of the grinding strip assembly so as to drive the bearing roller to rotate around the axis of the bearing roller. For the main machine of the grinding sleeve rotary type, when the grinding strip groove is the linear groove 221, as shown in FIG. 5-12, the reciprocating motion system drives the grinding strip assembly and the grinding sleeve 21 to make relative reciprocating linear motion along the axis 223 of the grinding strip assembly, and when the grinding strip groove is the second spiral groove, the reciprocating motion system drives the grinding strip assembly and the grinding sleeve 21 to make relative reciprocating linear motion along the axis 223 of the grinding strip assembly or make relative reciprocating spiral motion around the axis 223 of the grinding strip assembly so as to drive the bearing roller to rotate around the axis of the bearing roller. In the present invention, when the bearing roller is a spherical roller and the grinding strip groove is the second spiral groove, it is recommended that the reciprocating motion system drives the grinding strip assembly and the grinding sleeve 21 to make relative reciprocating spiral motion along the cylindrical helix B 2222.

As shown in FIG. 1-10, FIG. 3-10 and FIG. 5-11, for the main machine of the grinding strip assembly rotary type, bearing rollers of one queue are arranged in the feeding channel 431 of the feeding unit arranged at the entrance of the first spiral groove 211 from near to far, and the queue is a serial queue of rolling surfaces between adjacent bearing rollers, wherein the bearing roller closest to the grinding strip assembly that is about to enter the grinding strip assembly opposite to the feed channel 431 during the rotation of the grinding strip assembly rests on an extensible supporting piece 226 between two adjacent grinding strips 22. With the rotation of the grinding strip assembly relative to the grinding sleeve 21, when any grinding strip groove of the grinding strip assembly is opposite to the feeding channel 431, the bearing roller resting on the extensible supporting piece 226 enters the grinding strip groove under the action of gravity and/or the pushing of the feeding unit 43. The grinding strip assembly continues to rotate relative to the grinding sleeve 21, and the bearing roller enters the first spiral groove 211 through the entrance of the first spiral groove 211 under the pushing action of the working surface of the grinding strip groove, thus entering the grinding machining area surrounded by the working surface 2111 of the first spiral groove and the working surface of the grinding strip groove. FIG. 1-10, FIG. 3-10 and FIG. 5-11 respectively show examples in which the cylindrical roller, the tapered roller and the spherical roller of the main machine of the horizontal grinding strip assembly rotary type entering the grinding machining area.

As shown in FIG. 1-11, FIG. 3-11 and FIG. 5-12, for the main machine of the grinding sleeve rotary type, under the action of the feeding unit 43, one bearing roller is disposed in the feeding waiting area 225 of any grinding strip groove along the grinding strip groove, and a contact relationship between the bearing roller in the feeding waiting area 225 and the working surface of the grinding strip groove is the same as a contact relationship between the bearing roller and the working surface of the grinding strip groove in the grinding machining area. At an entrance end of the first spiral groove 211, after the first spiral groove 211 is cut off by an end surface of the grinding sleeve 21, the working surface 2111 of the first spiral groove exposed at the end surface is designated as a guide side 215. With the rotation of the grinding sleeve 21 relative to the grinding strip assembly, when the guide side 215 of any first spiral groove 211 is opposite to the feeding waiting area 225 of the grinding strip groove, the bearing roller in the feeding waiting area 225 enters the entrance of the first spiral groove 211 along the working surface of the grinding strip groove and the guide side 215 under the action of gravity and/or the pushing of the feeding unit 43. The grinding sleeve 21 continues to rotate relative to the grinding strip assembly. On one hand, the bearing roller enters the first spiral groove 211 through the entrance under the pushing action of the working surface of the grinding strip groove, thus entering the grinding machining area surrounded by the working surface 2111 of the first spiral groove and the working surface of the grinding strip groove. On the other hand, next bearing roller enters the feeding waiting area 225 under the action of the feeding unit 43, waiting for entering the first spiral groove 211 through the entrance of the first spiral groove 211 when the guide side 215 or the guide side 215 of next first spiral groove 211 is opposite to the grinding strip groove. FIG. 1-11, FIG. 3-11 and FIG. 5-12 respectively show examples in which the cylindrical roller, the tapered roller and the spherical roller of the main machine of the vertical grinding sleeve rotary type entering the grinding machining area.

When the bearing roller is a cylindrical roller, the rolling surface 32 of the cylindrical roller in the grinding machining area is in surface contact with the working surface 2211 of the linear groove and in contact with the working surface I 21111 of the first spiral groove respectively, as shown in FIG. 1-3, FIG. 1-7(*a*) and FIG. 1-7(*b*). Under the friction drive of the working surface 2111 of the first spiral groove, the cylindrical roller makes rotational movement around the axis of the cylindrical roller. Meanwhile, the cylindrical roller moves along the linear groove 221 and the first spiral groove 211 respectively under the pushing action of the working surface 2111 of the first spiral groove and the working surface 2211 of the linear groove. The rolling surface 32 of the cylindrical roller slides relative to the working surface 2111 of the first spiral groove and the working surface 2211 of the linear groove, thus realizing grinding machining of the rolling surface 32 of the cylindrical roller. Meanwhile, the cylindrical roller penetrates through the first spiral groove 211 and leaves the grinding machining area from the exit of the first spiral groove 211.

When the bearing roller is a tapered roller, the rolling surface 32 of the tapered roller in the grinding machining area is in line contact with the two V-shaped side faces of the working surface 2211 of the linear groove and in contact with the working surface I 21111 of the first spiral groove respectively, as shown in FIG. 3-6 and FIG. 3-8. Under the friction drive of the working surface 2111 of the first spiral groove, the tapered roller makes rotational movement around the axis of the tapered roller. Meanwhile, the tapered roller moves along the linear groove 221 and the first spiral groove 211 respectively under the pushing action of the working surface 2111 of the first spiral groove and the working surface 2211 of the linear groove. The rolling surface 32 of the tapered roller slides relative to the working surface 2111 of the first spiral groove and the working surface 2211 of the linear groove, thus realizing grinding machining of the rolling surface 32 of the tapered roller. Meanwhile, the tapered roller penetrates through the first spiral groove 211 and leaves the grinding machining area from the exit of the first spiral groove 211.

When the bearing roller is a spherical roller, the rolling surface 32 of the spherical roller in the grinding machining area is in cross line contact with the working surface 2111 of the first spiral groove and in line contact with the working surface I of the grinding strip groove respectively, as shown in FIG. 5-6 and FIG. 5-8. Under the friction drive of the working surface of the grinding strip groove, the spherical roller makes rotational movement around the axis of the spherical roller. Meanwhile, the spherical roller moves along the grinding strip groove and the first spiral groove 211 respectively under the pushing action of the working surface 2111 of the first spiral groove and the working surface of the grinding strip groove. The rolling surface 32 of the spherical roller slides relative to the working surface 2111 of the first spiral groove and the working surface of the grinding strip groove, thus realizing grinding machining of the rolling surface 32 of the spherical roller. Meanwhile, the spherical roller penetrates through the first spiral groove 211 and leaves the grinding machining area from the exit of the first spiral groove 211.

The method specifically comprises the following steps.

At step 1, the radial expansion mechanism is started, so that the grinding strip assembly moves towards the inner surface of the grinding sleeve 21 along the radial direction of the grinding strip assembly, and a space in the grinding machining area at each intersection of the first spiral groove 211 and the grinding strip groove is capable of accommodating one bearing roller only.

At step 2, the grinding strip assembly rotary driving member or the grinding sleeve rotary driving member is started, so that the grinding strip assembly and the grinding sleeve 21 rotate relatively at an initial speed of 0 rpm to 10 rpm. When the bearing roller is a spherical roller, the reciprocating motion system is started simultaneously.

At step 3, the transmission subsystem, the sorting unit 42 and the feeding unit 43 are started. A feeding speed of the feeding unit 43 is adjusted to match the feeding speed with the relative initial rotation speed of the grinding strip assembly and the grinding sleeve 21. A transmission speed of the transmission subsystem and a sorting speed of the sorting unit 42 are adjusted to match the transmission rate and the sorting speed with the feeding speed of the feeding unit 43. Therefore, a sealed cycle of spiral movement of the bearing roller between the grinding strip assembly and the grinding sleeve 21 along the first spiral groove 211 and the collection, sorting and feeding through the external circulation system is established.

At step 4, the relative rotation speed of the grinding strip assembly and the grinding sleeve 21 is adjusted to a working rotation speed of 5 rpm to 60 rpm, and the feeding speed of the feeding unit is adjusted to a working feeding speed, so that the speeds are matched with working rotation speed of the grinding strip assembly and the grinding sleeve 21, and the transmission speed of the transmission subsystem and the sorting speed of the sorting unit 42 are adjusted, so that storage quantities of the bearing rollers at all positions of the collection unit 41, the sorting unit 42, the feeding unit 43 and the transmission subsystem in the external circulation system are matched and the external circulation is smooth and ordered.

At step 5, a grinding liquid is filled into the grinding machining area.

Step 6, comprises:

1) the radial expansion mechanism is adjusted, so that the grinding strip assembly further advances toward the inner surface of the grinding sleeve 21 along the radial direction of the grinding strip assembly until the rolling surface 32 of the bearing roller in the grinding machining area is in contact with the working surface 2111 of the first spiral groove and the working surface of the grinding strip groove respectively. According to different types of the bearing roller, the rolling surface 32 has different contact relationships with the working surface 2111 of the first spiral groove and the working surface of the grinding strip groove respectively:

When the bearing roller is a cylindrical roller, the rolling surface 32 of the cylindrical roller in the grinding machining area is in line contact with the working surface I 21111 of the first spiral groove and in surface contact with the working surface 2211 of the linear groove respectively.

When the bearing roller is a tapered roller, the rolling surface 32 of the tapered roller in the grinding machining area is in line contact with the working surface I 21111 of the first spiral groove and the two V-shaped side faces of the working surface 2211 of the linear groove respectively.

When the bearing roller is a spherical roller, the rolling surface 32 of the spherical roller in the grinding machining area is in cross line contact with the working surface 2111 of the first spiral groove and in line contact with the working surface I of the grinding strip groove respectively.

2) The radial expansion mechanism is adjusted to apply an average initial pressure of 0.5 N to 2 N to each bearing roller distributed in the grinding machining area.

When the bearing roller is a cylindrical roller or a tapered roller, the bearing roller makes rotational movement around the axis thereof under the friction drive of the working surface 2111 of the first spiral groove, and meanwhile, moves along the linear groove 221 and the first spiral groove 211 respectively under the pushing action of the working surface 2111 of the first spiral groove and the working surface 2211 of the linear groove. The rolling surface 32 slides relative to the working surface 2111 of the first spiral groove and the working surface 2211 of the linear groove, and the rolling surface starts to undergo grinding machining of the working surface 2111 of the first spiral groove and the working surface 2211 of the linear groove.

When the bearing roller is a spherical roller, the spherical roller makes rotational movement around the axis thereof under the friction drive of the working surface of the grinding strip groove, and meanwhile, moves along the linear groove 221 and the first spiral groove 211 respectively under the pushing action of the working surface 2111 of the first spiral groove and the working surface of the grinding strip groove. The rolling surface 32 of the spherical roller slides relative to the working surface 2111 of the first spiral groove and the working surface of the grinding strip groove, and the rolling surface 32 of the spherical roller starts to undergo grinding machining of the working surface 2111 of the first spiral groove and the working surface of the grinding strip groove.

At step 7, the radial expansion mechanism is further adjusted along with the stable operation of the grinding machining to apply an average working pressure of 2 N to 50 N to each bearing roller distributed in the grinding machining area. The bearing roller maintains the contact relationship with the working surface 2111 of the first spiral groove and the working surface of the grinding strip groove, the rotation movement around the axis thereof and the movement relationship along the grinding strip groove and the first spiral groove 211 in step 6, and the rolling surface 32 continuously undergoes the grinding machining of the working surface 2111 of the first spiral groove and the working surface of the grinding strip groove.

At step 8, when the grinding sleeve 21 is of the split structure, the radial contraction mechanism is adjusted to compensate the wear of the working surface 2111 of the first spiral groove in real time. The bearing roller is sampled after a period of grinding machining. When a surface quality, a shape precision and a size consistency of the rolling surface 32 dissatisfy technical requirements, the grinding machining in the step is continued. When the surface quality, the shape precision and the size consistency of the rolling surface 32 satisfy the technical requirements, step 9 is entered.

At step 9, the pressure applied to the bearing roller is gradually reduced and finally reached zero. The operation of the sorting unit 42, the feeding unit 43 and the transmission subsystem are stopped, and the relative rotation speed of the grinding strip assembly and the grinding sleeve 21 is adjusted to zero. The operation of the reciprocating motion system when the reciprocating motion system is already started in step 2 is stopped. Filling the grinding liquid into the grinding machining area is stopped. The grinding strip assembly is returned back to an off-working position along the radial direction of the grinding strip assembly.

Embodiment 2 of method: a method for finish machining of a rolling surface of a bearing roller made of a ferromagnetic material (such as GCr15, G20CrNi2MoA, Cr4Mo4V30 and the like).

The bearing roller is one of a cylindrical roller, a tapered roller and a spherical roller.

The main differences between the method and the method according to Embodiment 1 of method are as follows:

When the bearing roller is a cylindrical roller, the apparatus according to Embodiment 2 of apparatus or Embodiment 3 of apparatus is adopted in the method, for batch-circulated finish machining of a rolling surface of the cylindrical roller made of a ferromagnetic material. When the bearing roller is a tapered roller, the apparatus according to Embodiment 6 of apparatus or Embodiment 7 of apparatus is adopted in the method, for batch-circulated finish machining of a rolling surface of the tapered roller made of a ferromagnetic material. When the bearing roller is a spherical roller, the apparatus according to Embodiment 10 of apparatus or according to Embodiment 11 of apparatus is adopted in the method, for batch-circulated finish machining of a rolling surface of the spherical roller made of a ferromagnetic material.

When the bearing roller is a cylindrical roller or a tapered roller, by adjusting a magnetic field intensity of the grinding sleeve magnetic field with the cylindrical magnetic structure, the working surface 2111 of the first spiral groove generates sufficient magnetic attraction to the bearing roller, so that a sliding friction driving moment generated by the working surface 2111 of the first spiral groove on the rotation of the bearing roller around the axis of the bearing roller is greater than a sliding friction resisting moment generated by the working surface of the grinding strip groove on the rotation of the bearing roller around the axis of the bearing roller, thereby driving the bearing roller to continuously rotate around the axis thereof, as shown in FIG. 2-1(*a*), FIG. 2-1(*b*), FIG. 2-2(*a*), FIG. 2-2(*b*), FIG. 2-3(*a*), FIG. 2-3(*b*), FIG. 2-4, FIG. 2-5, FIG. 4-1(*a*), FIG. 4-1(*b*), FIG. 4-2(*a*), FIG. 4-2(*b*), FIG. 4-3, FIG. 4-4 and FIG. 4-5.

When the bearing roller is a spherical roller, by adjusting a magnetic field intensity of the grinding strip magnetic field with the strip-shaped magnetic structure, the working surface of the grinding strip groove generates strong enough magnetic attraction to the bearing roller, so that the sliding friction driving torque generated by the working surface of the grinding strip groove on the rotation of the bearing roller around the axis of the bearing roller is greater than a sliding friction resisting moment generated by the working surface 2111 of the first spiral groove on the rotation of the bearing roller around the axis of the bearing roller, thereby driving the bearing roller to continuously rotate around the axis thereof, as shown in FIG. 6-1, FIG. 6-2, FIG. 6-3, FIG. 6-4 and FIG. 6-5.

The specific steps of the method are different from the specific steps of the method according to Embodiment 1 of method in that:

At step 3, the transmission subsystem, the sorting unit 42, the feeding unit 43 and the demagnetization unit 44 are started. A feeding speed of the feeding unit 43 is adjusted to match the feeding speed with the relative initial rotation speed of the grinding strip assembly and the grinding sleeve 21. A transmission speed of the transmission subsystem and a sorting speed of the sorting unit 42 are adjusted to match the transmission rate and the sorting speed with the feeding speed of the feeding unit 43. Therefore, a sealed cycle of spiral movement of the bearing roller between the grinding strip assembly and the grinding sleeve 21 along the first spiral groove 211 and the collection, sorting and feeding through the external circulation system is established.

At step 6, wherein:

2) the radial expansion mechanism is adjusted to apply an average initial pressure of 0.5 N to 2 N to each bearing roller distributed in the grinding machining area.

When the bearing roller is a cylindrical roller or a tapered roller, the cylindrical magnetic structure enters a working state, and a magnetic field intensity of the grinding sleeve magnetic field is adjusted, such that a sliding friction driving moment generated by the working surface 2111 of the first spiral groove on the rotation of the bearing roller around the axis of the bearing roller is greater than a sliding friction resisting moment generated by the working surface 2211 of the linear groove on the rotation of the bearing roller around the axis of the bearing roller, thereby driving the bearing roller to continuously rotate around the axis thereof. Meanwhile, the bearing roller moves along the linear groove 221 and the first spiral groove 211 respectively under the pushing action of the working surface 2111 of the first spiral groove and the working surface 2211 of the linear groove. The rolling surface 32 slides relative to the working surface 2111 of the first spiral groove and the working surface 2211 of the linear groove, and the rolling surface starts to undergo grinding machining of the working surface 2111 of the first spiral groove and the working surface 2211 of the linear groove.

When the bearing roller is a spherical roller, the cylindrical magnetic structure enters a working state, and a magnetic field intensity of the grinding sleeve magnetic field of the strip-shaped magnetic structure is adjusted, such that a sliding friction driving moment generated by the working surface of the grinding strip groove on the rotation of the spherical roller around the axis of the spherical roller is greater than a sliding friction resisting moment generated by the working surface 2111 of the first spiral groove on the rotation of the spherical roller around the axis of the spherical roller, thereby driving the spherical roller to continuously rotate around the axis thereof. Meanwhile, the spherical roller moves along the grinding strip groove and the first spiral groove respectively under the pushing action of the working surface 2111 of the first spiral groove and the working surface of the grinding strip groove. The rolling surface 32 of the spherical roller slides relative to the working surface 2111 of the first spiral groove and the working surface of the grinding strip groove, and the rolling surface 32 of the spherical roller starts to undergo grinding machining of the working surface 2111 of the first spiral groove and the working surface of the grinding strip groove.

At step 9, the pressure applied to the bearing roller is reduced and finally reached zero. The operation of the sorting unit 42, the feeding unit 43 and the transmission subsystem are stopped, and the relative rotation speed of the grinding strip assembly and the grinding sleeve 21 is adjusted to zero. The operation of the reciprocating motion system when the reciprocating motion system is already started in step 2 is stopped. The cylindrical magnetic structure or the strip-shaped magnetic structure is switched to an off-working state. The operation of the demagnetization unit 44 is stopped. Filling the grinding liquid into the grinding machining area is stopped. The grinding strip assembly is returned back to an off-working position along the radial direction of the grinding strip assembly.

The invention claimed is:

1. A grinding tool kit for finish machining of a rolling surface of a bearing roller, comprising a grinding sleeve (21) and a grinding strip assembly, wherein: during grinding machining, the grinding sleeve (21) is coaxial with the grinding strip assembly, and the grinding strip assembly penetrates through the grinding sleeve (21); an inner surface of the grinding sleeve (21) is provided with one or a plurality of first spiral grooves (211); the grinding strip assembly comprises at least three grinding strips (22) distributed in a circumferential columnar array, a surface of each grinding strip (22) opposite to the inner surface of the grinding sleeve (21) is a front surface of the grinding strip (22), the front surface of each grinding strip (22) is provided with one grinding strip groove (22) penetrating through the grinding strip (22) along a length direction of the grinding strip (22), and the grinding strip groove is a linear groove (221) or a second spiral groove; and the first spiral groove (211) and the second spiral groove are both cylindrical spiral grooves;

a surface of the first spiral groove (211) comprises a working surface (2111) of the first spiral groove in contact with a bearing roller to be machined during grinding machining, and a surface of the grinding strip groove comprises a working surface of the grinding strip groove in contact with the bearing roller during grinding machining;

during grinding machining, one bearing roller is distributed at each intersection of the first spiral groove (211) and the grinding strip groove; corresponding to each intersection, an area enclosed by the working surface (2111) of the first spiral groove and the working surface of the grinding strip groove is a grinding machining area; the grinding strip assembly and the grinding sleeve (21) rotate relatively around an axis (223) of the grinding strip assembly, and simultaneously, the grinding strip assembly and the grinding sleeve (21) make relative reciprocating linear motion along the axis (223) of the grinding strip assembly or make relative reciprocating spiral motion around the axis (223) of the grinding strip assembly, or make no relative reciprocating motion, and the grinding strip (22) applies a working pressure to the bearing roller distributed in the first spiral groove (211) along a radial direction of the grinding strip assembly; the bearing roller is in contact with the working surface (2111) of the first spiral groove and the working surface of the grinding strip groove respectively in the grinding machining area; the bearing roller rotates around an axis of the bearing roller under a friction drive of the working surface (2111) of the first spiral groove or the working surface of the grinding strip groove, and simultaneously moves along the first spiral groove (211) and the grinding strip groove respectively under a pushing action of the working surface of the grinding strip groove and the working surface (2111) of the first spiral groove, and the rolling surface (32) of the bearing roller slides relative to the working surface (2111) of the first spiral groove and the working surface of the grinding strip groove, so that grinding machining of the rolling surface (32) is realized; and when the grinding strip groove is the linear groove (221), the working surface of the grinding strip groove is a working surface (2211) of the linear groove, and when the grinding strip groove is the second spiral groove, the working surface of the grinding strip groove is a working surface of the second spiral groove;

the working surface (2111) of the first spiral groove is on a scanning surface (2112) of the first spiral groove, the scanning surface (2112) of the first spiral groove is a scanning surface with equal section, and the working surface (2111) of the first spiral groove is continuous or discontinuous; and the bearing roller is taken as a scanning outline A of solid scanning of the scanning surface (2112) of the first spiral groove, a scanning path A of the scanning surface (2112) of the first spiral groove is a cylindrical helix, the scanning path A passing through a geometric reference point on an axis (32) of the bearing roller is denoted as a cylindrical helix A (2121), the cylindrical helix A (2121) is on a first cylindrical surface, and an axis of the cylindrical helix A (2121) is an axis of the grinding sleeve (21);

the working surface of the grinding strip groove is on a scanning surface of the grinding strip groove, the scanning surface of the grinding strip groove is a scanning surface with equal section, and the working surface of the grinding strip groove is continuous or discontinuous; when the grinding strip groove is the linear groove (221), the scanning surface of the grinding strip groove is a scanning surface of the linear groove, the bearing roller is taken as a scanning outline B1 of solid scanning of the scanning surface of the linear groove, a scanning path B1 of the scanning surface of the linear groove is a straight line parallel to an array axis of the grinding strip assembly, the scanning path B1 passing through the geometric reference point is denoted as a straight line B (2221), a distance from the straight line B (2221) to the array axis is an array radius, and the array axis is an axis of the grinding strip assembly; when the grinding strip groove is the second spiral groove, the scanning surface of the grinding strip groove is a scanning surface of the second spiral groove, the bearing roller is taken as a scanning outline B2 of solid scanning of the scanning surface of the second spiral groove, a scanning path B2 of the scanning surface of the second spiral groove is a cylindrical equidistant helix, the scanning path B2 passing through the geometric reference point is denoted as a cylindrical helix B (2222), and the cylindrical helix B is on a second cylindrical surface; an axis of the cylindrical helix B (2222) is the array axis of the grinding strip assembly, a radius of the cylindrical helix B (2222) is an array radius of the grinding strip assembly, and the array axis is the axis of the grinding strip assembly; and a normal section of the linear groove (221) is a plane perpendicular to the straight line B (2221), and a normal section of the second spiral groove is a plane perpendicular to a tangent of the cylindrical helix B (2222) and passing through a point of tangency of the tangent; and during grinding machining, the array radius is equal to a radius of the cylindrical helix A (2121).

2. The grinding tool kit for the finish machining of the rolling surface of the bearing roller according to claim 1, wherein the bearing roller is one of a cylindrical roller, a tapered roller and a spherical roller; and according to different types of the bearing rollers, the geometric reference point, a relative positional relationship between the bearing roller as the scanning outline A of the scanning surface (2112) of the first spiral groove and the grinding sleeve (21), and a relative positional relationship between the bearing roller as the scanning outline B of the scanning surface of the grinding strip groove and the grinding strip assembly are respectively:

1) when the bearing roller is a cylindrical roller, the geometric reference point is a center of mass ($O_1$) of the cylindrical roller; the grinding strip groove is the linear groove (221), and an axis (31) of the cylindrical roller as the scanning outline B1 coincides with the straight line B (2221); solid scanning is carried out on the scanning outline B1 along the scanning path B1, then a groove surface formed by enveloping of the scanning outline B1 on the front surface of the grinding strip (22) is the scanning surface of the linear groove (2212); the scanning path A is a cylindrical equidistant helix or a cylindrical non-equidistant helix; the axis (31) of the cylindrical roller as the scanning outline A is parallel to an axis (213) of the grinding sleeve; and solid scanning is carried out on the scanning outline A along the scanning path A, then a groove surface formed by enveloping of a rolling surface (32) of the cylindrical roller as the scanning outline A and an end surface rounding (34) at one end on the inner surface of the grinding sleeve (21) is the scanning surface (2112) of the first spiral groove;

2) when the bearing roller is a tapered roller, the geometric reference point is a center of mass ($O_2$) of the tapered roller; the grinding strip groove is the linear groove (221), an axis (31) of the tapered roller as the scanning outline B1 is within an axial section of the grinding strip assembly, an included angle between the axis (31) of the tapered roller and the straight line B (2221) is denoted as $\gamma$, a half cone angle of the tapered roller is denoted as $\varphi$, and $\gamma+\varphi<45°$; solid scanning is carried out on the scanning outline B1 along the scanning path B1, then two V-shaped side faces formed by enveloping of a rolling surface (32) of the tapered roller as the scanning outline B1 on the front surface of the grinding strip (22) are the scanning surface (2212) of the linear groove; the scanning path A is a cylindrical equidistant helix; the axis (31) of the tapered roller as the scanning outline A is within an axial section of the grinding sleeve (21), and an included angle between the axis (31) of the tapered roller and the axis (213) of the grinding sleeve is denoted as $\delta$, and $\delta=\gamma$; solid scanning is carried out on the scanning outline A along the scanning path A, then a groove surface formed by enveloping of the rolling surface (32) of the tapered roller as the scanning outline A and a big head-end surface on the inner surface of the grinding sleeve (21) is the scanning surface (2112) of the first spiral groove; and the big head-end surface comprises a spherical base surface (33) of the tapered roller or further comprises an end surface rounding (34) of the big head-end of the tapered roller, or comprises the spherical base surface (33) and the end surface rounding (34) of the big head-end;

3) when the bearing roller is a spherical roller, a cross-sectional truncated circle with a largest diameter of a rolling surface (32) of the spherical roller is denoted as a maximum diameter truncated circle (35), and the geometric reference point is a circle center ($O_3$) of the maximum diameter truncated circle (35);

the first spiral groove (211) is continuous or discontinuous; when the first spiral groove (211) is continuous, the grinding sleeve (21) is of an integrated structure; and when the first spiral groove (211) is discontinuous, the grinding sleeve (21) is of a split structure, and the grinding sleeve (21) with the split structure consists of at least three grinding sleeve unit strips (210) distributed in a circumferential columnar array, and each first spiral groove (211) is intermittently distributed in the inner surface of the grinding sleeve (21) formed by a front surface of each grinding sleeve unit strip (210); and a gap is provided between adjacent grinding sleeve unit strips (210) along a circumferential direction of the grinding sleeve (21) so as to facilitate the synchronous inward contraction of each grinding sleeve unit strip (210) along a radial direction of the grinding sleeve (21) to compensate wear of the working surface (2111) of the first spiral groove in the grinding machining process;

the spherical roller as the scanning outline A is one of a symmetric spherical roller without spherical base surface, a symmetric spherical roller with spherical base surface and an asymmetric spherical roller, the scanning path A is a cylindrical equidistant helix, and a helical rise angle of the cylindrical helix A (2121) is denoted as $\lambda$; an included angle between an axis (31) of the spherical roller and the axis (213) of the grinding sleeve is denoted as $\alpha$, and $\alpha+\lambda=90°$; a vertical line A (214) from the circle center ($O_3$) to the axis (213) of the grinding sleeve is perpendicular to the axis (31) of the spherical roller; a radius of curvature of an axial section profile (320) of the rolling surface (32) of the spherical roller is denoted as $R_c$, the radius of the cylindrical helix A (2121) is denoted as $R_0$, a radius of the maximum diameter truncated circle (35) is denoted as r, and $R_c=R_0(1+\tan^2\lambda)+r$; and solid scanning is carried out on the scanning outline A along the scanning path A, then a groove surface formed by enveloping of the scanning outline A on the inner surface of the grinding sleeve (21) is the scanning surface (2112) of the first spiral groove;

the spherical roller as the scanning outline B1 is the same as the spherical roller as the scanning outline A, when the grinding strip groove is the linear groove (221), an included angle between the axis (31) of the spherical roller and the straight line B (2221) is denoted as $\beta$, and $\beta=\alpha$; a vertical line B (224) from the circle center ($O_3$) to the axis (223) of the grinding strip assembly is perpendicular to the axis (31) of the spherical roller; solid scanning is carried out on the scanning outline B1 along the scanning path B1, then a groove surface formed by enveloping of a rolling surface (32) of the symmetric spherical roller without spherical base surface as the scanning outline B1 or the rolling surface (32) of the symmetric spherical roller without spherical base surface as the scanning outline B1 and the end surface rounding (34) at one end or the rolling surface (32) of the symmetric spherical roller with spherical base surface as the scanning outline B1 and a reference end surface or the rolling surface (32) of the asymmetric spherical roller as the scanning outline B1 and the big head-end surface on the front surface of the grinding strip (22) is the scanning surface of the linear groove; and the reference end surface comprises the spherical base surface (33) of the symmetric spherical roller with spherical base surface or comprises the end surface rounding (34) at the same end as the spherical base surface (33) or comprises the spherical base surface (33) and the end surface rounding (34) at the same end as the spherical base surface (33), and the big head-end surface comprises the spherical base surface (33) of the asymmetric spherical roller or comprises the end surface rounding (34) of the big head-end of the asymmetric spherical roller or comprises the spherical base surface (33) and the end surface rounding (34) of the big head-end; and the spherical roller as the scanning outline B2 is the same as the spherical roller as the scanning outline A, when the grinding strip groove is the second spiral groove, an included angle between the axis (31) of the spherical roller and the axis (223) of the grinding strip assembly is denoted as, and $=\alpha$; the vertical line B (224) from the circle center ($O_3$) to the axis (223) of the grinding strip assembly is perpendicular to the axis (31) of the spherical roller; a rotation direction of the cylindrical helix B (2222) is opposite to that of the cylindrical helix A (2121); and solid scanning is carried out on the scanning outline B2 along the scanning path B2, then a groove surface formed by enveloping of the rolling surface (32) of the symmetric spherical roller without spherical base surface as the scanning outline B2 or the rolling surface (32) of the symmetric spherical roller without spherical base surface as the scanning outline B2 and the end surface rounding (34) at one end or the rolling surface (32) of the symmetric spherical roller with spherical base surface as the scanning outline B2 and the reference end surface or the rolling surface (32) of the asymmetric spherical roller as the scanning outline B2 and the big head-end surface on the front surface of the grinding strip (22) is the scanning surface of the second spiral groove.

3. The grinding tool kit for the finish machining of the rolling surface of the bearing roller according to claim 1, wherein the bearing roller is one of a cylindrical roller, a tapered roller and a spherical roller; and according to different types of the bearing rollers, the geometric reference point, a relative positional relationship between the bearing roller as the scanning outline A of the scanning surface (2112) of the first spiral groove and the grinding sleeve (21), and a relative positional relationship between the bearing roller as the scanning outline B of the scanning surface of the grinding strip groove and the grinding strip assembly are respectively:

1) when the bearing roller is a cylindrical roller, the geometric reference point is a center of mass ($O_1$) of the cylindrical roller; the grinding strip groove is the linear groove (221), and an axis (31) of the cylindrical roller as the scanning outline B1 coincides with the straight line B (2221); solid scanning is carried out on the scanning outline B1 along the scanning path B1, then a groove surface formed by enveloping of the scanning outline B1 on the front surface of the grinding strip (22) is the scanning surface of the linear groove (2212); the scanning path A is a cylindrical equidistant helix or a cylindrical non-equidistant helix; the axis (31) of the cylindrical roller as the scanning outline A is parallel to an axis (213) of the grinding sleeve; and solid scanning is carried out on the scanning outline A along the scanning path A, then a groove surface formed by enveloping of a rolling surface (32) of the cylindrical roller as the scanning outline A and an end surface rounding (34) at one end is the scanning surface (2112) of the first spiral groove;

2) when the bearing roller is a tapered roller, the geometric reference point is a center of mass ($O_2$) of the tapered roller; the grinding strip groove is the linear groove (221), an axis (31) of the tapered roller as the scanning outline B1 is within an axial section of the grinding strip assembly, an included angle between the axis (31) of the tapered roller and the straight line B (2221) is denoted as $\gamma$, a half cone angle of the tapered roller is denoted as $\varphi$, and $\gamma+\varphi<45°$; solid scanning is carried out on the scanning outline B1 along the scanning path B1, then two V-shaped side faces formed by enveloping of a rolling surface (32) of the tapered roller as the scanning outline B1 on the front surface of the grinding strip (22) are the scanning surface (2212) of the linear groove; the scanning path A is a cylindrical equidistant helix; the axis (31) of the tapered roller as the scanning outline A is within an axial section of the grinding sleeve (21), an included angle between the axis (31) of the tapered roller and the axis (213) of the grinding sleeve is denoted as $\delta$, and $\delta=\gamma$; solid scanning is carried out on the scanning outline A along the scanning path A, then a groove surface formed by enveloping of the rolling surface (32) of the tapered roller as the scanning outline A and a big head-end surface on the inner surface of the grinding sleeve (21) is the scanning surface (2112) of the first spiral groove; and the big head-end surface comprises a spherical base surface (33) of the tapered roller or further comprises an end surface rounding (34) of the big head-end; and 3) when the bearing roller is a spherical roller, a cross-sectional truncated circle with a largest diameter of a rolling surface (32) of the spherical roller is denoted as a maximum diameter truncated circle (35), and the geometric reference point is a circle center ($O_3$) of the maximum diameter truncated circle (35);

the first spiral groove (211) is continuous or discontinuous; when the first spiral groove (211) is continuous, the grinding sleeve (21) is of an integrated structure; and when the first spiral groove (211) is discontinuous, the grinding sleeve (21) is of a split structure, the grinding sleeve (21) with the split structure consists of at least three grinding sleeve unit strips (210) distributed in a circumferential columnar array, and each first spiral groove (211) is intermittently distributed in the inner surface of the grinding sleeve (21) formed by a front surface of each grinding sleeve unit strip (210); and a gap is provided between adjacent grinding sleeve unit strips (210) along a circumferential direction of the grinding sleeve (21) so as to facilitate the synchronous inward contraction of each grinding sleeve unit strip (210) along a radial direction of the grinding sleeve (21) to compensate wear of the working surface (2111) of the first spiral groove in the grinding machining process;

the spherical roller as the scanning outline A is one of a symmetric spherical roller without spherical base surface, a symmetric spherical roller with spherical base surface and an asymmetric spherical roller, the scanning path A is a cylindrical equidistant helix, and a helical rise angle of the cylindrical helix A (2121) is denoted as $\lambda$; an included angle between an axis (31) of the spherical roller and the axis (213) of the grinding sleeve is denoted as $\alpha$, and $\alpha+\lambda=90°$; a vertical line A (214) from the circle center ($O_3$) to the axis (213) of the grinding sleeve is perpendicular to the axis (31) of the spherical roller; a radius of curvature of an axial section profile (320) of the rolling surface (32) of the spherical roller is denoted as $R_c$, the radius of the cylindrical helix A (2121) is denoted as $R_0$, a radius of the maximum diameter truncated circle (35) is denoted as r, and $R_c=R_0(1+\tan^2\lambda)+r$; and solid scanning is carried out on the scanning outline A along the scanning path A, then a groove surface formed by enveloping of the scanning outline A on the inner surface of the grinding sleeve (21) is the scanning surface (2112) of the first spiral groove;

the spherical roller as the scanning outline B1 is the same as the spherical roller as the scanning outline A, when the grinding strip groove is the linear groove (221), an included angle between the axis (31) of the spherical roller and the straight line B (2221) is denoted as $\beta$, and $\beta=\alpha$; a vertical line B (224) from the circle center ($O_3$) to the axis (223) of the grinding strip assembly is perpendicular to the axis (31) of the spherical roller; solid scanning is carried out on the scanning outline B1 along the scanning path B1, then a groove surface formed by enveloping of a rolling surface (32) of the symmetric spherical roller without spherical base surface as the scanning outline B1 or the rolling surface (32) of the symmetric spherical roller without spherical base surface as the scanning outline B1 and the end surface rounding (34) at one end or the rolling surface (32) of the symmetric spherical roller with spherical base surface as the scanning outline B1 and a reference end surface or the rolling surface (32) of the asymmetric spherical roller as the scanning outline B1 and the big head-end surface on the front surface of the grinding strip (22) is the scanning surface of the linear groove; and the reference end surface comprises the spherical base surface (33) of the symmetric spherical roller with spherical base surface or further comprises the end surface rounding (34) at the same end as the spherical base surface (33), and the big head-end surface comprises the spherical base surface (33) of the asymmetric spherical roller or further comprises the end surface rounding (34) of the big head-end; and the spherical roller as the scanning outline B2 is the same as the spherical roller as the scanning outline A, when the grinding strip groove is the second spiral groove, an included angle between the axis (31) of the spherical roller and the axis (223) of the grinding strip assembly is denoted as, and $=\alpha$; the vertical line B (224) from the circle center ($O_3$) to the axis (223) of the grinding strip assembly is perpendicular to the axis (31) of the spherical roller; a rotation direction of the cylindrical helix B (2222) is opposite to that of the cylindrical helix A (2121); and solid scanning is carried out on the scanning outline B2 along the scanning path B2, then a groove surface formed by enveloping of the rolling surface (32) of the symmetric spherical roller without spherical base surface as the scanning outline B2 or the rolling surface (32) of the symmetric spherical roller without spherical base surface as the scanning outline B2 and the end surface rounding (34) at one end or the rolling surface (32) of the symmetric spherical roller with spherical base surface as the scanning outline B2 and the reference end surface or the rolling surface (32) of the asymmetric spherical roller as the scanning outline B2 and the big head-end surface on the front surface of the grinding strip (22) is the scanning surface of the second spiral groove.

4. The grinding tool kit for the finish machining of the rolling surface of the bearing roller according to claim 3, wherein:

the grinding tool kit is used for the finish machining of the rolling surface of the bearing roller made of a ferromagnetic material; and according to the different types of the bearing rollers, a cylindrical magnetic structure (217) or a strip-shaped magnetic structure (227) is provided, specifically:

1) when the bearing roller is a cylindrical roller or a tapered roller, the surface of the first spiral groove (211) in contact with the rolling surface (32) during grinding machining is denoted as a working surface I (21111) of the first spiral groove, the grinding sleeve (21) is made of a magnetic conductive material, and the cylindrical magnetic structure (217) is embedded in a solid inside of the grinding sleeve (21) so as to form a grinding sleeve magnetic field with magnetic lines distributed on the axial section of the grinding sleeve (21) in the grinding machining area; and the working surface I (21111) of the first spiral groove is embedded with one or multiple spiral belt-shaped non-magnetic conductive materials (218) along the scanning path A, or one or multiple spiral belt-shaped grinding sleeve magnetic isolation grooves (2181) or multiple annular belt-shaped grinding sleeve magnetic isolation grooves (2181) are arranged along the scanning path A on a solid inner cavity side of the grinding sleeve (21) facing away from the working surface I of the first spiral groove so as to increase magnetic resistance of the magnetic lines (2171) of the grinding sleeve magnetic field passing through the solid of the grinding sleeve (21) at the working surface I (21111) of the first spiral groove; and 2) when the bearing roller is a spherical roller, the surface of the grinding strip groove in contact with the rolling surface (32) during grinding machining is denoted as a working surface I of the grinding strip groove, the grinding strip (22) is made of a magnetic conductive material, and the strip-shaped magnetic structure (227) is embedded in the solid inside of the grinding strip (22) along the scanning path B1 or the scanning path B2 so as to form a grinding sleeve magnetic field with magnetic lines distributed on a normal section of the grinding strip groove in the grinding machining area; and the working surface I of the grinding strip groove is embedded with one or multiple strip-shaped non-magnetic conductive materials (228) along the scanning path B1 or the scanning path B2, or one or multiple strip-shaped grinding strip magnetic isolation grooves (2281) are arranged along the scanning path B1 or the scanning path B2 on a solid inner cavity side of the grinding strip (22) facing away from the working surface I of the grinding strip groove so as to increase magnetic resistance of the magnetic lines (2271) of the grinding strip magnetic field passing through the solid of the grinding strip (22) at the working surface I of the grinding strip groove.

5. An apparatus for finish machining of a rolling surface of a bearing roller, comprising a main machine, an external circulation system, a grinding sleeve fixture, a grinding strip assembly fixture and the grinding tool kit for the finish machining of the rolling surface of the bearing roller according to claim 3, wherein:

the grinding sleeve fixture is used for clamping the grinding sleeve (21); when the grinding sleeve (21) is of the split structure, the grinding sleeve fixture comprises one group of grinding sleeve unit strip mounting bases (11) which are distributed in a circumferential columnar array and used for fixedly connecting the grinding sleeve unit strips (210) and a radial contraction mechanism located at the periphery of the grinding sleeve unit strip mounting base (11); the radial contraction mechanism comprises a radial contraction member and a basic shaft sleeve coaxial with the grinding sleeve; the axis (213) of the grinding sleeve is an axis of the grinding sleeve fixture; the basic shaft sleeve is connected to the main machine; and the radial contraction member is connected to the grinding sleeve unit strip mounting bases (11) and the basic shaft sleeve respectively, and used for driving all the grinding sleeve unit strip mounting bases (11) and the grinding sleeve unit strips (210) on the grinding sleeve unit strip mounting bases to contract inward synchronously along a radial direction of the grinding sleeve fixture to compensate wear of the working surface (2111) of the first spiral groove and transmit torque between the basic shaft sleeve and the grinding sleeve unit strip mounting bases (11);

the grinding strip assembly fixture is used for clamping the grinding strip assembly; the grinding strip assembly fixture comprises one group of grinding strip mounting bases (12) which are distributed in a circumferential columnar array and used for fixedly connecting the grinding strip (22) and a radial expansion mechanism located in a center of the grinding strip assembly fixture; a back surface of the grinding strip (22) is fixedly connected to a surface of the grinding strip mounting base (12) located at a periphery of the grinding strip assembly fixture; the radial expansion mechanism comprises a radial expansion member and a basic mandrel coaxial with the grinding strip assembly; the axis (223) of the grinding strip assembly is an axis of the grinding strip assembly fixture; the radial expansion member is connected to the grinding strip mounting bases (12) and the basic mandrel respectively, used for driving all the grinding strip mounting bases (12) and the grinding strips (22) on the grinding strip mounting bases to expand and load outward synchronously along a radial direction of the grinding strip assembly fixture and transmit torque between the basic mandrel and the grinding strip mounting bases (12);

according to different relative rotation modes of the grinding tool kit, a configuration of the main machine is a grinding strip assembly rotary type or a grinding sleeve rotary type; for the main machine of the grinding strip assembly rotary type, the main machine comprises a grinding strip assembly rotary driving member and a grinding sleeve fixture clamping member; the grinding strip assembly rotary driving member is used for clamping the basic mandrel in the grinding strip assembly fixture and driving the grinding strip assembly to rotate; the grinding sleeve fixture clamping member is used for clamping the grinding sleeve fixture; for the main machine of the grinding sleeve rotary type, the main machine comprises a grinding sleeve rotary driving member and a grinding strip assembly fixture clamping member; the grinding sleeve rotary driving member is used for clamping the grinding sleeve fixture and driving the grinding sleeve (21) to rotate; and the grinding strip assembly fixture clamping member is used for clamping the basic mandrel in the grinding strip assembly fixture;

when the bearing roller is a spherical roller, the main machine further comprises a reciprocating motion system; for the main machine of the grinding strip assembly rotary type, when the grinding strip groove is the linear groove (221), the reciprocating motion system is used for driving the grinding strip assembly rotary driving member and the grinding sleeve fixture clamping member to make relative reciprocating linear motion along the axis (223) of the grinding strip assembly, and when the grinding strip groove is the second spiral groove, the reciprocating motion system is used for driving the grinding strip assembly rotary driving member and the grinding sleeve fixture clamping member to make relative reciprocating linear motion along the axis (223) of the grinding strip assembly or make relative reciprocating spiral motion around the axis (223) of the grinding strip assembly; and for the main machine of the grinding sleeve rotary type, when the grinding strip groove is the linear groove (221), the reciprocating motion system is used for driving the grinding strip assembly fixture clamping member and the grinding sleeve rotary driving member to make relative reciprocating linear motion along the axis (223) of the grinding strip assembly, and when the grinding strip groove is the second spiral groove, the reciprocating motion system is used for driving the grinding strip assembly fixture clamping member and the grinding sleeve rotary driving member to make relative reciprocating linear motion along the axis (223) of the grinding strip assembly or make relative reciprocating spiral motion around the axis (223) of the grinding strip assembly;

the external circulation system comprises a collection unit (41), a sorting unit (42), a feeding unit (43) and a transmission subsystem;

the collection unit (41) is arranged at an exit of the first spiral groove (211) and used for collecting bearing rollers leaving the grinding machining area from the exit of each first spiral groove (211);

according to the different types of the bearing rollers, functions of the sorting unit (42) are respectively:

1) when the bearing roller is a cylindrical roller or a symmetric spherical roller without spherical base surface or a symmetric spherical roller with spherical base surface, the sorting unit (42) is used for sorting the bearing rollers into a queue required by the feeding unit (43); and 2) when the bearing roller is a tapered roller or an asymmetric spherical roller, the sorting unit (42) is used for sorting the bearing rollers into a queue required by the feeding unit (43), and adjusting pointing directions of small-head ends of the bearing rollers to be consistent;

according to the different configurations of the main machine, a setting position and a working mode of the feeding unit (43) in the apparatus are as follows:

1) for the main machine of the grinding strip assembly rotary type, the feeding unit (43) is arranged at an entrance of the first spiral groove (211), and a frame of the feeding unit (43) maintains a fixed relative position with the grinding sleeve (21); the feeding unit (43) is provided with a feeding channel (431), and the feeding channel (431) intersects the first spiral groove (211) at the entrance; and the feeding unit (43) is used for feeding the bearing roller into the grinding strip groove through the feeding channel (431); and 2) for the main machine of the grinding sleeve rotary type, the feeding unit (43) is arranged at one end of the grinding sleeve (21) located at the entrance of the first spiral groove (211), and the frame of the feeding unit (43) and the grinding sleeve (21) keep a fixed relative position in a direction of the axis (213) of the grinding sleeve, while the frame of the feeding unit (43) and the grinding strip groove keep a fixed relative position in a circumferential direction of the grinding strip assembly; an area of each grinding strip groove located outside an end surface of the grinding sleeve (21) and close to the end surface is a feeding waiting area (225), and the end surface is located at an entrance end of the first spiral groove (211); and the feeding unit (43) is used for feeding the bearing roller into the entrance of the first spiral groove (211) through the feeding waiting area (225);

the transmission subsystem is used for transmitting the bearing roller between the units in the external circulation system;

during the grinding machining process, an external circulation moving path of the bearing roller in the external circulation system is: from the exit of the first spiral groove (211) to the entrance of the first spiral groove (211) through the collection unit (41), the sorting unit (42) and the feeding unit (43) in turn; and a spiral moving path of the bearing roller between the grinding strip assembly and the grinding sleeve (21) along the first spiral groove (211) is combined with the external circulation moving path in the external circulation system to form one sealed circle; and the bearing roller is combined with the external circulation movement path in the external circulation system along the spiral movement path of the first spiral groove (211) between the grinding bar assembly and the grinding sleeve (21) to form a closed cycle; and the radial contraction mechanism is one of a conical surface radial contraction mechanism, a communicating-type fluid pressure radial contraction mechanism and a micro-displacement unit radial contraction mechanism; and the radial expansion mechanism is one of a conical surface radial expansion mechanism, a communicating-type fluid pressure radial expansion mechanism and a micro-displacement unit radial expansion mechanism.

6. The apparatus for the finish machining of the rolling surface of the bearing roller according to claim 5, wherein:

the apparatus is used for the finish machining of the rolling surface of the bearing roller made of a ferromagnetic material; and according to the different types of the bearing rollers, a cylindrical magnetic structure or a strip-shaped magnetic structure is provided, specifically:

1) when the bearing roller is a cylindrical roller or a tapered roller, the surface of the first spiral groove (211) in contact with the rolling surface (32) during grinding machining is denoted as a working surface I (21111) of the first spiral groove, and the grinding sleeve (21) is made of a magnetic conductive material; and the cylindrical magnetic structure is arranged at one of the following two positions so as to form a grinding sleeve magnetic field with magnetic lines distributed on the axial section of the grinding sleeve (21) in the grinding machining area:

a) the cylindrical magnetic structure is embedded in the solid inside of the grinding sleeve (21); the working surface I (21111) of the first spiral groove is embedded with one or multiple spiral belt-shaped non-magnetic conductive materials (218) along the scanning path A, or one or multiple spiral belt-shaped grinding sleeve magnetic isolation grooves (2181) or multiple annular belt-shaped grinding sleeve magnetic isolation grooves (2181) are arranged along the scanning path A on a solid inner cavity side of the grinding sleeve (21) facing away from the working surface I of the first spiral groove so as to increase magnetic resistance of the magnetic lines (2171) of the grinding sleeve magnetic field passing through the solid of the grinding sleeve (21) at the working surface I (21111) of the first spiral groove; and b) the grinding sleeve fixture further comprises a magnetic sleeve (219) made of a magnetic conductive material, and the grinding sleeve fixture clamps the grinding sleeve (21) through the magnetic sleeve (219); the cylindrical magnetic structure is embedded in a middle part of an inner wall of the magnetic sleeve (219), the magnetic sleeve (219) is sleeved on a periphery of the grinding sleeve (21), and the magnetic sleeve (219) is connected with the grinding sleeve (21) at both ends of the cylindrical magnetic structure to conduct the grinding sleeve magnetic field; and the working surface I (21111) of the first spiral groove is embedded with one or multiple spiral belt-shaped non-magnetic conductive materials (218) along the scanning path A, or one or multiple spiral belt-shaped grinding sleeve magnetic isolation grooves (2181) or multiple annular belt-shaped grinding sleeve magnetic isolation grooves (2181) are arranged along the scanning path A on an outer wall of the grinding sleeve (21) facing away from the working surface I of the first spiral groove so as to increase magnetic resistance of the magnetic lines (2171) of the grinding sleeve magnetic field passing through the solid of the grinding sleeve (21) at the working surface I (21111) of the first spiral groove; and 2) when the bearing roller is a spherical roller, the surface of the grinding strip groove in contact with the rolling surface (32) during grinding machining is denoted as the working surface I of the grinding strip groove, and the grinding strip (22) is made of a magnetic conductive material; and the strip-shaped magnetic structure is arranged at one of the following two positions so as to form a grinding strip magnetic field with magnetic lines distributed on a normal section of the grinding strip groove in the grinding machining area:

a) the strip-shaped magnetic structure is embedded in the solid inside of the grinding strip (22) along the scanning path B1 or the scanning path B2; and the working surface I of the grinding strip groove is embedded with one or multiple strip-shaped non-magnetic conductive materials (228) along the scanning path B1 or the scanning path B2, or one or multiple strip-shaped grinding strip magnetic isolation grooves (2281) are arranged along the scanning path B1 or the scanning path B2 on a solid inner cavity side of the grinding strip (22) facing away from the working surface I of the grinding strip groove so as to increase magnetic resistance of the magnetic lines (2271) of the grinding strip magnetic field passing through the solid of the grinding strip (22) at the working surface I of the grinding strip groove; and b) the grinding strip mounting base (12) is made of a magnetic conductive material, the strip-shaped magnetic structure is embedded in a middle part of the grinding strip mounting base (12) relative to a surface layer on the back surface of the grinding strip (22) along the scanning path B1 or the scanning path B2, and the grinding strip mounting base (12) and the grinding strip (22) are connected at both sides of the strip-shaped magnetic structure to conduct the grinding strip magnetic field; and the working surface I of the grinding strip groove is embedded with one or multiple strip-shaped non-magnetic conductive materials (228) along the scanning path B1 or the scanning path B2, or one or multiple strip-shaped grinding strip magnetic isolation grooves (2281) are arranged along the scanning path B1 or the scanning path B2 on the back surface of the grinding strip (22) facing away from the working surface I of the grinding strip groove so as to increase magnetic resistance of the magnetic lines (2271) of the grinding strip magnetic field passing through the solid of the grinding strip (22) at the working surface I of the grinding strip groove; and the external circulation system further comprises a demagnetization unit (44), and the demagnetization unit is used for demagnetizing the bearing roller made of the ferromagnetic material magnetized by the grinding sleeve magnetic field of the cylindrical magnetic structure or the bearing roller made of the ferromagnetic material magnetized by the grinding strip magnetic field of the strip-shaped magnetic structure.

7. A method for finish machining of a rolling surface of a bearing roller, employing the apparatus for the finish machining of the rolling surface of the bearing roller according to claim 6 to realize batch-circulated finish machining of the rolling surface of the bearing roller made of the ferromagnetic material, comprising the following steps of:

step 1: starting the radial expansion mechanism, so that the grinding strip assembly moves towards the inner surface of the grinding sleeve (21) along the radial direction of the grinding strip assembly, and a space in the grinding machining area at each intersection of the first spiral groove (211) and the grinding strip groove is capable of accommodating one bearing roller only;

step 2: starting the grinding strip assembly rotary driving member or the grinding sleeve rotary driving member, so that the grinding strip assembly and the grinding sleeve (21) rotate relatively at an initial speed of 0 rpm to 10 rpm; and when the bearing roller is a spherical roller, starting the reciprocating motion system simultaneously;

step 3: starting the transmission subsystem, the sorting unit (42), the feeding unit (43) and the demagnetization unit (44); and adjusting operating speeds of the feeding unit (43), the transmission subsystem and the sorting unit (42), thus establishing a closed cycle of a spiral movement of the bearing roller along the first spiral groove (211) between the grinding strip assembly and the grinding sleeve (21) and the collection, sorting and feeding through the external circulation system;

step 4: adjusting the relative rotation speed of the grinding strip assembly and the grinding sleeve (21) to a working rotation speed of 5 rpm to 60 rpm, and further adjusting the operating speeds of the feeding unit (43), the transmission subsystem and the sorting unit (42), so that storage quantities of the bearing rollers at all positions of the collection unit (41), the sorting unit (42), the feeding unit (43) and the transmission subsystem in the external circulation system are matched and the external circulation is smooth and ordered;

step 5: filling a grinding liquid into the grinding machining area;

step 6, comprising:

1) adjusting the radial expansion mechanism, so that the grinding strip assembly further advances toward the inner surface of the grinding sleeve (21) along the radial direction of the grinding strip assembly until the bearing roller in the grinding machining area contacts with the working surface (2111) of the first spiral groove and the working surface of the grinding strip groove respectively;

2) further adjusting the radial expansion mechanism to apply an average initial pressure of 0.5 N to 2 N to each bearing roller distributed in the grinding machining area; the cylindrical magnetic structure or the strip-shaped magnetic structure entering a working state, and a magnetic field intensity of the grinding sleeve magnetic field or the grinding strip magnetic field being adjusted, so that the bearing roller is driven to rotate around the axis thereof, meanwhile, the bearing roller moving along the grinding strip groove and the first spiral groove (211) respectively under the pushing action of the working surface (2111) of the first spiral groove and the working surface of the grinding strip groove; and the rolling surface (32) sliding relative to the working surface (2111) of the first spiral groove and the working surface of the grinding strip groove, and the rolling surface (32) starting to undergo grinding machining of the working surface (2111) of the first spiral groove and the working surface of the grinding strip groove;

step 7: further adjusting the radial expansion mechanism along with the stable operation of the grinding machining to apply an average working pressure of 2 N to 50 N to each bearing roller distributed in the grinding machining area; the bearing roller maintaining the contact relationship with the working surface (2111) of the first spiral groove and the working surface of the grinding strip groove, the rotation movement around the axis thereof and the movement relationship along the grinding strip groove and the first spiral groove (211) in step 6, and the rolling surface (32) continuously undergoing the grinding machining of the working surface (2111) of the first spiral groove and the working surface of the grinding strip groove;

step 8: when the grinding sleeve (21) is of the split structure, adjusting the radial contraction mechanism to compensate the wear of the working surface (2111) of the first spiral groove in real time; sampling the bearing roller after a period of grinding machining; when a surface quality, a shape precision and a size consistency of the rolling surface (32) dissatisfy technical requirements, continuing the grinding machining in the step; and when the surface quality, the shape precision and the size consistency of the rolling surface (32) satisfy the technical requirements, entering step 9; and step 9: reducing the pressure applied to the bearing roller and finally making the pressure reach zero; stopping the operation of the sorting unit (42), the feeding unit (43) and the transmission subsystem, and adjusting the relative rotation speed of the grinding strip assembly and the grinding sleeve (21) to zero; stopping the operation of the reciprocating motion system when the reciprocating motion system is already started in step 2; switching the cylindrical magnetic structure or the strip-shaped magnetic structure to an off-working state, and stopping the operation of the demagnetization unit (44); stopping filling the grinding liquid into the grinding machining area; and returning the grinding strip assembly back to an off-working position along the radial direction of the grinding strip assembly.

8. A method for finish machining of a rolling surface of a bearing roller, employing the apparatus for the finish machining of the rolling surface of the bearing roller according to claim 5 to realize batch-circulated finish machining of the rolling surface of the bearing roller, comprising the following steps of:

step 1: starting the radial expansion mechanism, so that the grinding strip assembly moves towards the inner surface of the grinding sleeve (21) along the radial direction of the grinding strip assembly, and a space in the grinding machining area at each intersection of the first spiral groove (211) and the grinding strip groove is capable of accommodating one bearing roller only;

step 2: starting the grinding strip assembly rotary driving member or the grinding sleeve rotary driving member, so that the grinding strip assembly and the grinding sleeve (21) rotate relatively at an initial speed of 0 rpm to 10 rpm; and when the bearing roller is a spherical roller, starting the reciprocating motion system simultaneously;

step 3: starting the transmission subsystem, the sorting unit (42) and the feeding unit (43); and adjusting operating speeds of the feeding unit (43), the transmission subsystem and the sorting unit (42), thus establishing a closed cycle of a spiral movement of the bearing roller along the first spiral groove (211) between the grinding strip assembly and the grinding sleeve (21) and the collection, sorting and feeding through the external circulation system;

step 4: adjusting the relative rotation speed of the grinding strip assembly and the grinding sleeve (21) to a working rotation speed of 5 rpm to 60 rpm, and further adjusting the operating speeds of the feeding unit (43), the transmission subsystem and the sorting unit (42), so that storage quantities of the bearing rollers at all positions of the collection unit (41), the sorting unit (42), the feeding unit (43) and the transmission subsystem in the external circulation system are matched and the external circulation is smooth and ordered;

step 5: filling a grinding liquid into the grinding machining area;

step 6, comprising:

1) adjusting the radial expansion mechanism, so that the grinding strip assembly further advances toward the inner surface of the grinding sleeve (21) along the radial direction of the grinding strip assembly until the bearing roller in the grinding machining area contacts with the working surface (2111) of the first spiral groove and the working surface of the grinding strip groove respectively;

2) further adjusting the radial expansion mechanism to apply an average initial pressure of 0.5 N to 2 N to each bearing roller distributed in the grinding machining area; the bearing roller rotating around the axis thereof under the friction drive of the working surface (2111) of the first spiral groove or the working surface of the grinding strip groove, and moving along the grinding strip groove and the first spiral groove (211) respectively under the pushing action of the working surface (2111) of the first spiral groove and the working surface of the grinding strip groove simultaneously; and the rolling surface (32) sliding relative to the working surface (2111) of the first spiral groove and the working surface of the grinding strip groove, and the rolling surface (32) starting to undergo grinding machining of the working surface (2111) of the first spiral groove and the working surface of the grinding strip groove;

step 7: further adjusting the radial expansion mechanism along with the stable operation of the grinding machining to apply an average working pressure of 2 N to 50 N to each bearing roller distributed in the grinding machining area; the bearing roller maintaining the contact relationship with the working surface (2111) of the first spiral groove and the working surface of the grinding strip groove, the rotation movement around the axis thereof and the movement relationship along the grinding strip groove and the first spiral groove (211) in step 6, and the rolling surface (32) continuously undergoing the grinding machining of the working surface (2111) of the first spiral groove and the working surface of the grinding strip groove;

step 8: when the grinding sleeve (21) is of the split structure, adjusting the radial contraction mechanism to compensate the wear of the working surface (2111) of the first spiral groove in real time; sampling the bearing roller after a period of grinding machining; when a surface quality, a shape precision and a size consistency of the rolling surface (32) dissatisfy technical requirements, continuing the grinding machining in the step; and when the surface quality, the shape precision and the size consistency of the rolling surface (32) satisfy the technical requirements, entering step 9; and step 9: reducing the pressure applied to the bearing roller and finally making the pressure reach zero; stopping the operation of the sorting unit (42), the feeding unit (43) and the transmission subsystem, and adjusting the relative rotation speed of the grinding strip assembly and the grinding sleeve (21) to zero; stopping the operation of the reciprocating motion system when the reciprocating motion system is already started in step 2; stopping filling the grinding liquid into the grinding machining area; and returning the grinding strip assembly back to an off-working position along the radial direction of the grinding strip assembly.

* * * * *